US005300412A

United States Patent [19]

Mihayashi et al.

[11] Patent Number: 5,300,412

[45] Date of Patent: * Apr. 5, 1994

[54] SILVER HALIDE COLOR PHOTOGRAPHIC MATERIAL

[75] Inventors: Keiji Mihayashi; Naoki Saito, both of Kanagawa, Japan

[73] Assignee: Fuji Photo Film Co., Ltd., Kanagawa, Japan

[ * ] Notice: The portion of the term of this patent subsequent to Mar. 16, 2010 has been disclaimed.

[21] Appl. No.: 843,161

[22] Filed: Feb. 28, 1992

[30] Foreign Application Priority Data

Mar. 1, 1991 [JP] Japan ..... 3-57697

[51] Int. Cl.[5] ..... G03C 1/46

[52] U.S. Cl. ..... 430/503; 430/505; 430/548; 430/553; 430/557; 430/957; 430/549

[58] Field of Search ..... 430/505, 503, 548, 553, 430/557, 957

[56] References Cited

U.S. PATENT DOCUMENTS

| | | | |
|---|---|---|---|
| 4,149,886 | 4/1979 | Tanaka et al. | 430/557 |
| 4,248,961 | 2/1981 | Hagen et al. | 430/557 |
| 4,495,272 | 1/1985 | Yagihara et al. | 430/548 |
| 4,690,889 | 9/1987 | Saito et al. | 430/548 |

FOREIGN PATENT DOCUMENTS

| | | | |
|---|---|---|---|
| 447920A1 | 3/1991 | European Pat. Off. . | |
| 2-212837 | 8/1990 | Japan . | |
| 2-228652 | 9/1990 | Japan . | |
| 2-257113 | 10/1990 | Japan . | |
| 1204680 | 9/1970 | United Kingdom | 430/557 |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

The present invention relates to a silver halide color photographic material having at least one light-sensitive silver halide emulsion layer or light-insensitive layer on a support, wherein the light-sensitive silver halide emulsion layer or a light-insensitive layer contains a yellow coupler selected from the group consisting of a yellow coupler represented by the following formula (I), a yellow coupler represented by the following formula (II) and combinations thereof, and a cyan coupler selected from the group consisting of a phenolic cyan coupler having a phenylureido group at the 2-position and a carbonamido group at the 5-position, a naphtholic cyan coupler having an amino group at the 5-position and combinations thereof;

(I)

(II)

wherein $X_1$ and $X_2$ each represents an alkyl group, an aryl group, or a heterocyclic group; $X_3$ represents an organic group capable of forming a nitrogen-containing heterocyclic group with >N—; Y represents an aryl group or a heterocyclic group; and Z represents a group capable of being released at the reaction of the coupler shown by the foregoing formula and the oxidation product of a developing agent.

21 Claims, No Drawings

SILVER HALIDE COLOR PHOTOGRAPHIC MATERIAL

FIELD OF THE INVENTION

The present invention relates to a silver halide color photographic material, and more particularly to a silver halide color photographic material containing a novel yellow coupler and a cyan coupler excellent in image storage stability.

BACKGROUND OF THE INVENTION

For a silver halide color photographic material, it has been desired that the coloring property, the color reproducing property, the sharpness, and the storage stability thereof are good, the deviation of the photographic performance by a change in the photographic processing is less, the storage stability of color images formed after processing is excellent, and the cost thereof is low.

As a yellow coupler for forming a color photographic image, an acylacetanilide type coupler having an active methylene (methine) group is generally known as described in T. H. James, *The Theory of Photographic Process,* 4th edition, pages 354–356. However, such a coupler has problems in that the coloring density is low and the color-forming rate is slow. In particular, when these couplers are used as so-called DIR couplers, a large amount thereof must be used since they have a low activity and there are problems with the color image fastness, the color hue, the cost, etc.

As malonedianilide type couplers closely related to the yellow couplers for use in the present invention, there are known couplers described, for example, in U.S. Pat. Nos. 4,149,886, 4,095,984 and 4,447,563, and British Patent 1,204,680. However, these couplers have a problem that the image storage stability, in particular, the fastness to humidity and heat is low. Also, since in the spectral absorption of azomethine dyes obtained from these couplers, there is prolonging of the skirt portion of the spectral absorption curve at the long wavelength side of yellow, an improvement has been desired for color reproduction.

On the other hand, as cyan couplers meeting the foregoing performance requirement, phenol series couplers having a phenylureido group at the 2-position and a carbonamido group at the 5-position thereof are proposed in, for example, JP-A-56-65134, JP-A-57-2044543, JP-A-57-204544, JP-A-57-204545, JP-A-58-33249, and JP-A-58-33250 and have practically been used. (The term "JP-A" as used herein means an "unexamined published Japanese patent application"). Also, naphthol series cyan couplers having an amido group at the 5-position are proposed in many patents such as European Patent 161,626A, etc., and also have practically been used. However, in color photographic materials, there is a limitation on the improvement thereof by only using a cyan coupler and hence a combination with various kinds of yellow couplers has been attempted as proposed in JP-A-2-212837, etc. However, by a combination with these conventional yellow couplers, the image storage stability after processing, the sharpness of color images, the processing dependency and the color reproducibility are as yet insufficient.

SUMMARY OF THE INVENTION

A first object of this invention is, therefore, to provide a silver halide color photographic material having a superior image storage stability.

A second object of this invention is to provide a silver halide color photographic material producing color images having excellent sharpness and fastness.

A third object of this invention is to provide a silver halide color photographic material having an excellent processing dependency.

A fourth object of this invention is to provide a silver halide color photographic material having an excellent color reproducibility.

A fifth object of this invention is to provide a silver halide color photographic material showing less deviation of the photographic performance during the storage thereof.

A sixth object of this invention is to provide an inexpensive silver halide color photographic material.

It has now been discovered that the foregoing objects can be achieved by the silver halide color photographic material of this invention as described hereinbelow.

That is, according to the present invention, there is provided a silver halide color photographic material comprising a support and having on a support at least one light-sensitive silver halide emulsion layer or light insensitive layer, wherein said light-sensitive silver halide emulsion layer or light-insensitive layer contains a yellow coupler selected from the group consisting of a yellow coupler represented by the following formula (I), a yellow coupler represented by the following formula (II) and combinations thereof, and also contains a cyan coupler selected from the group consisting of a phenol series cyan coupler having a phenylureido group at the 2-position and a carbonamido group at the 5-position, a naphthol series cyan coupler having an amino group at the 5-position and combinations thereof;

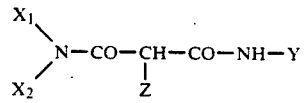

(I)

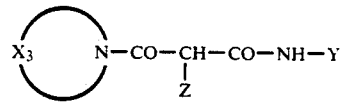

(II)

wherein in the above formulae, $X_1$ and $X_2$ each represents an alkyl group, an aryl group, or a heterocyclic group; $X_3$ represents an organic residue forming a nitrogen-containing heterocyclic group together with >N—; Y represents an aryl group or a heterocyclic group; and Z represents a group capable of being released at the reaction of the cyan coupler shown by each formula described above and an oxidation product of a color developing agent.

DETAILED DESCRIPTION OF THE INVENTION

The present invention is described in detail hereinbelow.

First, the yellow couplers for use in this invention shown by formula (I) and formula (II) described above are explained.

In formula (I), when $X_1$ and $X_2$ each represents an alkyl group, the alkyl group is a straight chain, branched or cyclic, saturated or unsaturated, substituted or unsubstituted alkyl group having form 1 to 30 carbon atoms, and preferably from 1 to 20 carbon atoms. Examples of the alkyl group are methyl, ethyl, propyl, butyl, cyclopropyl, allyl, t-octyl, i-butyl, dodecyl, and 2-hexyldecyl.

Also, when $X_1$ and $X_2$ each represents a heterocyclic group, the group is a 3- to 12-membered, preferably 5- or 6-membered, saturated or unsaturated, substituted or unsubstituted, a monocyclic or condensed ring heterocyclic group having from 1 to 20 carbon atoms, and preferably from 1 to 10 carbon atoms, and containing at least one nitrogen, oxygen, or sulfur atom as the heteroatom. Examples of the heterocyclic group are 3-pyrrolidinyl, 1,2,4-triazol-3-yl, 2-pyridyl, 4-pyrimidinyl, 3-pyrazolyl, 2-pyrrolyl, 2,4-dioxo-1,3-imidazolidin-5-yl, and pyranyl.

When $X_1$ and $X_2$ each represents an aryl group, the aryl group is a substituted or unsubstituted aryl group having from 6 to 20 carbon atoms, and preferably from 6 to 10 carbon atoms. Examples of the aryl group are phenyl and naphthyl.

In formula (II) described above, $X_3$ is an organic residue forming a nitrogen-containing heterocyclic group together with >N— and the nitrogen-containing heterocyclic group is a 3- to 12-membered, preferably 5- or 6-membered, substituted or unsubstituted, saturated or unsaturated, and monocyclic or condensed ring heterocyclic group having from 1 to 20 carbon atoms, and preferably from 1 to 15 carbon atoms, which may have, e.g., an oxygen atom or a sulfur atom as a hetero-atom in addition to the nitrogen atom. Examples of the heterocyclic group are pyrrolidino, piperidino, morpholino, 1-piperazinyl, 1-indolinyl, 1,2,3,4 tetrahydroquinolin-1-yl, 1-imidazolidinyl, 1-pyrazolyl, 1-pyrrolinyl, 1-pyrazolidinyl, 2,3-dihydro-1-indazolyl, 2-isoindolinyl, 1-indolyl, 1-pyrrolyl, 4-thiazine-S,S-dioxo-4-yl, and benzoxazin-4-yl.

Also, when $X_1$ and $X_2$ in formula (I) represents an alkyl group, an aryl group, or a heterocyclic group each having a substituent and the nitrogen-containing heterocyclic group formed by the organic residue shown by $X_3$ and >N— in formula (II) has a substituent, examples of the substituent are a halogen atom (e.g., fluorine and chlorine), an alkoxycarbonyl group (having from 2 to 30, and preferably from 2 to 20 carbon atoms, e.g., methoxycarbonyl, dodecyloxycarbonyl, and hexadecyloxycarbonyl), an acylamino group (having from 2 to 30, and preferably from 2 to 20 carbon atoms, e.g., acetamido, tetradecanamido, 2-(2,4-di-t-amylphenoxy), butanamido, and benzamido), a sulfonamido group (having from 1 to 30, and preferably from 1 to 20 carbon atoms, e.g., methanesulfonamido, dodecanesulfonamido, hexadecylsulfonamido, and benzenesulfonamido), a carbamoyl group (having from 1 to 30, and preferably from 1 to 20 carbon atoms, e.g., N-butylcarbamoyl and N,N-diethylcarbamoyl), an N-sulfonylcarbamoyl group (having from 1 to 30, and preferably from 1 to 20 carbon atoms, e.g., N-mesylcarbamoyl and N-dodecylsulfonylcarbamoyl), a sulfamoyl group (having from 1 to 30, and preferably from 1 to 20 carbon atoms, e.g., N-butylsulfamoyl, N-dodecylsulfamoyl, N-hexadecylsulfamoyl, N-3-(2,4-di-t-amylphenoxy)butylsulfamoyl, and N,N-diethylsulfamoyl), an alkoxy group (having from 1 to 30, and preferably from 1 to 20 carbon atoms, e.g., methoxy, hexadecyloxy, and isopropoxy), an aryloxy group (having from 6 to 20, and preferably from 6 to 10 carbon atoms, e.g., phenoxy, 4-methoxyphenoxy, 3-t-butyl-4-hydroxyphenoxy, and naphthoxy), an aryloxycarbonyl group (having from 7 to 21, and preferably from 7 to 11 carbon atoms, e.g., phenoxycarbonyl), and N-acylsulfamoyl group (having from 2 to 30, and preferably from 2 to 20 carbon atoms, e.g., N-propanoylsulfamoyl and N-tetradecanoylsulfamoyl), a sulfonyl group (having from 1 to 30, and preferably from 1 to 20 carbon atoms, e.g., methanesulfonyl, octanesulfonyl, 4-hydroxyphenylsulfonyl, and dodecanesulfonyl), an alkoxycarbonylamino group (having from 1 to 30, and preferably from 1 to 20 carbon atoms, e.g., ethoxycarbonylamino), a cyano group, a nitro group, a carboxyl group, a hydroxyl group, a sulfo group, an alkylthio group (having from 1 to 30, and preferably from 1 to 20 carbon atoms, e.g., methylthio, dodecylthio, and dodecylcarbamoylmethylthio), a ureido group (having from 1 to 30, and preferably from 1 to 20 carbon atoms, e.g., N-phenylureido and N hexadecylureido), an aryl group (having from 6 to 20, and preferably from 6 to 10 carbon atoms, e.g., phenyl, naphthyl, and 4-methoxyphenyl), a heterocyclic group (having from 1 to 20, and preferably from 1 to 10 carbon atoms, having at least one of nitrogen, oxygen, or sulfur as a heteroatom, and being a 3- to 12-membered, and preferably 5- or 6-membered monocyclic or condensed ring, e.g., 2-pyridyl, 3-pyrazolyl, 1-pyrrolyl, 2,4-dioxo-1,3 imidazolidin-1-yl, 2-benzoxazolyl, morpholino, and indolyl), an alkyl group (having from 1 to 30, and preferably from 1 to 20 carbon atoms, and being straight chain, branched or cyclic and saturated or unsaturated alkyl group, e.g., methyl, ethyl, isopropyl, cyclopropyl, t-pentyl, t octyl, cyclopentyl, t-butyl, s-butyl, dodecyl, and 2-hexyldecyl), an acyl group (having from 1 to 30, and preferably from 2 to 20 carbon atoms, e.g., acetyl and benzoyl), an acyloxy group (having from 2 to 30, and preferably from 2 to 20 carbon atoms, e.g., propanoyloxy and tetradecanoyloxy), an arylthio group (having from 6 to 20, and preferably 6 to 10 carbon atoms, e.g., phenylthio and naphthylthio), a sulfamoylamino group (having from 0 to 30, and preferably from 0 to 20 carbon atoms, e.g., N-butylsulfamoylamino, N-dodecylsulfamoylamino, and N-phenylsulfamoylamino), and an N-sulfonylsulfamoyl group (having from 1 to 30, and preferably from 1 to 20 carbon atoms, e.g., N-mesylsulfamoyl, N-ethanesulfonylsulfamoyl, N-dodecanesulfonylsulfamoyl, and N-hexadecanesulfonylsulfamoyl).

The foregoing substituents may each have a further substituent. Examples of such a substituent are those described above.

In the foregoing substituents, preferred examples thereof are an alkoxy group, a halogen atom, an alkoxycarbonyl group, an acyloxy group, an acylamino group, a sulfonyl group, a carbamoyl group, a sulfamoyl group, a sulfonamido group, a nitro group, an alkyl group, and an aryl group.

When in formulae (I), and (II), Y represents an aryl group, the aryl group is a substituted or unsubstituted aryl group having from 6 to 20, and preferably from 6 to 10 carbon atoms. Typical examples thereof are phenyl and naphthyl.

When in formulae (I) and (II), Y represents a heterocyclic group, the heterocyclic group has the same meaning as the heterocyclic group shown for $X_1$ or $X_2$ described above.

When Y represents a substituted aryl group or a substituted heterocyclic group, examples of the substituent are those illustrated as the examples of the substituent when $X_1$ has the substituent. Preferred examples of the substituent of Y are a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamido group, and an alkyl group.

The groups shown by Z in formulae (I) and (II) may be any conventionally known coupling releasing groups. Preferred examples of the group shown by Z are a nitrogen-containing heterocyclic group bonding to a coupling position via the nitrogen atom of the group, an aromatic oxy group, an aromatic thio group, a heterocyclic oxy group, a heterocyclic thio group, an acyloxy group, a carbamoyloxy group, an alkylthio group, and a halogen atom.

These releasing groups may be non-photographically useful groups, or photographically useful groups or the precursors of the photographically useful groups (e.g., development inhibitors, development accelerators, desilvering accelerators, fogging agents, dyes hardening agents, couplers, scavengers for oxidation product of developing agent, fluorescent dyes, developing agents, and electron transferring agents).

When Z is a photographically useful group, examples thereof are the photographically useful groups or split-off groups capable of releasing the photographically useful groups (e.g., timing group) as described, for example, in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571, and 4,741,994, European Patent Publication Nos. 193389A, 348139A, and 272573A.

When Z represents a nitrogen-containing heterocyclic group bonding to the coupling position via the nitrogen atom of the group, the heterocyclic group is preferably a 5- or 6-membered, substituted or unsubstituted, saturated or unsaturated, and monocyclic or condensed ring heterocyclic group having from 1 to 15, and preferably from 1 to 10 carbon atoms. The heterocyclic group may further contain an oxygen atom or a sulfur atom as a hetero-atom in addition to the nitrogen atom.

Preferred examples of the heterocyclic group represented by Z are 1-pyrazolyl, 1-imidazolyl, pyrrolino, 1,2,4-triazol-2-yl, 1,2,3-triazol-3-yl, benzotriazolyl, benzimidazolyl, imidazolidine-2,4-dione-3-yl, oxazolidine-2,4-dione-3-yl, 1,2,4-triazolidine-3,5-dione-4-yl, 2-imidazolinon-1-yl, 3,5-dioxomorpholino, and 1-indazolyl.

When these heterocyclic groups have a substituent, the substituents are those described above as the examples of the substituent of the groups shown for $X_1$. Preferred examples of the substituent are an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group, and a sulfonyl group.

When Z represents an aromatic oxy group, the group is preferably a substituted or unsubstituted aromatic oxy group having from 6 to 10 carbon atoms and is particularly preferably a substituted or unsubstituted phenoxy group. When the aromatic oxy group has a substituent, examples of the substituent are those illustrated above as the examples of the substituent of the group shown for $X_1$. In these substituents, a preferred substituent is an electron attractive substituent. Examples of such a substituent are a sulfonyl group, an alkoxycarbonyl group, a sulfamoyl group, a halogen atom, a carboxyl group, a carbamoyl group, a nitro group, a cyano group, and an acyl group.

When Z represents an aromatic thio group, the group is preferably a substituted or unsubstituted aromatic thio group having from 6 to 10 carbon atoms and is particularly preferably a substituted or unsubstituted phenylthio group. When the aromatic thio group has a substituent, examples of the substituent are those described above as the examples of the substituent of the group shown for $X_1$. In these substituents, preferred examples thereof are an alkyl group, an alkoxy group, a sulfonyl group, an alkoxycarbonyl group, a sulfamoyl group, a halogen atom, a carbamoyl group, and a nitro group.

When Z represents a heterocyclic oxy group, the moiety of the heterocyclic group is a 3- to 12-membered, and preferably 5- or 6-membered, substituted or unsubstituted, saturated or unsaturated, and monocyclic or condensed ring heterocyclic group having from 1 to 20, and preferably from 1 to 10 carbon atoms and containing at least one nitrogen, oxygen, and sulfur atom as the hetero-atom. Examples of the heterocyclic oxy group include a pyridyloxy group, a pyrazolyloxy group, and a furyloxy group.

When the heterocyclic oxy group has a substituent, examples of the substituent are those described above as the examples of the substituent of the group shown for $X_1$. In these substituents, preferred examples of the substituent include an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, and a sulfonyl group.

When Z represents a heterocyclic thio group, the moiety of the heterocyclic group is a 3- to 12-membered, and preferably 5- or 6-membered, substituted or unsubstituted, saturated or unsaturated, and monocyclic or condensed ring heterocyclic group having from 1 to 20, and preferably from 1 to 10 carbon atoms and including at least one nitrogen, oxygen, and sulfur atom as the heteroatom. Examples of the heterocyclic thio group include a tetrazolylthio group, a 1,3,4-thiadiazolylthio group, a 1,3,4-oxadiazolythio group, a 1,3,4-triazolylthio group, a benzimidazolylthio group, a benzothiazolylthio group, and a 2-pyridylthio group.

When the heterocyclic thio group has a substituent, examples of the substituent are those described above as the examples of the substituent of the group shown for $X_1$. In these substituents, preferred examples thereof include an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, a heterocyclic group, and a sulfonyl group.

When Z represents an acyloxy group, the acyloxy group is preferably a monocyclic or condensed ring and substituted or unsubstituted aromatic acyloxy group having from 6 to 10 carbon atoms or a substituted or unsubstituted aliphatic acyloxy group having from 2 to 30, and preferably from 2 to 20 carbon atoms. When the acyloxy group has a substituent, examples of the substituent are those described above as the examples of the substituent of the group shown for $X_1$.

When Z represents a carbamoyloxy group, the carbamoyloxy group is preferably an aliphatic, aromatic, or heterocyclic and substituted or unsubstituted carbamoyloxy group having from 1 to 30, and preferably from 1 to 20 carbon atoms. Examples of the carbamoyloxy group include N,N-diethylcarbamoyloxy, N-phenylcarbamoyloxy, 1-imidazolylcarbonyloxy, and 1-pyrrolocarbonyloxy.

When the carbamoyloxy group has a substituent, examples of the substituent are those described above as the examples of the substituent of the group shown for $X_1$.

When Z represents an alkylthio group, the alkylthio group is preferably a straight chain, branched, or cyclic, saturated or unsaturated, and substituted or unsubstituted alkylthio group having from 1 to 30, and preferably from 1 to 20 carbon atoms.

When the alkylthio has a substituent, examples of the substituent are those described above as the examples of the group shown for $X_1$.

The particularly preferred ranges of the cyan couplers represented by formulae (I) and (II) are described hereinbelow.

In formula (I), the group shown by $X_1$ is preferably an alkyl group and particularly preferably an alkyl group having from 1 to 10 carbon atoms.

In formulae (I) and (II), the group shown by Y is preferably an aromatic group and particularly preferably a phenyl group having at least one substituent at the ortho-position. Examples of the substituent are those described above as the examples of the substituent which may be bonded to the aromatic group shown by Y and examples of the preferred substituent are also the same as above.

In formulae (I) and (II), the group shown by Z is preferably a 5- to 6-membered nitrogen-containing heterocyclic group bonding to a coupling position with the nitrogen atom of the group, an aromatic oxy group, a 5- or 6-membered heterocyclic oxy group, or a 5- or 6-membered heterocyclic thio group.

Preferred yellow couplers shown by formulae (I) and (II) described above are couplers shown by the following formula (III), (IV), or (V):

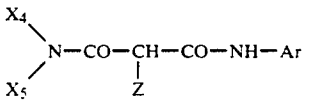
(III)

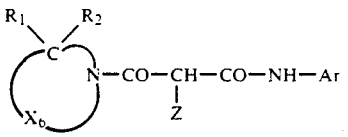
(IV)

-continued

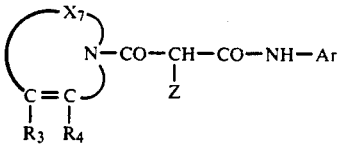
(V)

wherein in the above formulae, Z has the same meaning as described above in formula (I); $X_4$ represents an alkyl group; $X_5$ represents an alkyl group or an aromatic group; Ar represents a phenyl group having at least one substituent at the ortho-position; $X_6$ represents an organic residue forming a nitrogen-containing heterocyclic group (monocyclic or condensed ring) together with $-C(R_1R_2)-N<$; $X_7$ represents an organic residue forming a nitrogen-containing heterocyclic group (monocyclic or condensed ring) together with $-C(R_3)=C(R_4)-N<$; and $R_1$, $R_2$, $R_3$, and $R_4$ each represents a hydrogen atom or a substituent.

In formulae (III) to (V), the detailed explanations and the preferred ranges of the groups shown by $X_4$ to $X_7$, Ar, and Z are the same as the corresponding groups described above in formulae (I) and (II). Also, when $R_1$ to $R_4$ each represents a substituent, examples of the substituent are those described above as the examples of the substituent of the group shown for $X_1$.

In the yellow couplers represented by the foregoing formulae, the couplers shown by formula (IV) or (V) are particularly preferred.

The yellow couplers represented by foregoing formulae (I) to (V) each combine to each other through a divalent or higher valent group at the group shown by $X_1$ to $X_7$, Y, Ar, $R_1$ to $R_4$, or Z to form a dimer or higher polymer (e.g., a telomer or a polymer). In this case, the carbon atom number may be outside the range defined above for each substituent or group.

Preferred examples of the yellow couplers represented by formulae (I) to (V) are non-diffusible type couplers. A non-diffusible type coupler is a coupler having a group for sufficiently increasing the molecular weight of the coupler in the molecule for making the coupler immobile in the layer containing the coupler. As such a group, an alkyl group having from 8 to 30, and preferably from 10 to 20 total carbon atoms or an aryl group having a substituent of from 4 to 20 total carbon atoms is usually used. Such a non-diffusible group may be substituted to any portion of the molecule and the coupler may have two or more such non-diffusible groups.

Specific examples of the yellow couplers represented by formulae (I) to (V) are illustrated hereinbelow but the invention is not limited thereto.

(1)
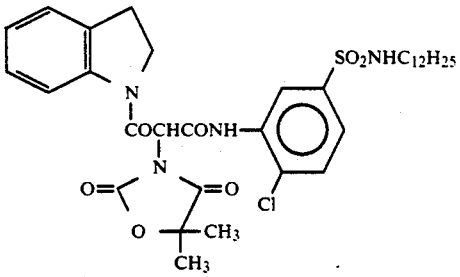
(2)
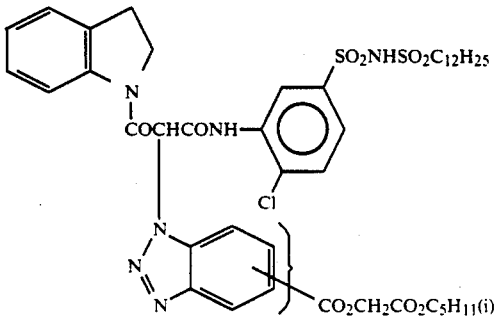
(3)
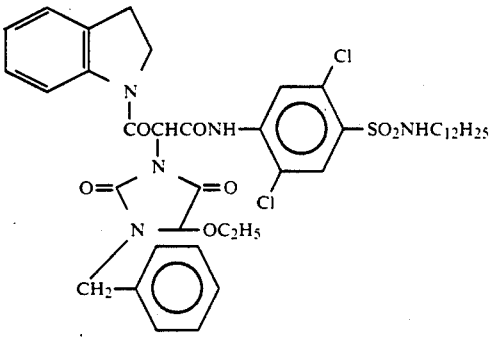
(4)
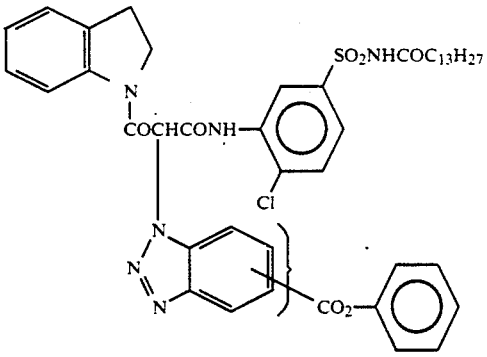
(5)
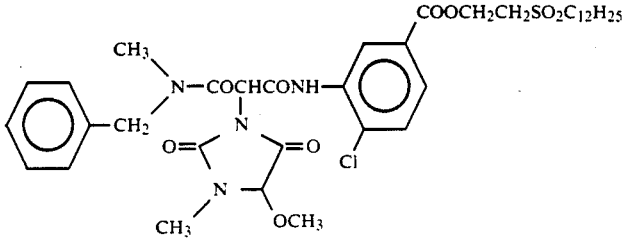

-continued
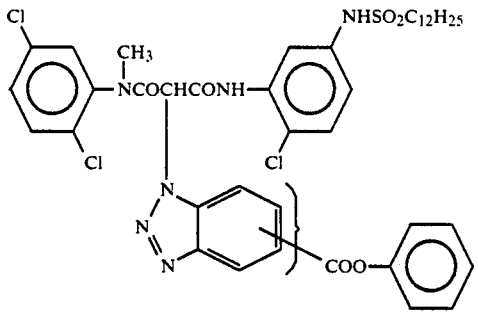
(6)
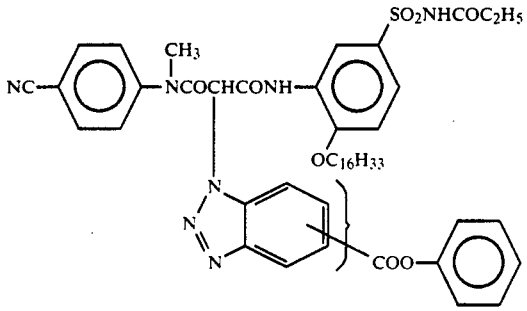
(7)
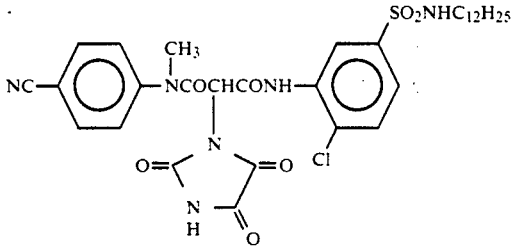
(8)
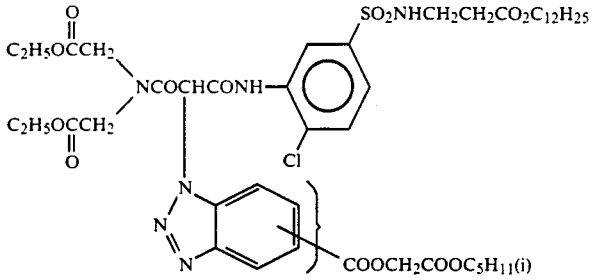
(9)
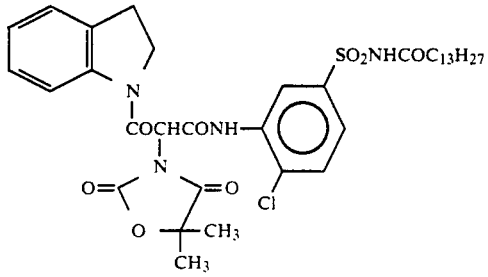
(10)

-continued
(11)
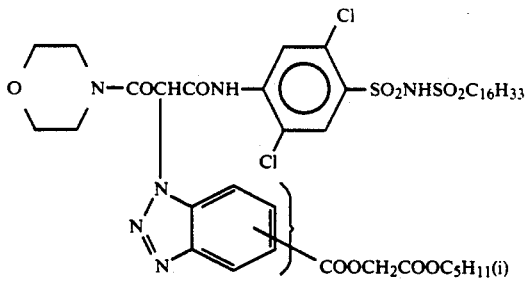
(12)
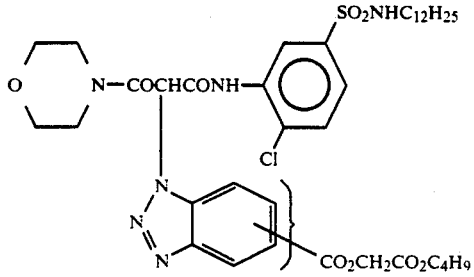
(13)
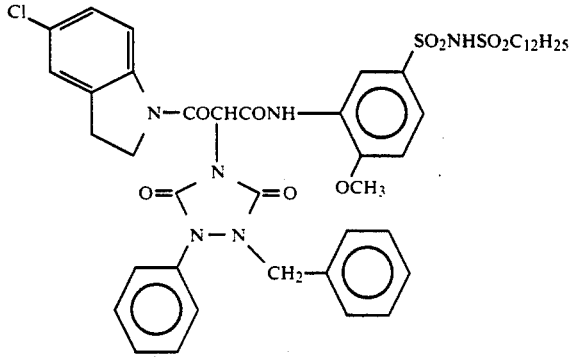
(14)
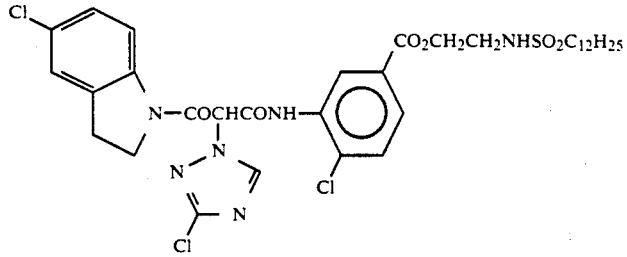
(15)
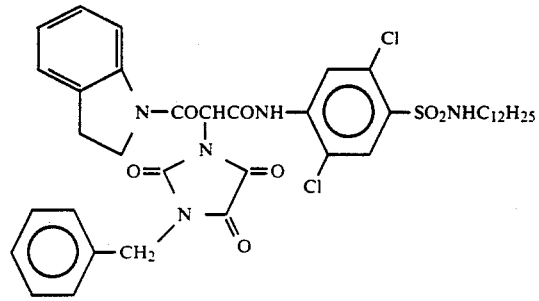

-continued
(16)
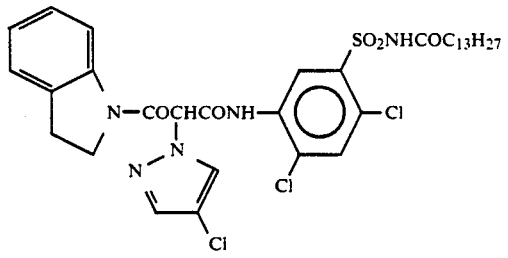
(17)
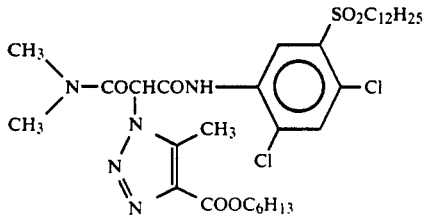
(18)
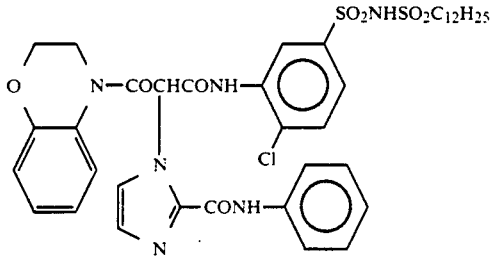
(19)
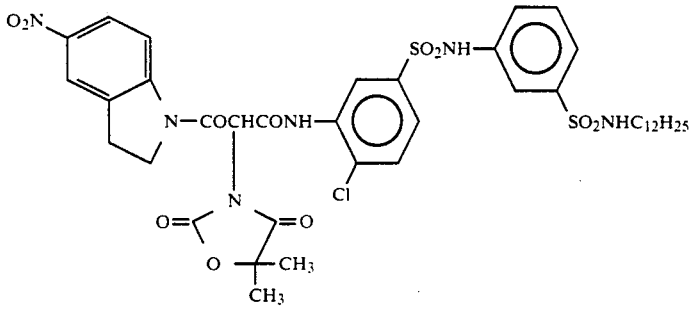
(20)
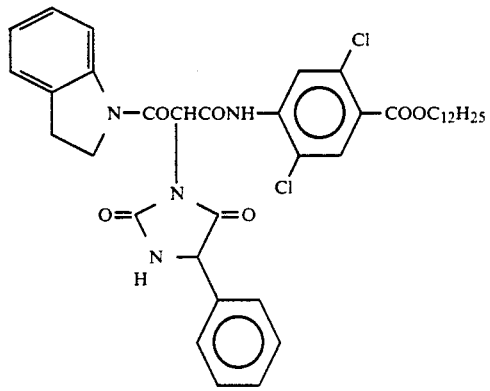

-continued
(21)
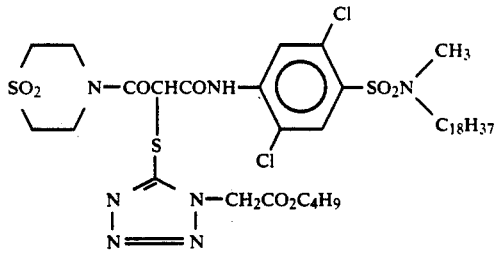
(22)
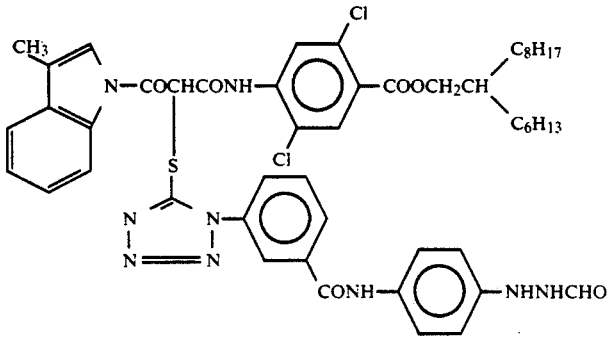
(23)
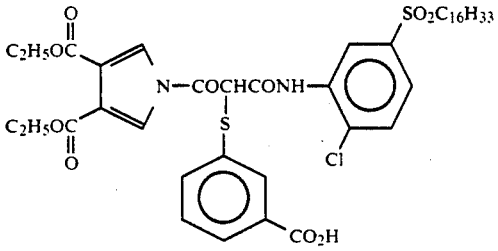
(24)
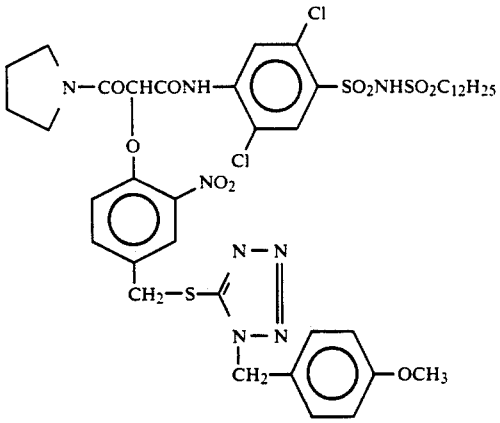
(25)
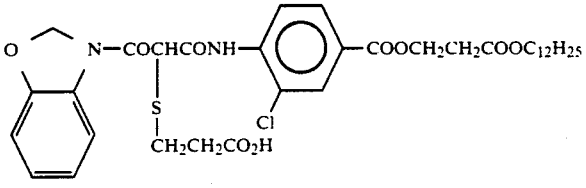

-continued
(26)
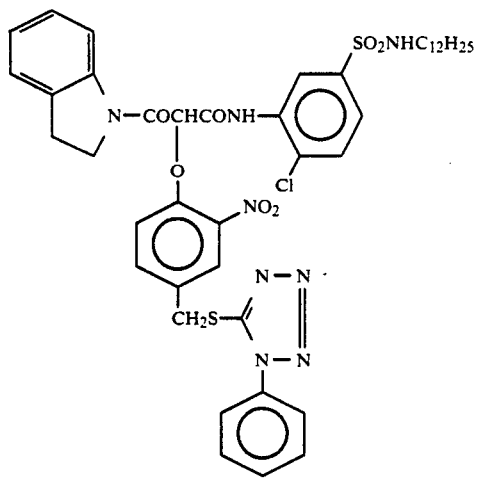
(27)
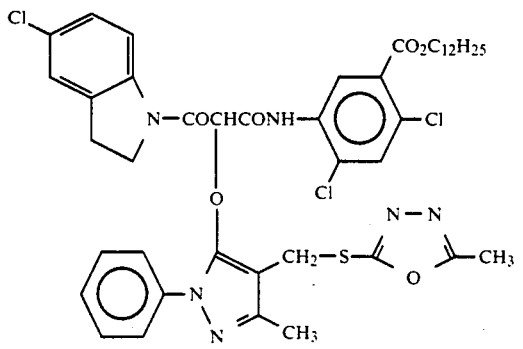
(28)
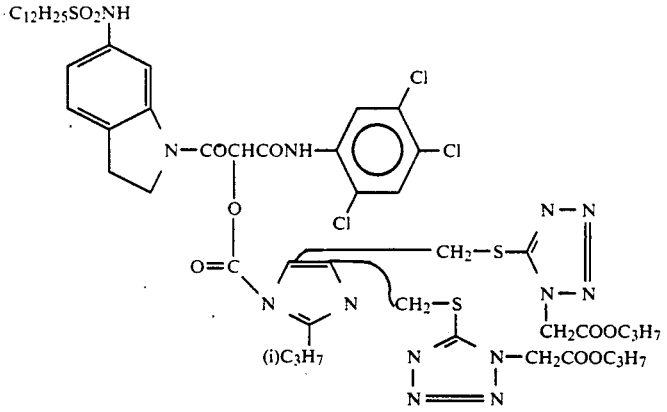
(29)
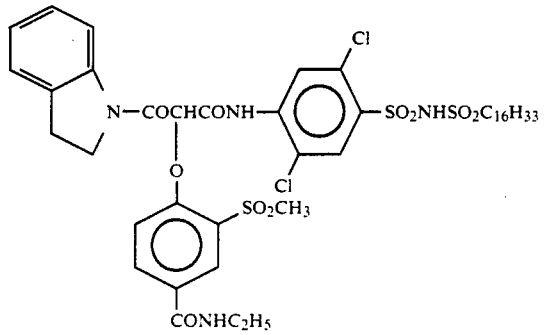

-continued
(30)
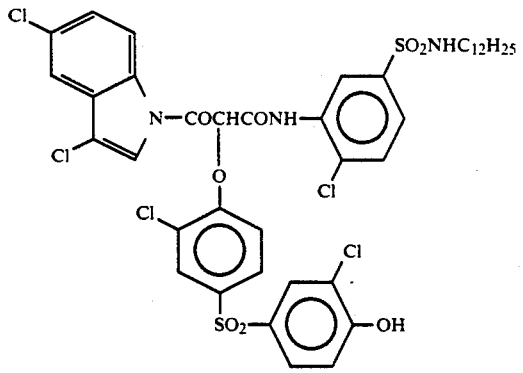
(31)
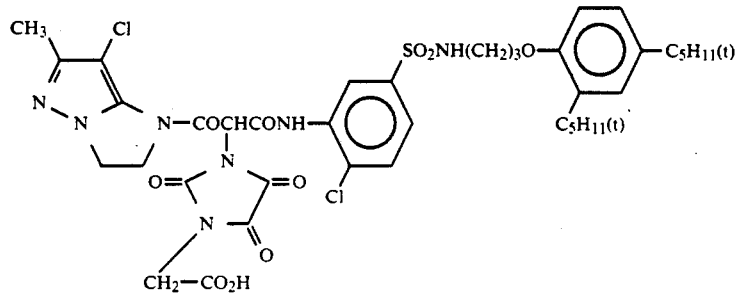
(32)
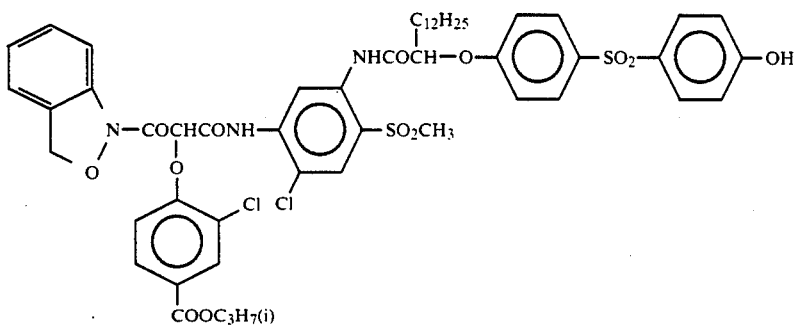
(33)
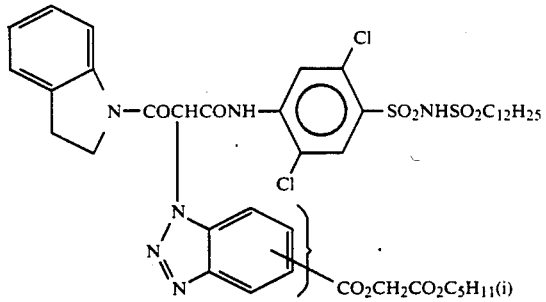
(34)
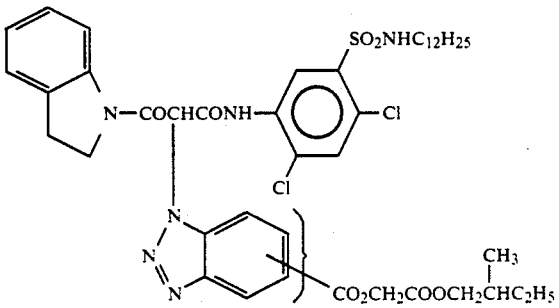

-continued
(35)
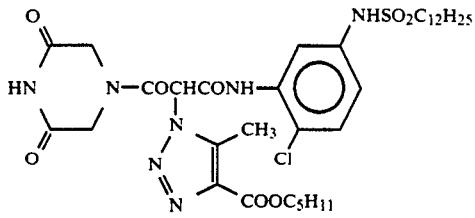
(36)
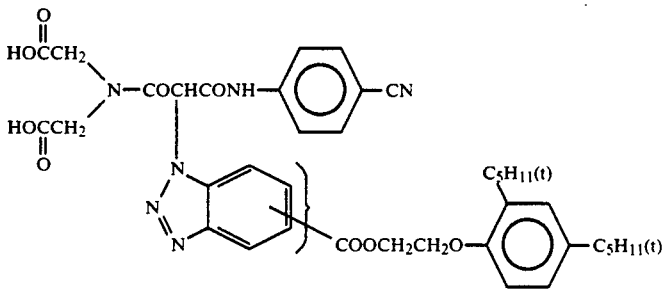
(37)
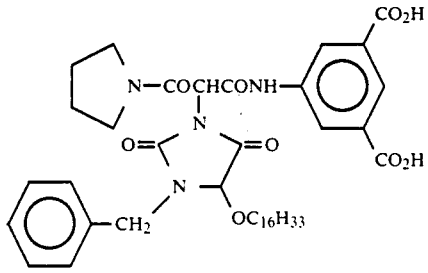
(38)
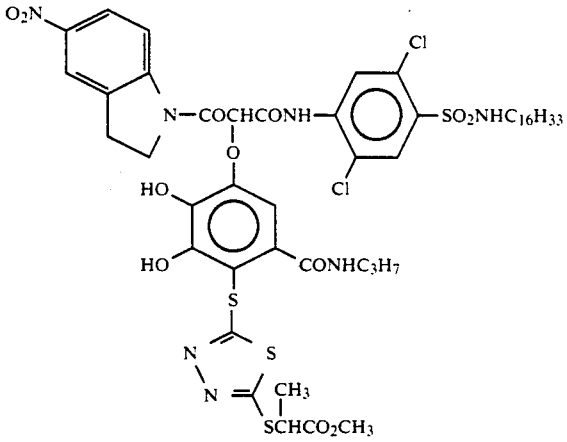
(39)
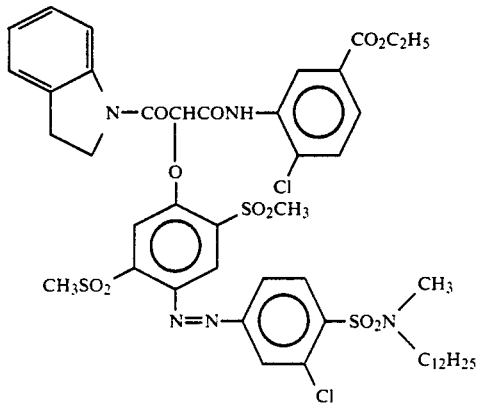

-continued
(40)
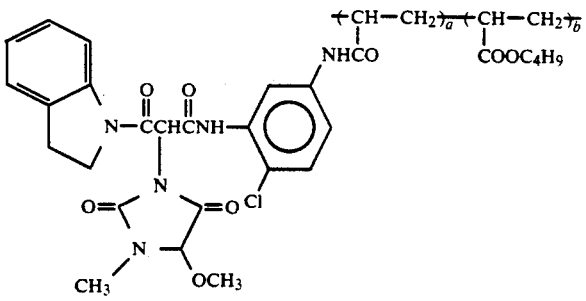
a/b = 1/1 (by weight)
Average Molecular Weight:
30,000
(41)
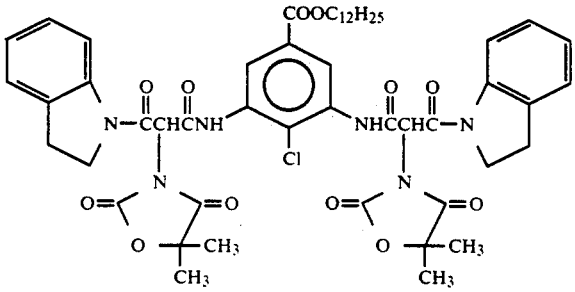
(42)
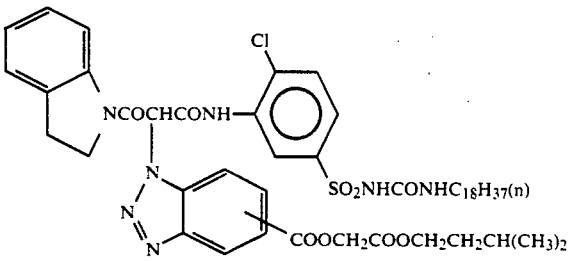
(43)
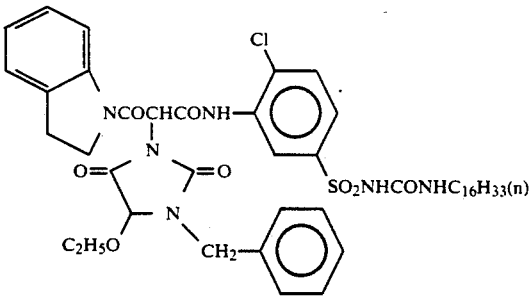
(44)
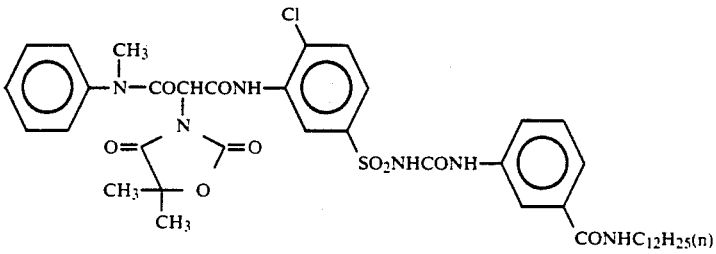

-continued (45)

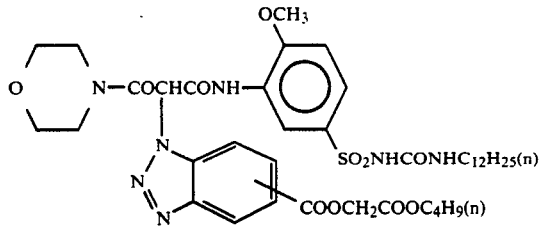

(46)

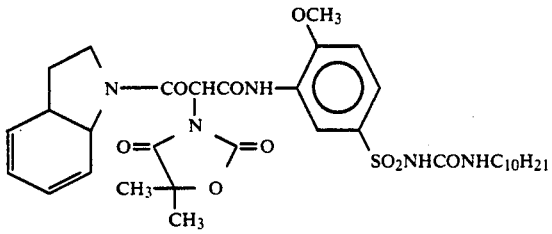

(47)

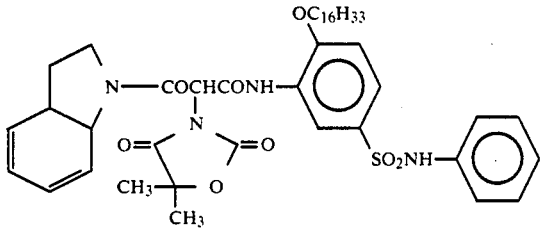

The yellow coupler for use in this invention is preferably incorporated in the light-sensitive silver halide emulsion layer of the silver halide color photographic material or a layer adjacent thereto and is particularly preferably incorporated in the light-sensitive silver halide emulsion layer.

The total amount of the yellow coupler to be added in the color photographic light-sensitive material is from 0.0001 to 0.80 g/m$^2$, preferably from 0.005 to 0.50 g/m$^2$, and more preferably from 0.02 to 0.30 g/m$^2$ when the releasing group shown by Z contains a photographically useful group or component. Also, the total amount of the yellow couplers to be added is from 0.001 to 1.20 g/m$^2$, preferably from 0.01 to 1.00 g/m$^2$, and more preferably from 0.10 to 0.80 g/m$^2$ when the releasing group Z does not contain a photographically useful group or component.

The yellow coupler for use in this invention can be added to the color photographic material in the same manner as ordinary couplers as described hereinbelow.

Synthesis examples of the yellow couplers for use in this invention are shown hereinbelow.

SYNTHESIS EXAMPLE (1)

Synthesis of Coupler (1)

Yellow coupler (1) was synthesized according to the following synthesis scheme:

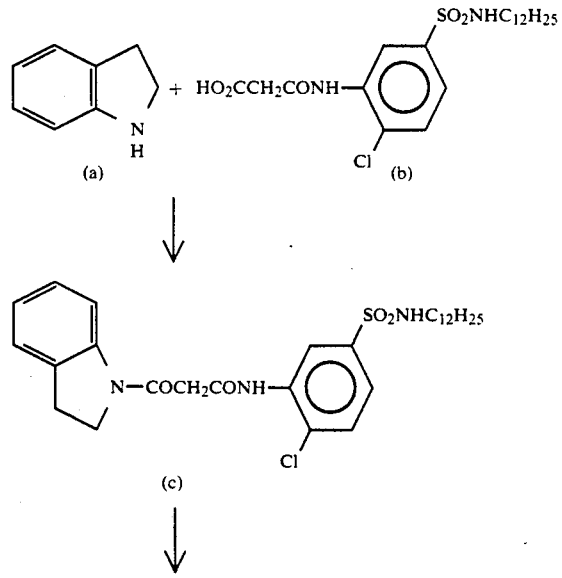

-continued

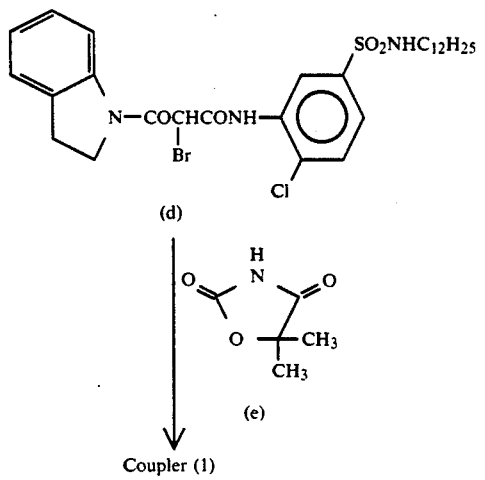

Step (1): In a mixed solvent of 100 ml of N,N-dimethylformamide and 100 ml of acetonitrile were dissolved 3.5 g of compound (a) and 13 g of compound (b). To the solution was added dropwise 40 ml of an acetonitrile solution having dissolved therein 6 g of N,N'-dicyclohexylcarbodiimide at room temperature. After carrying out the reaction for 2 hours, N,N'-dichlorohexylurea thus precipitated was filtered off. Then, to the filtrate that was obtained was added 500 ml of water. The reaction product formed was extracted with 500 ml of ethyl acetate. The extract was washed with water in a separating funnel and then the oil layer that was formed was recovered. The solvent was distilled off under reduced pressure and the residue that was formed was recrystallized by the addition of hexane. Thus, 16.1 g of compound (c) was obtained.

Step (2): To a mixture of 16 g of compound (c) obtained in step (1) and 150 ml of dichloromethane was added dropwise a solution of 10 ml of dichloromethane containing 4.8 g of bromine under ice-cooling (5° C. to 10° C.). After carrying out the reaction for 10 minutes, the reaction mixture was washed with water in a separating funnel. The oil layer (containing compound (d)) was recovered and used in the subsequent step.

Step (3): To 160 ml of N,N-dimethylformamide were added 8.2 g of compound (e) and 8.8 ml of triethylamine and to the solution was added dropwise the dichloromethane solution obtained in step (2) at room temperature. After carrying out the reaction for one hour, 500 ml of ethyl acetate was added to the reaction mixture and th mixture was washed with water in a separating funnel. Then, after neutralizing the mixture with dilute hydrochloric acid, the mixture was washed again with water. The oil layer thus formed was recovered and after distilling off the solvent from the oil layer under reduced pressure, the residue formed was separated and purified by column chromatography. In this case, silica gel was used as the filler and a mixture of ethyl acetate and hexane (1/1 by volume ratio) was used as the eluent. The fractions containing the desired compound were collected and the solvent was distilled off under reduced pressure to provide 16.3 g of waxy compound (1).

SYNTHESIS EXAMPLE (2)

Synthesis of Coupler (2)

By following the same procedure as in the case of synthesizing coupler (1), except that compound (f) shown below was used in place of compound (b) and compound (g) shown below was used in place of compound (e) each being equimolar amount, 15.4 g of the desired waxy compound (2) was obtained.

Compound (f):

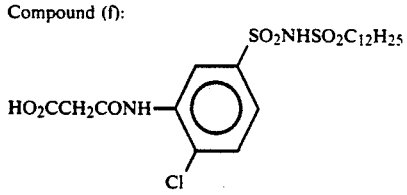

Compound (g):

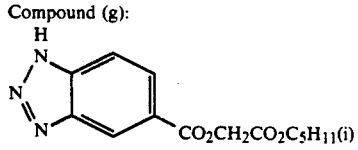

SYNTHESIS EXAMPLE (3)

Synthesis of Coupler (6)

Coupler (6) was synthesized by the following reaction scheme:

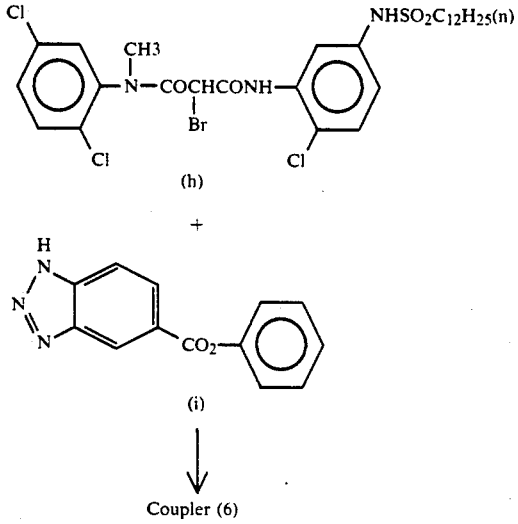

To 50 ml of N,N-dimethylformamide were added 4.42 g of compound (i) and 1.87 g of triethylamine followed by stirring for 10 minutes. To the solution was added dropwise a solution of 6.23 g of compound (h) dissolved in 20 ml of methylene chloride at room temperature over a period of 15 minutes. After carrying out the reaction for one hour at room temperature, the reaction mixture was poured into water and the product was extracted with ethyl acetate. The organic layer (the extract) was recovered, dried on anhydrous magnesium sulfate, and after removing the drying agent by filtration, the solvent was distilled off under reduced pressure. The residue obtained was purified by silica gel column chromatography to provide 4.7 g of desired coupler (6) as a white powder.

The phenol series cyan coupler having a phenylureido group at the 2-position and a carbonamido group at the 5-position for use in this invention ca be preferably shown by the following formula (B):

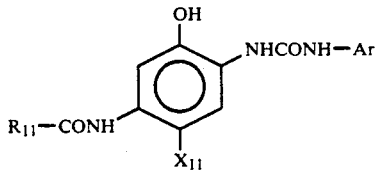

(B)

wherein $R_{11}$ represents an aliphatic group, an aromatic group, or a heterocyclic group; Ar represents an aromatic group; and $X_{11}$ represents a hydrogen atom or a group releasable by the coupling reaction with the oxidation product of an aromatic primary amine color developing agent.

In this case, the aliphatic group means an aliphatic hydrocarbon group (hereinafter the same), such as a straight chain, branched, or cyclic alkyl, alkenyl, or alkynyl group and each group may be substituted.

The aromatic group may be a substituted or unsubstituted aryl group and may form a condensed ring.

Also, the heterocyclic ring may be a substituted or unsubstituted and monocyclic or condensed ring heterocyclic group.

$R_{11}$ represents an aliphatic group having from 1 to 36 carbon atoms, an aromatic group having from 6 to 36 carbon atoms, or a heterocyclic group having from 2 to 36 carbon atoms and is preferably a tertiary alkyl group having from 4 to 36 carbon atoms or a group having from 7 to 36 carbon atoms and represented by the following formula (B');

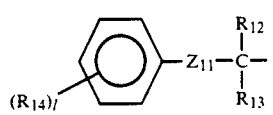

(B')

wherein $R_{12}$ and $R_{13}$, which may be the same or different, each represents a hydrogen atom, an aliphatic group having from 1 to 30 carbon atoms, or an aromatic group having from 6 to 30 carbon atoms; $R_{14}$ represents a monovalent group; $Z_{11}$ represents —O—, —S—, —SO—, or —$SO_2$—; and l represents an integer of from 0 to 5 and when $R_{14}$ is plural, plural $R_{14}$s may be the same or different.

In a preferred embodiment of the group shown by formula (B'), $R_{12}$ and $R_{13}$ each represents a branched alkyl group having from 1 to 18 carbon atoms; $R_{14}$ represents a halogen atom, an aliphatic group, an aliphatic oxy group, a carbonamido group, a sulfonamido group, a carboxy group, a sulfo group, a cyano group, a hydroxy group, a carbamoyl group, a sulfamoyl group, an aliphatic oxycarbonyl group, or an aromatic sulfonyl group; and $Z_{11}$ represents —O—. In this case, it is preferred that $R_{14}$ has from 0 to 30 carbon atoms and l is from 1 to 3.

Ar represents a substituted or unsubstituted aryl group and may be a condensed ring. Typical examples of the substituent of the substituted aryl group include a halogen atom, a cyano group, a nitro group, a trifluoromethyl group, —$COOR_{15}$, —$COR_{15}$, —$SO_2OR_{15}$, —$NHCOR_{15}$, —$CONR_{15}R_{16}$, —$SO_2NR_{15}R_{16}$, —$OR_{15}$, —$OR_{15}(COR_{16})$, —$SO_2R_{17}$, —$SOR_{17}$, —$OCOR_{17}$, and —$NR_{15}(SO_2R_{17})$. In the above formulae, $R_{15}$ and $R_{16}$, which may be the same or different, each represents a hydrogen atom, an aliphatic group, an aromatic group, or a heterocyclic group; $R_{17}$ represents an aliphatic group, an aromatic group, or a heterooyclic group; and the carbon atom number of Ar is from 6 to 30 and Ar is preferably a phenyl group having the foregoing substituent.

$X_{11}$ represents a hydrogen atom or a coupling releasing group (including a releasing atom). Typical examples of the coupling releasing group are a halogen atom, —$OR_{18}$, $SR_{18}$, —$OCOR_{18}$, —$NHCOR_{18}$, —$NHCOSR_{18}$, —OCO— $OR_{18}$, —$OCONHR_{18}$, an aromatic azo group having from 6 to 30 Carbon atoms and a heterocyclic group having from 1 to 30 carbon atoms and bonding to a coupling active position of the coupler with a nitrogen atom (e.g., succinic acid imide, phthalimide, hydantoinyl, pyrazolyl, and 2-benzotriazolyl), wherein $R_{18}$ represents an aliphatic group having from 1 to 30 carbon atoms, an aromatic group having from 6 to 30 carbon atoms, or a heterocyclic group having from 2 to 30 carbon atoms.

The aliphatic group in the above formula (B) may be a saturated or unsaturated, substituted or unsubstituted, and straight chain, branched, or cyclic aliphatic group as described above and typical examples thereof are methyl, ethyl, butyl, cyclohexyl, allyl, propargyl, methoxyethyl, n-decyl, n-dodecyl, n-hexadecyl, trifluoromethyl, heptafluoropropyl, dodecyloxypropyl, 2,4-di-tert-amylphenoxypropyl, and 2,4-di-tert-amylphenoxybutyl.

Also, the aromatic group in formula (B) may be a substituted or unsubstituted aromatic group and typical examples thereof are phenyl, tolyl, 2-tetradecyloxyphenyl, pentafluorophenyl, 2-chloro-5-dodecyloxycarbonylphenyl, 4-chlorophenyl, 4-cyanophenyl, and 4-hydroxyphenyl.

Also, the heterocyclic group in formula (B) may be a substituted or unsubstituted heterocyclic group and typical examples are 2-pyridyl, 4-pyridyl, 2-furyl, 4-thienyl, and quinolinyl.

Preferred examples of the substituents shown in formula (B) are described hereinbelow.

In formula (B), $R_{11}$ is preferably 1-(2,4-ditert-amylphenoxy)amyl, 1-(2,4-di-tert-amylphenoxy)heptyl, and t-butyl.

Also, Ar is particularly preferably 4-cyanophenyl, 4-alkylsulfonylphenyl (e.g., 4-methanesulfonamidophenyl, 4-propanesulfonamidophenyl, and 4-butanesulfonamidophenyl), 4-trifluoromethylphenyl, and halogen-substituted phenyl (e.g., 4-fluorophenyl, 4-chlorophenyl, 4-chloro-3-cyanophenyl, 3,4-dichlorophenyl, and 2,4,5-trichlorophenyl).

$X_{11}$ is preferably a hydrogen atom, a halogen atom, or —$OR_{18}$. $R_{18}$ is preferably a carboxy group, a sulfo group, an alkoxycarbonyl group, a carbamoyl group, a sulfamoyl group, an alkoxysulfonyl group, an acyl group, an alkylsulfonyl group, an arylsulfonyl group, an alkylsulfinyl group, an arylsulfinyl group, a phosphono group or a phosphonoyl group.

Also, $R_{18}$ is preferably shown by the following formula (A):

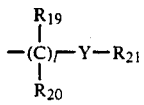

(A)

wherein $R_{19}$ and $R_{20}$ each represents a hydrogen atom or a monovalent group: Y represents —CO—, —SO—, —$SO_2$—, or —$POR_{22}$—; $R_{21}$ and $R_{22}$ each represents a hydroxy group, an alkyl group, an aryl group, an alkoxy group, an alkenyloxy group, an aryloxy group, or a substituted or unsubstituted amino group; and l represents an integer of from 1 to 6.

When in formula (A), $R_{19}$ and/or $R_{20}$ is a monovalent group, the group is preferably an alkyl group (e.g., methyl, ethyl, n-butyl, ethoxycarbonylmethyl, benzyl, n-decyl, and n-dodecyl), an aryl group (e.g., phenyl, 4-chlorophenyl, and 4-methoxyphenyl), an acyl group (e.g., acetyl, decanoyl, benzoyl, and pivaloyl), or a carbamoyl group (e.g., N-ethylcarbamoyl and N-phenylcarbamoyl); and $R_{19}$ and $R_{20}$ are more preferably a hydrogen atom, an alkyl group, or an aryl group.

In formula (A), Y is preferably —CO— or —$SO_2$—, and more preferably —CO—.

In formula (A), $R_{21}$ is preferably an alkyl group, an alkoxy group, an alkenyloxy group, an aryloxy group, or a substituted or unsubstituted amino group, and more preferably an alkoxy group.

Also, in formula (A), l is preferably an integer of from 1 to 3, and more preferably 1.

Further, $R_{18}$ or is most preferably shown by the following formula (A'):

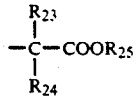

(A')

wherein $R_{23}$ and $R_{24}$ each represents a hydrogen atom, a substituted or unsubstituted alkyl group or a substituted aryl group and $R_{25}$ represents a substituted or unsubstituted alkyl group, a substituted or unsubstituted alkenyl group, or a substituted or unsubstituted aryl group.

The coupler represented by formula (B) may form a dimer, an oligomer or a higher polymer by bonding each other via a divalent or higher valent group in the substituent $R_{11}$, Ar or $X_{11}$. In this case, the carbon atom number may be outside the range defined above for each substituent.

When the cyan coupler shown by formula (B) forms a polymer, a typical example thereof is a homopolymer or copolymer of an addition polymerizable ethylenically unsaturated compound having a cyan dye-forming coupler residue (cyan coloring monomer).

Specific examples of the cyan coupler represented by formula (B) are shown below but the invention is not limited to them.

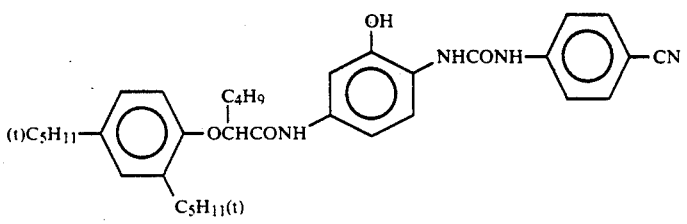

(B-1)

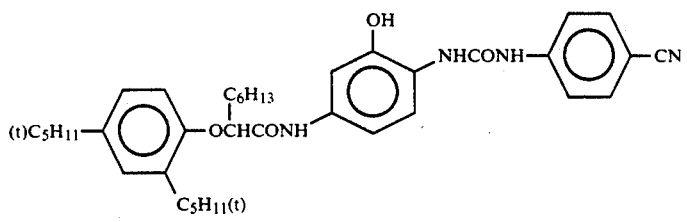

(B-2)

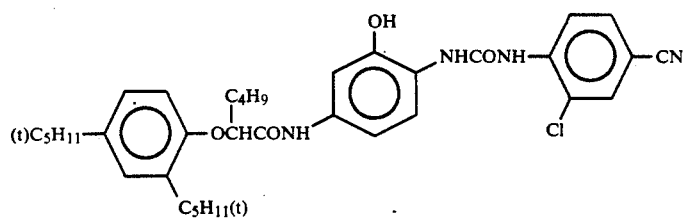

(B-3)

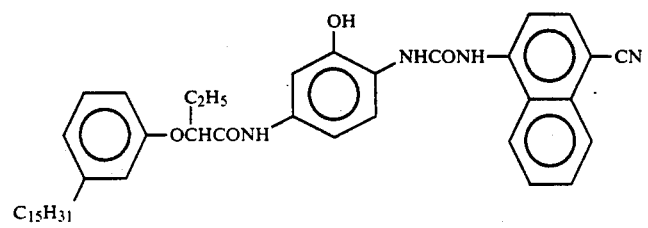

(B-4)

-continued
(B-5)
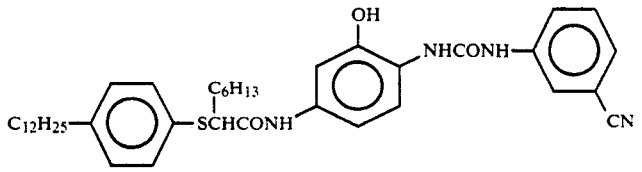
(B-6)
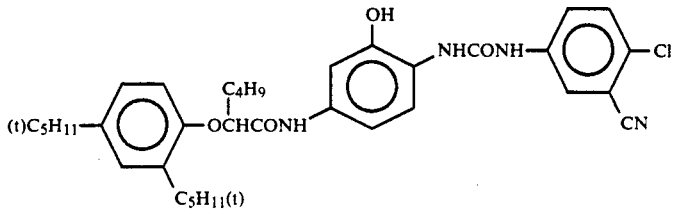
(B-7)
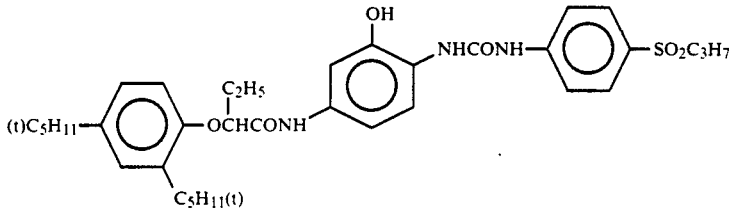
(B-8)
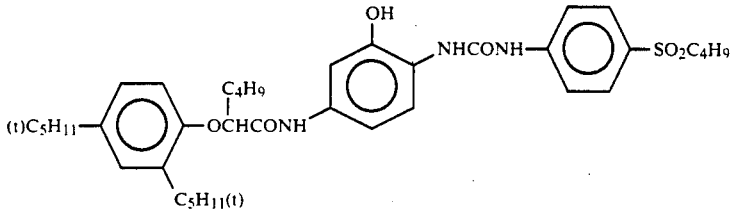
(B-9)
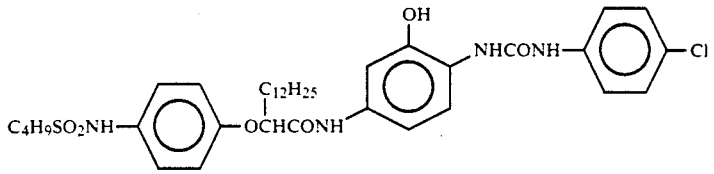
(B-10)
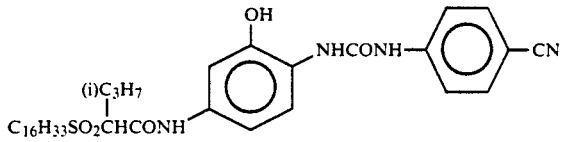
(B-11)
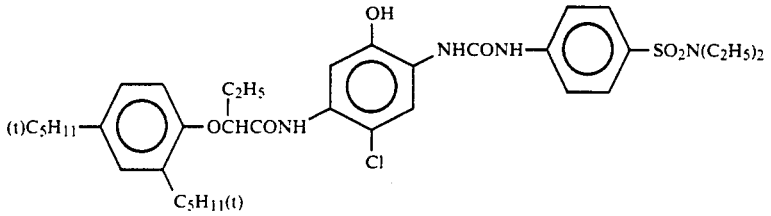

-continued
(B-12)
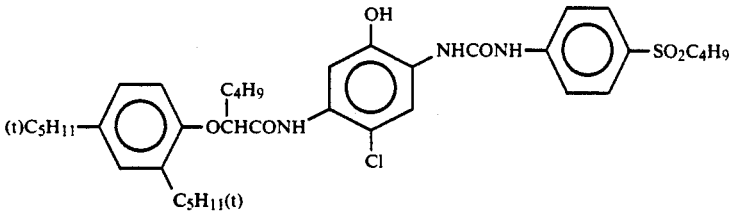
(B-13)
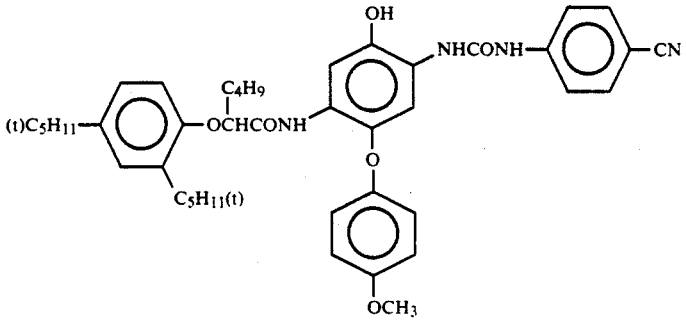
(B-14)
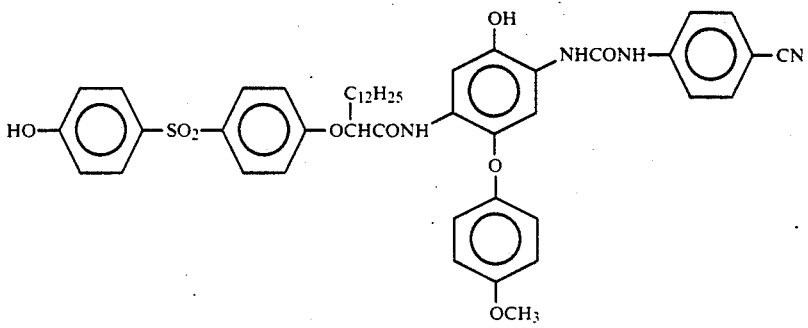
(B-15)
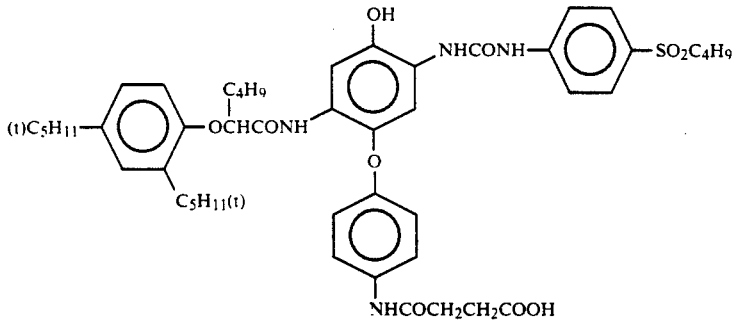
(B-16)
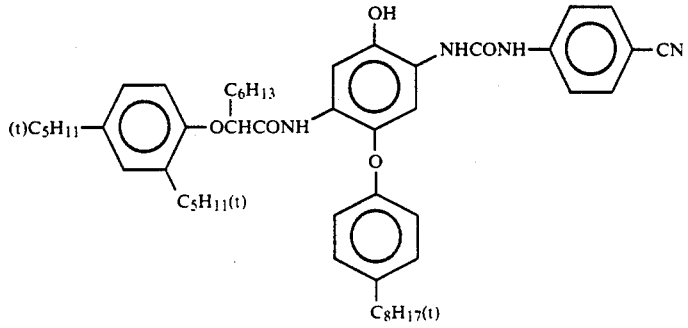

-continued
(B-17)
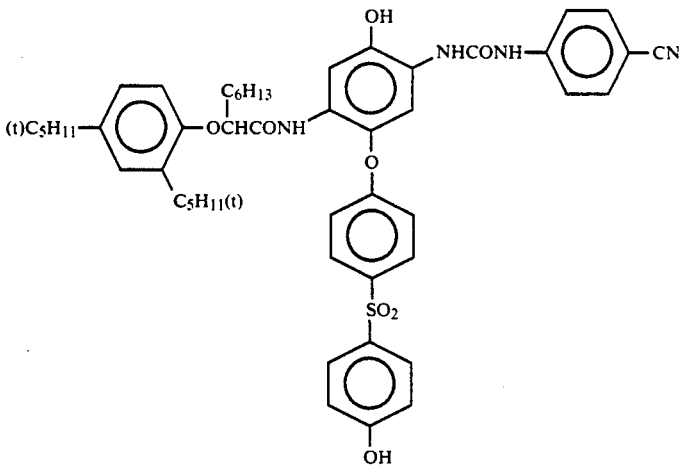
(B-18)
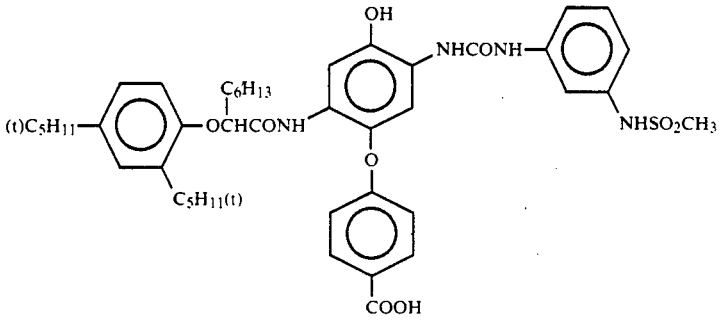
(B-19)
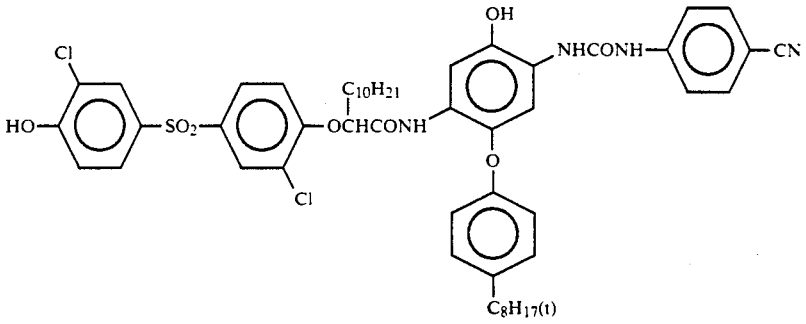
(B-20)
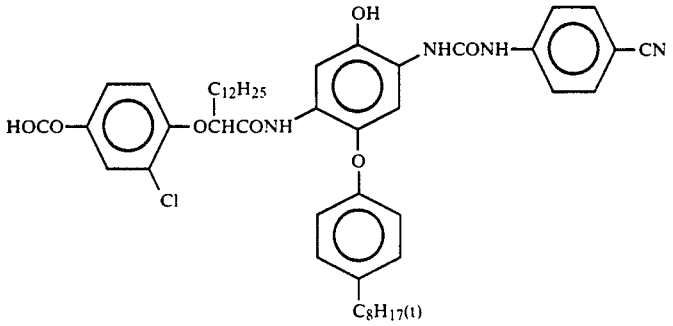

-continued
(B-21)
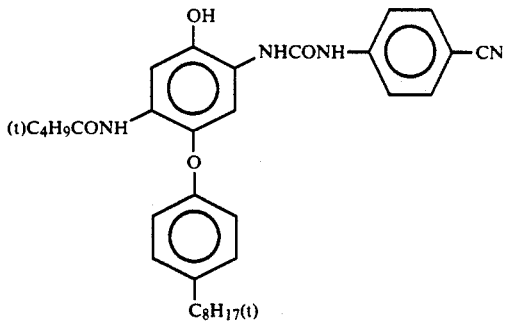
(B-22)
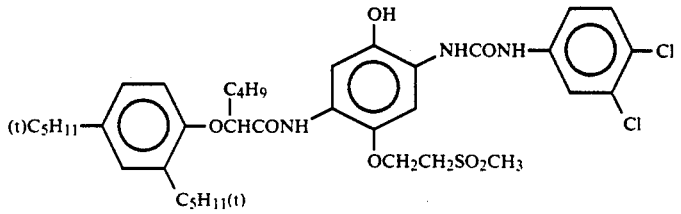
(B-23)
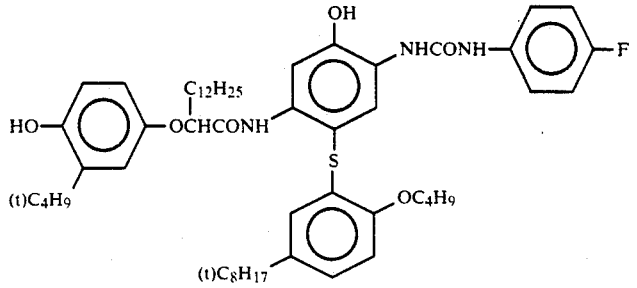
(B-24)
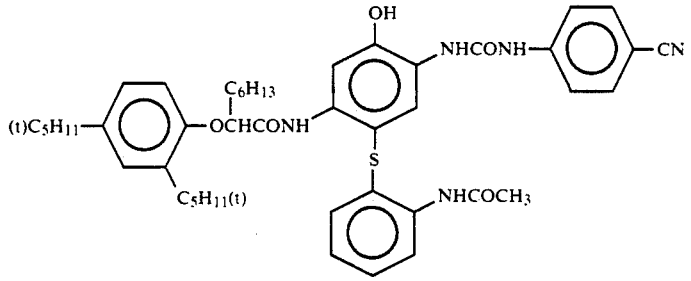
(B-25)
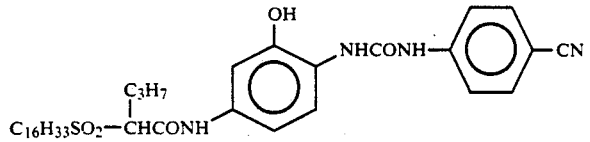
(B-26)
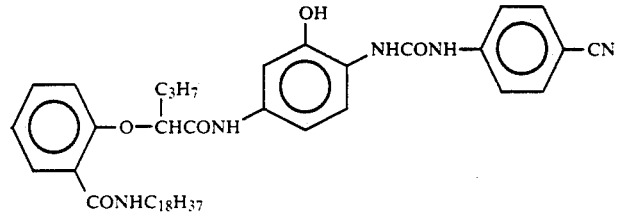

-continued (B-27)

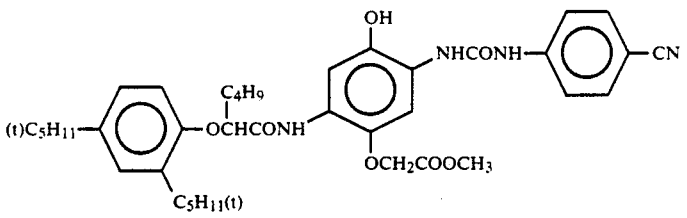

(B-28)

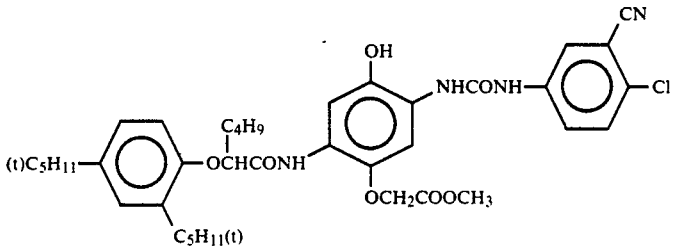

(B-29)

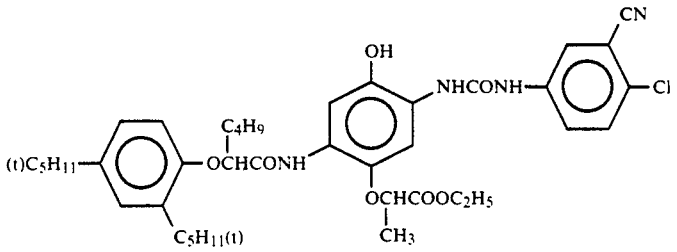

(B-30)

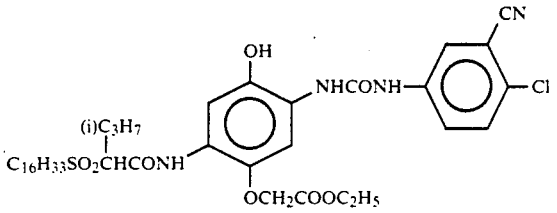

(B-31)

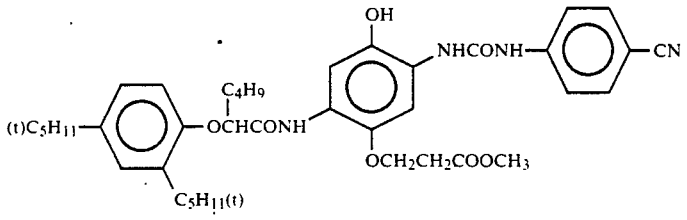

The cyan couplers represented by formula (B) can be synthesized by the methods described in U.S. Pat. Nos. 4,333,999 and 4,427,767, JP-A-57-204543, JP-A-57-204544, JP-A-57-204545, JP-A-59-198455, JP-A-60-35731, JP-A-60-37557, JP-A-61-42658, and JP-A-61-75351.

For incorporating the cyan coupler represented by formula (B) into the silver halide color photographic material, a high-boiling organic solvent is used. The amount of the high-boiling organic solvent which is added is at most 1.0 g per gram of the coupler represented by formula (B) and if the amount of the high-boiling organic solvent is larger than this amount, there is a problem that the sharpness of the color images which are formed is deteriorated. The amount of the organic solvent is preferably less than 0.50 g, and more preferably less than 0.25 g per gram of the coupler. If necessary, the amount may be 0.

The amount of the cyan coupler represented by formula (B) which may be added is in the range of from $1.0\times10^{-5}$ mol to $3.0\times10^{-3}$ mol, and preferably from $5.0\times10^{-5}$ to $1.5\times10^{-3}$ mol per square meter of the color photographic light-sensitive material of this invention.

When the color photographic material of this invention is a multilayer silver halide color photographic material, the foregoing cyan coupler for use in this invention may exist in any layer. However, when the cyan coupler exists in the red-sensitive silver halide emulsion layer thereof, the improvement effect of this invention is large. Also, when the same color-sensitive layer is composed of several silver halide emulsion layers each having a different light sensitivity, it is preferred that the foregoing cyan coupler is used for a low-sensitive silver halide emulsion layer.

The naphthol series cyan coupler having an amino group at the 5-position for use in this invention is preferably represented by following formula (C):

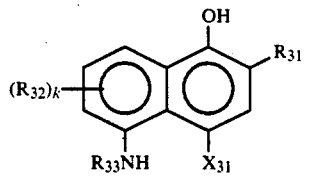

(C)

wherein $R_{31}$ represents $—CONR_{34}R_{35}$, $—SO_2NR_{34}R_{35}$, $—NHCOR_{34}$, $—NHCOOR_{36}$, $—NHSO_2R_{36}$, $—NHCONR_{34}R_{35}$ or $—NHSO_2NR_{34}R_{35}$; $R_{32}$ represents a group capable of being substituted to the naphthalene ring; k represents an integer of from 0 to 3; $R_{33}$ represents a substituent; $X_{31}$ represents a hydrogen atom or a group capable of being released by the coupling reaction with the oxidation product of an aromatic primary amine developing agent. Also, in the above formulae, $R_{34}$ and $R_{35}$, which may be the same or different, each represents a hydrogen atom, an alkyl group, an aryl group, or a heterocyclic group, and $R_{36}$ represents an alkyl group, an aryl group, or a heterocyclic group.

In formula (C), when k is 2 or 3, the $R_{32}$s may be the same or different or may combine with each other to form a ring. Also, the couplers shown by formula (C) may combine with each other through a divalent or higher valent group at $R_{31}$, $R_{32}$, $R_{33}$, or $X_{31}$ to form a dimer or higher polymer.

The cyan couplers represented by formula (C) are described in detail hereinbelow.

In formula (C), $R_{31}$ represents $—CONR_{34}R_{35}$, $—SO_2NR_{34}R_{35}$, $—NHCOR_{34}$, $—NHCOOR_{36}$, $—NHSO_2R_{36}$, $—NHCONR_{34}R_{35}$ or $—NHSO_2R_{34}R_{35}$ (wherein $R_{34}$, $R_{35}$, and $R_{36}$ each independently represents an alkyl group having from 1 to 30 total carbon atoms (hereinafter referred to as C number), an aryl group having from 6 to 30 C number, or a heterocyclic group having from 2 to 30 C number, and further $R_{34}$ and $R_{35}$ each may be a hydrogen atom).

In formula (C), $R_{32}$ represents a group (including an atom, hereinafter the same) capable of being substituted to the naphthalene ring and typical examples of the group are a halogen atom (e.g., fluorine, chlorine, bromine, and iodine), a hydroxy group, a carboxy group, an amino group, a sulfo group, a cyano group, an alkyl group, an aryl group, a heterocyclic group, a carbonamido group, a sulfonamido group, a carbamoyl group, a sulfamoyl group, a ureido group, an acyl group, an acyloxy group, an alkoxy group, an aryloxy group, an alkylthio group, an arylthio group, an alkylsulfonyl group, an arylsulfonyl group, a sulfamoylamino group, an alkoxycarbonylamino group, a nitro group, and an imido group. When k is 2, examples of $R_{32}$ include a dioxymethylene group and a trimethylene group. The C number of $(R_{32})_k$ is from 0 to 30.

In formula (C), $R_{33}$ represents a substituent and is preferably represented by the following formula (C-1):

$$R_{37}(Y_{31})_m— \quad \text{(C-1)}$$

wherein $Y_{31}$ represents >NH, >CO, or $>SO_2$; m represents 0 or 1; and $R_{37}$ represents a hydrogen atom, an alkyl group having from 1 to 30 C number, an aryl group having from 6 to 30 C number, a heterocyclic group having from 2 to 30 C number, $—COR_{38}$, $—NR_{38}R_{39}$, $—CONR_{38}R_{39}$, $—OR_{40}$, $—PO—(OR_{40})_2$, $—SO_2NR_{38}R_{39}$, $—CO_2R_{40}$, $—CO—SR_{40}$, $—SO_2OR_{40}$, or $—SO_2R_{40}$ (wherein $R_{38}$, $R_{39}$ and $R_{40}$ have the same meaning as the foregoing $R_{34}$, $R_{35}$, and $R_{36}$, respectively).

In $R_{31}$ or $R_{37}$, $R_{34}$ and $R_{35}$ of $—NR_{34}R_{35}$ or $R_{38}$ and $R_{39}$ of $—NR_{38}R_{39}$ may combine with each other to form a nitrogen-containing heterocyclic ring (e.g., pyrrolidine, piperidine, and morpholine).

In formula (C), $X_{31}$ represents a hydrogen atom or a group capable of being released by the coupling reaction with the oxidation product of an aromatic primary amine developing agent (hereinafter referred to as a releasing group and including a releasing atom) and typical examples of the releasing group are a halogen atom, $—OR_{41}$, $—SR_{41}$, $—OCOR_{41}$, $—NHCOR_{41}$, $—NHCOSR_{41}$, $—OCOOR_{41}$, $OCONHR_{41}$, a thiocyanate group, and a heterocyclic group having from 1 to 30 C number and bonding to the coupling active position with a nitrogen atom (e.g., a succinic acid imido group, a phthalimido group, a pyrazolyl group, a hydantoinyl group, and a 2-benzotriazolyl group). In the above formulae, $R_{41}$ has the same meaning as the above-described $R_{36}$ group.

In the above formula, the alkyl group may be a straight chain, branched, or cyclic alkyl group and may contain an unsaturated bond or a substituent (e.g., a halogen atom, a hydroxy group, an aryl group, a heterocyclic group, an alkoxy group, an aryloxy group, an alkylsulfonyl group, an arylsulfonyl group, an alkoxycarbonyl group, an acyloxy group, and an acyl group). Typical examples of the alkyl group are methyl, isopropyl, isobutyl, t-butyl, 2-ethylhexyl, cyclohexyl, n-dodecyl, n-hexadecyl, 2-methoxyethyl, benzyl, trifluoromethyl, 3-dodecyloxypropyl, and 4-(2,4-di-t-pentylphenoxy)propyl.

Also, in the above formulae, the aryl group may be a condensed ring (e.g., a naphthyl group) or may have a substituent (e.g., a halogen atom, an alkyl group, an aryl group, an alkoxy group, an aryloxy group, a cyano group, an acyl group, an alkoxycarbonyl group, a carbonamido group, a sulfonamido group, a carbamoyl group, an alkylsulfonyl group, and an arylsulfonyl group). Typical examples thereof are phenyl, tolyl, pentafluorophenyl, 2-chlorophenyl, 4-hydroxyphenyl, 4-cyanophenyl, 2-tetradecyloxyphenyl, 3-chloro-5-dodecyloxyphenyl, and 4-t-butylphenyl.

Also, in the above formulae, the heterocyclic group is a 3- to 8-membered monocyclic or condensed ring heterocyclic group containing at least one hetero-atom of O, N, S, P, Se, and Te in the ring and may have a substituent (e.g., a halogen atom, a carboxy group, a hydroxy group, a nitro group, an alkyl group, an aryl group, an alkoxy group, an aryloxy group, an alkoxycarbonyl group, an aryloxycarbonyl group, an amino group, a carbamoyl group, a sulfamoyl group, an alkylsulfonyl group, and an arylsulfonyl group). Typical examples of the heterocyclic group are 2-pyridyl, 4-pyridyl, 2-furyl, 4-thienyl, benzotriazol-1-yl, 5-phenyltetrazol-1-yl, 5-methylthio-1,3,4-thiadiazol-2-yl, and 5-methyl-1,3,4-oxadiazol-2-yl.

Preferred embodiments of the cyan coupler represented by formula (C) are described hereinbelow.

In formula (C), $R_{31}$ is preferably $—CONR_{34}R_{35}$ or $—SO_2NR_{34}R_{35}$ and practical examples thereof are carbamoyl, N-n-butylcarbamoyl, N n-dodecylcarbamoyl, N-(3-n-didecyloxypropyl)carbamoyl, N-cyclohexylcarbamoyl, N-[3-(2,4-di-t-pentylphenoxy)propyl]carbamoyl, N-hexadecyl-carbamoyl, N-[4-(2,4-di-t-pentylphenoxy)carbamoyl, N-(3-dodecyloxy-2-methylpropyl)carbamoyl, N-[3-(4-t-octylphenoxy)propyl]carbamoyl, N hexadecyl-N-methylcarbamoyl, N-(3-dodecyloxypropyl)sulfamoyl, and N-[4-(2,4-di-t-pentylphenoxy)butyl]sulfamoyl. $R_{31}$ is particularly preferably $—COR_{34}R_{35}$.

For $(R_{32})_k$, the case of k=0, that is, the unsubstituted case is the most preferable and then the case of k=1 is preferable. $R_{32}$ is preferably a halogen atom, an alkyl group (e.q., methyl, isopropyl, t-butyl, and cyclopentyl), a carbonamido group (e.g., acetamido, pivalinamido, trifluoroacetamido and benzamido), a sulfonamido group (e.g., methanesulfonamido and toluenesulfonamido), or a cyano group.

$R_{33}$ in formula (C) corresponds to the case when m=0 in formula (C-1). More preferably, $R_{37}$ in formula (C-1) is $—COR_{38}$ (e.g., formyl, acetyl trifluoroacetyl, 2-ethylhexanoyl, pivaloyl, benzoyl, pentafluorobenzoyl, and 4-(2,4-di-t-pentylphenoxy)butanoyl), $—COOR_{40}$ (e.g., methoxycarbonyl, ethoxycarbonyl, isobutoxycarbonyl, 2-ethylhexyloxycarbonyl, n-dodecyloxycarbonyl, and 2-methoxyethoxycarbonyl), or $—SO_2R_{40}$ (e.g., methylsulfonyl, n-butylsulfonyl, n-hexadecylsulfonyl, phenylsulfonyl, p-tolylsulfonyl, p-chlorophenylsulfonyl, and trifluoromethylsulfonyl), and is particularly preferably $—COOR_{40}$.

In formula (C), $X_{31}$ is preferably a hydrogen atom, a halogen atom, $—OR_{41}$ (e.g., an alkoxy group such as ethoxy, 2-hydroxyethoxy, 2-methoxyethoxy, 2-(2-hydroxyethoxy)ethoxy, 2-methylsulfonylethoxy, ethoxycarbonylmethoxy, carboxymethoxy, 3-carboxypropoxy, N-(2-methoxyethyl)carbamoylmethoxy, 1-carboxytridecyloxy, 2-methanesulfonamidoethoxy, 2-(carboxymethylthio)ethoxy, 2-(1-carboxytridecylthio)ethoxy, etc., and an aryloxy group such as 4-cyanophenoxy, 4-carboxyphenoxy, 4-methoxyphenoxy, 4-t-octylphenoxy, 4-nitrophenoxy, 4-(3-carboxypropanamido)phenoxy, 4-acetamidophenoxy, etc.), or $—SR_{11}$ (e.g., an alkylthio group such as carboxymethylthio, 2-carboxymethylthio, 2-methoxyethylthio, ethoxycarbonylmethylthio, 2,3-dihydroxypropylthio, 2-(N,N-dimethylamino)ethylthio, etc., and an arylthio group such as 4-carboxyphenylthio, 4-methoxyphenylthio, 4-(3-carboxypropanamido)phenylthio, etc.), and is particularly preferably a hydrogen atom, a chlorine atom, an alkoxy group, or an alkylthio group.

The cyan couplers represented by formula (C) may combine with each other through a divalent or higher valent group at $R_{31}$, $R_{32}$, $R_{33}$, or $X_{31}$ to form a dimer or higher polymer. In this case, the carbon atom number of each group may be outside the foregoing range.

Specific examples of each group in formula (C) and the cyan coupler represented by formula (C) are shown below but the invention is not limited to these examples.

Examples of $R_{31}$:

$—CONH(CH_2)_3O—A$ $—CONH(CH_2)_4O—A$ $—CONH(CH_2)_3OC_{12}H_{25}\text{-}n$ $—CONH(CH_2)_3OC_{10}H_{21}\text{-}n$ $—CONH(CH_2)_3OCH_2CH(C_2H_5)C_4H_9\text{-}n$ $—CONHC_{16}H_{33}\text{-}n$ -continued $—CONHCH_2CH(CH_3)CH_2C_{12}H_{25}\text{-}n$ $—CONH(CH_2CH_2O)_2C_{12}H_{25}\text{-}n$ $—CONHCH_2CH_2OC_{12}H_{25}\text{-}n$

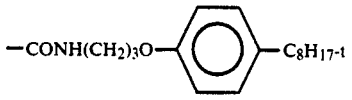

$—CONH(CH_2)_3O—C_8H_{17}\text{-}t$ $—CONHCH_2CH(C_6H_{13})C_8H_{17}\text{-}n$

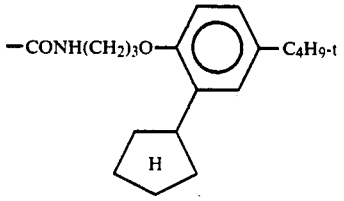

$—CONH(CH_2)_3O—C_4H_9\text{-}t$ $—CONHC_4H_9\text{-}n$

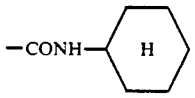

$—CON(CH_3)C_{16}H_{33}\text{-}n$ $—CONH(CH_2)_3OC_{14}H_{29}\text{-}n$ $—CONH(CH_2)_3OC_{11}H_{23}\text{-}n$ $—SO_2NH(CH_2)_3OC_{12}H_{25}\text{-}n$

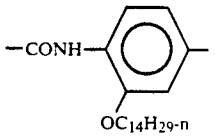

$—CONH—C_6H_4—OC_{14}H_{29}\text{-}n$

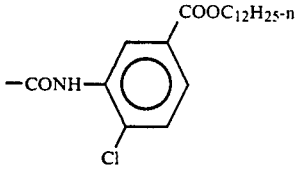

$—CONH—C_6H_3(COOC_{12}H_{25}\text{-}n)—Cl$ $—SO_2N(C_8H_{17}\text{-}n)C_8H_{17}\text{-}n$ $—NHCO(CH_2)_3O—A$

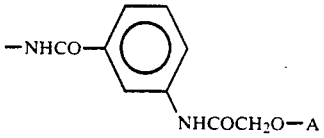

$—NHCO—C_6H_4—NHCOCH_2O—A$ $—NHSO_2C_{16}H_{33}\text{-}n$

-continued

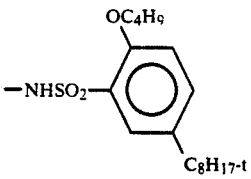

$-NHCOOC_{12}H_{25}$-n

Examples of $R_{32}$:

$-F$ $-Cl$ $-CN$ $-CH_3$ $-CF_3$ $-C_4H_9$-t $-C_8H_{17}$-t $-NHCOCH_3$ $-NHSO_2CH_3$ $-NHCOOC_2H_5$

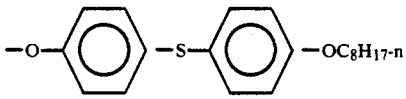

Examples of $R_{33}NH-$:

$-NHCOCH_3$ $-NHCOCF_3$ $-NHCO-$

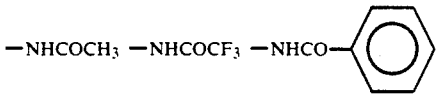

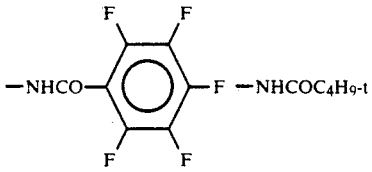

$-NHCOC_4H_9$-t $-NHCO(CH_2)_3O-A$ $-NHCO-$

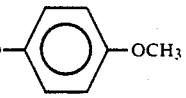

$-OCH_3$ $-NHCO-$

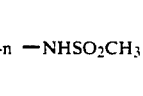

$-OC_{12}H_{25}$-n $-NHSO_2CH_3$ $-NHSO_2CF_3$ $-NHSO_2C_4H_9$-n

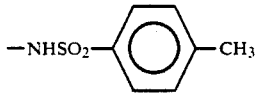

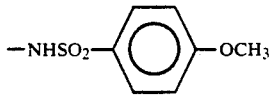

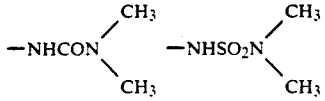

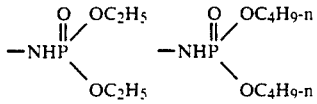

-continued

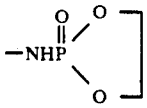

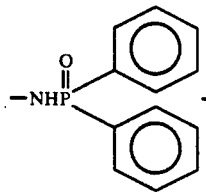

$-NHCOOCH_3$

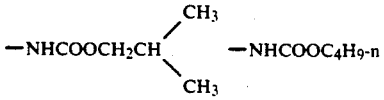

$-NHCOOC_4H_9$-n $-NHCOOCH_2CH_2OCH_3$

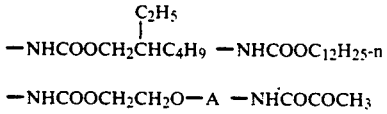

$-NHCOOC_{12}H_{25}$-n $-NHCOOCH_2CH_2O-A$ $-NHCOCOCH_3$

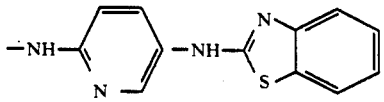

Examples of $X_{31}$:

$-OC_2H_5$ $-OCH_2CH_2OH$ $-OCH_2CH_2SO_2CH_3$ $-O(CH_2CH_2O)_2H$ $-OCH_2COOH$ $-O(CH_2)_3COOH$ $-OCH_2COOC_2H_5$ $-OCH_2CONHCH_2CH_2OCH_3$ $-OCH_2CH_2SCH_2COOH$ $-OCH_2CH_2S\overset{C_{12}H_{25}\text{-}n}{\overset{|}{C}}HCOOH$ $-OCH_2CH_2OCH_3$ $-OCH_2CH_2NHSO_2CH_3$

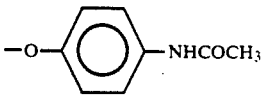

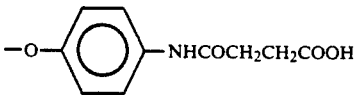

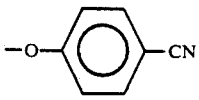

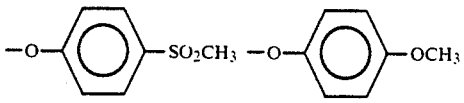

-continued

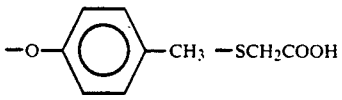

$-SCH_2CH_2COOH$ $-\overset{CH_3}{\overset{|}{S}}CHCOOH$ $-SCH_2COOC_2H_5$ $-SCH_2CH_2OH$

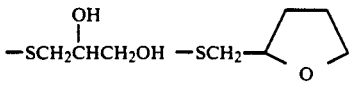

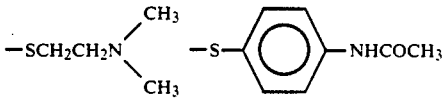

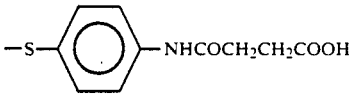

-continued

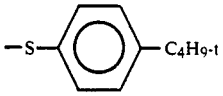

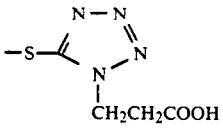

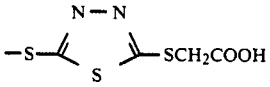

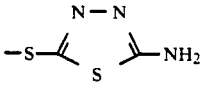

TABLE 1

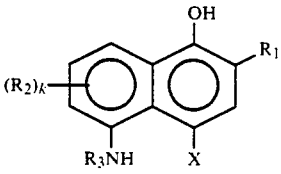

k = 0

| No. | $R_1$ | $R_3$ | X |
|---|---|---|---|
| C-1 | $-CONH(CH_2)_3O-A$ | $CH_3CO-$ | H |
| C-2 | $-CONH(CH_2)_3O-A$ | $CF_3CO-$ | H |
| C-3 | $-CONH(CH_2)_3O-A$ | $CH_3SO_2-$ | H |
| C-4 | $-CONH(CH_2)_3O-A$ | $C_2H_5OCO-$ | H |
| C-5 | $-CONH(CH_2)_4O-A$ | $t\text{-}C_4H_9CO-$ | H |
| C-6 | $-CONH(CH_2)_3O-C_{12}H_{25}\text{-}n$ | $C_2H_5OCO-$ | H |
| C-7 | $-CONH(CH_2)_3O-C_{12}H_{25}\text{-}n$ | $i\text{-}C_4H_9OCO-$ | H |
| C-8 | $-CONH(CH_2)_3OC_{10}H_{21}\text{-}n$ | $i\text{-}C_4H_9OCO-$ | H |
| C-9 | $-CONH(CH_2)_3OC_{10}H_{21}\text{-}n$ | $n\text{-}C_4H_9\overset{C_2H_5}{\overset{\vert}{C}}HCH_2OCO-$ | H |
| C-10 | $-CONH(CH_2)_3O-A$ | $i\text{-}C_4H_9OCO-$ | H |

TABLE 2

| No. | $R_1$ | $R_3$ | X |
|---|---|---|---|
| C-11 | 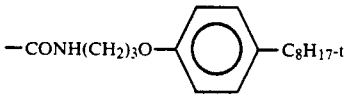 | $i\text{-}C_4H_9OCO-$ | H |
| C-12 | $-CONHCH_2\overset{CH_3}{\overset{\vert}{C}}HCH_2OC_{12}H_{25-n}$ | $i\text{-}C_4H_9OCO-$ | H |
| C-13 | $-CONH(CH_2)_3OCH_2\overset{C_2H_5}{\overset{\vert}{C}}HC_4H_9$ | $n\text{-}C_8H_{17}OCO-$ | H |
| C-14 | 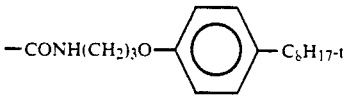 | $n\text{-}C_4H_9SO_2-$ | H |

TABLE 2-continued

| No. | $R_1$ | $R_3$ | X |
|---|---|---|---|
| C-15 | $-CONH(CH_2)_3OC_{12}H_{25}$-n | $(C_2H_5O)_2\overset{O}{\overset{\|}{P}}-$ | H |
| C-16 | $-CONH(CH_2)_3O-A$ | 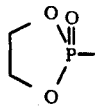 | H |

TABLE 3

| No. | $R_1$ | $R_3$ | X |
|---|---|---|---|
| C-17 | $-CONHCH_2CH_2OC_{12}H_{25}$-n | i-$C_4H_9OCO-$ | H |
| C-18 | $-CON(CH_3)(C_{16}H_{33}$-n$)$ | $C_2H_5OCO-$ | H |
| C-19 | $-CONHCH_2CH_2OCOC_{11}H_{23}$-n | i-$C_4H_9OCO-$ | H |
| C-20 | $-CONHC_{12}H_{25}$-n | n-$C_4H_9CH(CH_3)CH_2OCO-$ | H |
| C-21 | $-SO_2NH(CH_2)_3OC_{12}H_{25}$-n | i-$C_4H_9OCO-$ | H |
| C-22 | $-SO_2N(CH_3)(C_{18}H_{37}$-n$)$ | $C_2H_5OCO-$ | H |
| C-23 | $-CONHC_2H(C_6H_{13}$-n$)C_8H_{17}$-n | i-$C_4H_9OCO-$ | H |

TABLE 4

| No. | $R_1$ | $R_3$ | X |
|---|---|---|---|
| C-24 | $-CONH(CH_2)_3OC_{12}H_{25}$-n | 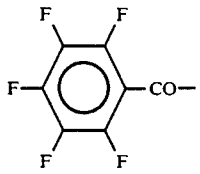 | H |
| C-25 | 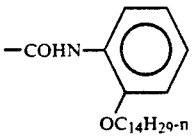 | $CH_3SO_2-$ | H |
| C-26 | 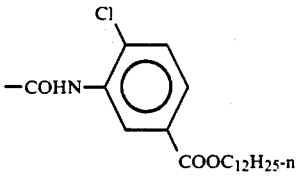 | 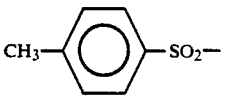 | H |
| C-27 | $-CONH(CH_2)_3OC_{12}H_{25}$-n | i-$C_4H_9OCO-$ | Cl |
| C-28 | $-CONH(CH_2)_3OC_{12}H_{25}$-n | n-$C_4H_9OCO-$ | Cl |
| C-29 | $-CONH(CH_2)_3OC_{14}H_{29}$-n | t-$C_4H_9CO-$ | Cl |

TABLE 5

| No. | $R_1$ | $R_3$ | X |
|---|---|---|---|
| C-30 | $-CONH(CH_2)_3OC_{12}H_{25}$-n | i-$C_4H_9OCO-$ | $-OCH_2CH_2OH$ |
| C-32 | $-CONH(CH_2)_3OC_{12}H_{25}$-n | i-$C_4H_9OCO-$ | $-O(CH_2CH_2O)_2H$ |

TABLE 5-continued

| No. | $R_1$ | $R_3$ | X |
|---|---|---|---|
| C-33 | $-CONH(CH_2)_3OC_{12}H_{25}$-n | i-$C_4H_9OCO-$ | $-OCH_2CH_2OCH_3$ |
| C-34 | $-CONH(CH_2)_3OC_{12}H_{25}$-n | i-$C_4H_9OCO-$ | $-OCH_2CH_2SCH_2COOH$ |
| C-35 | $-CONHC_4H_9$-n | i-$C_4H_9OCO-$ | $-OCH_2CH_2S\overset{COOH}{\overset{\vert}{C}}HC_{12}H_{25}$-n |
| C-36 | $-CONHCH_2\overset{CH_3}{\overset{\vert}{C}}HCH_2OC_{12}H_{25}$-n | i-$C_4H_9OCO-$ | $-O(CH_2)_3COOH$ |
| C-37 | $-CONH(CH_2)_4O-A$ | i-$C_4H_9OCO-$ | 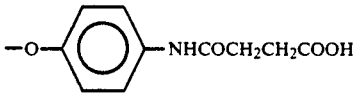 |
| C-38 | $-CONH(CH_2)_3O-A$ | i-$C_4H_9OCO-$ | 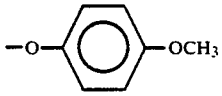 |
| C-39 | 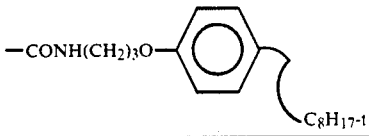 | i-$C_4H_9OCO-$ | $-SCH_2COOH$ |

TABLE 6

| No. | $R_1$ | $R_3$ | X |
|---|---|---|---|
| C-40 | $-CONH(CH_2)_3OC_{12}H_{25}$-n | i-$C_4H_9OCO-$ | $-SCH_2CH_2COOH$ |
| C-41 | $-CONH(CH_2)_3OC_{12}H_{25}$-n | i-$C_4H_9OCO-$ | $-SCH_2CH_2OH$ |
| C-42 | $-CONH(CH_2)_4O-A$ | $CH_3SO_2-$ | 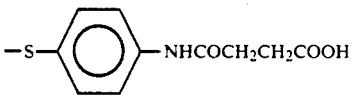 |
| C-43 | $-SO_2NH(CH_2)_3O-A$ | n-$C_4H_9SO_2-$ | $-OCH_2CH_2OH$ |
| C-44 | $-CONHCH_2\overset{CH_3}{\overset{\vert}{C}}HCH_2OC_{12}H_{25}$-n | i-$C_4H_9OCO-$ | $-OCH_2CH_2OH$ |
| C-45 | $-CONH(CH_2CH_2O)C_{12}H_{25}$-n | $(C_2H_5O)_2\overset{O}{\overset{\Vert}{P}}-$ | $-OCH_2CH_2OCH_3$ |
| C-46 | $-CONH(CH_2)_4O-A$ | t-$C_4H_9CO-$ | $-OCH_2COOC_2H_5$ |

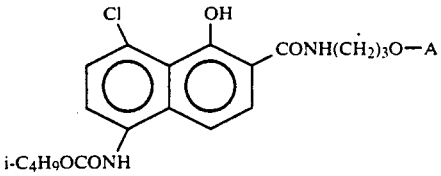

C-47

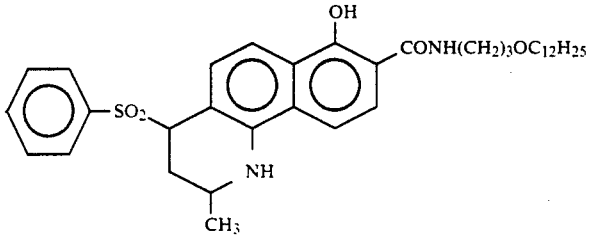

C-48

-continued
C-49
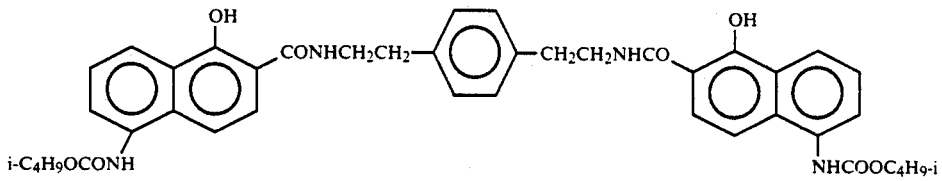
C-50
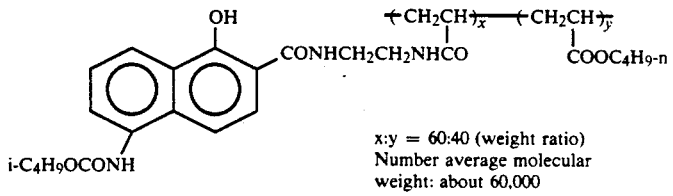
x:y = 60:40 (weight ratio)
Number average molecular weight: about 60,000
C-51
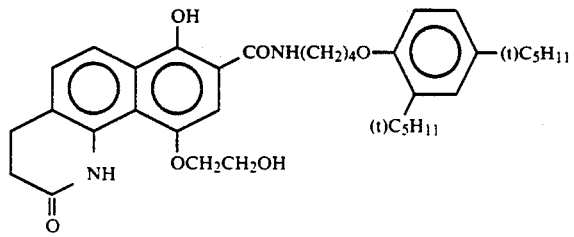
C-52
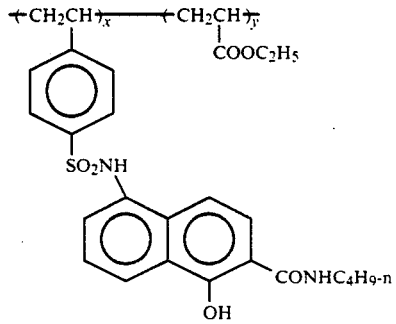
x:y = 70:30 (weight ratio)
Number average molecular weight: about 55,000
C-53
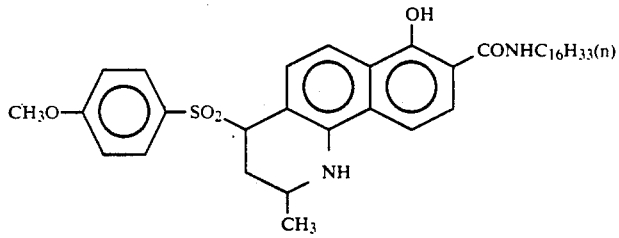
In the above-described formulae, A represents
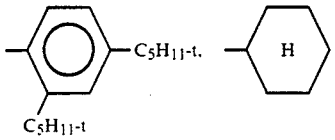
represents a cyclohexyl group,
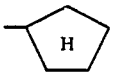
represents a cyclopentyl group, and —$C_8H_{17}$-t represents
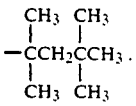

Cyan couplers represented by formula (C) other than the foregoing compounds and/or the synthesis methods for these compounds are described, for example, in U.S. Pat. No. 4,690,889, JP-A-60-237448, JP-A-61-153640, JP-A-61-145557, JP-A-63-208042, and JP-A-64-31159 and West German Patent No. 3,823,049A.

For dispersing the cyan coupler represented by formula (C) in a silver halide emulsion or an aqueous hydrophilic colloid solution, it is preferred to use a small amount of a high-boiling organic solvent for further improving the sharpness and the desilvering property as described in JP-A-62-269958.

Practically, the high-boiling organic solvent is used in an amount of less than about 0.3 by weight ratio, and preferably less than about 0.1 by weight ratio to the cyan coupler.

The sum total of the amounts of the cyan couplers represented by formula (C) is at least 30 mol %, preferably at least 50 mol %, more preferably at least 70 mol %, and particularly preferably at least 90% based on the amount of all of the cyan couplers.

The cyan couplers represented by formula (C) are preferably used in a combination of two or more kinds thereof. When the same color sensitive silver halide emulsion layer is composed of two or more silver halide emulsion layers each having a different sensitivity, it is preferred to use the 2-equivalent cyan coupler for the emulsion layer having the highest sensitivity and the 4-equivalent cyan coupler for the emulsion layer having lowest sensitivity. When other silver halide emulsion layer(s) exist in the same color sensitive emulsion layer, it is preferred to use one or both of the 2-equivalent cyan coupler and the 4-equivalent cyan coupler for the emulsion layer(s).

It is preferred to use a polymer coupler obtained by the monomer represented by the following formula (PA) for the green-sensitive emulsion layer of the silver halide color photographic material of this invention for improving the sharp processing dependence and for improving the image storage stability after processing.

Formula (PA):

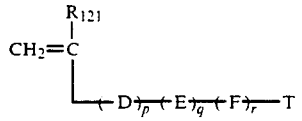

(PA)

wherein $R_{121}$ represents a hydrogen atom, an alkyl group having from 1 to 4 carbon atoms, or a chlorine atom; —D— represents —COO—, —$CONR_{122}$ or a substituted or unsubstituted phenylene group; —E— represents a substituted or unsubstituted alkylene group, a substituted or unsubstituted phenylene group, or a substituted or unsubstituted aralkylene group; —F— represents —$CONR_{122}$, —$NR_{122}CONR_{122}$—, —$NR_{122}COO$—, —$NR_{122}CO$—, —$OCONR_{122}$—, —$NR_{122}$—, —COO—, —OCO—, —CO—, —O—, —S—, —$SO_2$—, —$NR_{122}SO_2$—, or —$SO_2NR_{122}$; —$R_{122}$ represents a hydrogen atom or a substituted or unsubstituted aryl group, when two or more $R_{122}$ exist in the same molecule, the $R_{122}$s may be the same or different; p, q, and r each represents 0 or 1 excluding the case where p, q, and r are simultaneously 0.

Also, in above formula (PA), T represents a coupler residue of a magenta coupler represented by following formula (PB) (said coupler residue is bonded to —(D)—, —(E)—, or —(F)— of foregoing formula (PA) with $Ar_{51}$, $Z_{51}$, or $R_{133}$ of formula (PB));

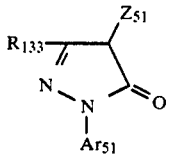

(PB)

wherein $Ar_{51}$ represents a well known-type substituent at the 1-position of a 2-pyrazolin-5-one coupler such as, for example, an alkyl group, a substituted alkyl group (e.g., a haloalkyl such as fluoroalkyl, etc., cyanoalkyl, and benzylalkyl), substituted or unsubstituted heterocyclic group (e.g., 4-pyridyl and 2-thiazolyl), or a substituted or unsubstituted aryl group (the substituents of the substituted heterocyclic group and the substituted aryl group are an alkyl group (e.g., methyl and ethyl), an alkoxy group (e.g., methoxy and ethoxy), an aryloxy group (e.g., phenyloxy), an alkoxycarbonyl group (e.g., methoxycarbonyl), an acylamino group (e.g., acetylamino), a carbamoyl group, an alkylcarbamoyl group (e.g., methylcarbamoyl and ethylcarbamoyl), a dialkylcarbamoyl group (e.g., dimethylcarbamoyl), an arylcarbamoyl group (e.g., phenylcarbamoyl), an alkylsulfonyl group (e.g., methylsulfonyl), an arylsulfonyl group (e.g., phenylsulfonyl), an alkylsulfonamido group (e.g., methanesulfonamido), an arylsulfonamido group (e.g., phenylsulfonamido), a sulfamoyl group, an alkylsulfamoyl group (e.g., ethylsulfamoyl), a dialkylsulfamoyl group (e.g., dimethylsulfamoyl), an alkylthio group (e.g., methylthio), an arylthio group (e.g., phenylthio), a cyano group, a nitro group, and a halogen atom (e.g., fluorine, chlorine, and bromine), and when two or more substituents exist, they may be the same or different; and a particularly preferable substituent is a halogen atom, an alkyl group, an alkoxy group, an alkoxycarbonyl group, or a cyano group.).

$R_{133}$ in formula (PB) represents a substituted or unsubstituted anilino group, a substituted or unsubstituted acylamino group (e.g., alkylcarbonamido, phenylcarbonamido, alkoxycarbonamido, and phenyloxycarbonamido), a substituted or unsubstituted ureido group (e.g., alkylureido and phenyl ureido), or a substituted or unsubstituted sulfonamido group. Examples of the substituent for the foregoing substituted groups are a halogen atom (e.g., fluorine, chlorine, and bromine), a straight chain or branched alkyl group (e.g., methyl, t-butyl, octyl, and tetradecyl), an alkoxy group (e.g., methoxy, ethoxy, 2-ethylhexyloxy, and tetradecyloxy), an acylamino group (e.g., acetamido, benzamido, butanamido, octanamido, tetradecanamido, a-(2,4-di-tert-amylphenoxy)acetamido, α-(2,4-di-tert-amylphenoxy)butylamido, α-(3-pentadecylphenoxy)hexanamido, α-(4-hydroxy-3-tert-butylphenoxy)tetradecanamido, 2-oxo-pyrrolidin-1-yl, 2-oxo-5-tetradecylpyrrolidin-1-yl, and N-methyltetradecanamido), a sulfonamido group (e.g., methanesulfonamido, benzenesulfonamido, ethylsulfonamido, p-toluenesulfonamido, octanesulfonamido, p-dodecylbenzenesulfonamido, and N-methyl-tetradecanesulfonamido), a sulfamoyl group (e.g., sulfamoyl, N-methylsulfamoyl, N-ethylsulfamoyl, N,N-dimethylsulfamoyl, N,N-dihexylsulfamoyl, N-hexadecylsulfamoyl, N-[3-(dodecyloxy)propyl]sulfamoyl, N-[4-(2,4-di-tert-amylphenoxy)butyl]sulfamoyl, and N-methyl-N-tetradecylsulfamoyl), a carbamoyl group (e.g., N-methylcarbamoyl, N-butylcarbamoyl, N-octadecylcarbamoyl, N-[4 (2,4-di-tert-amylphenoxy)butyl]carbamoyl, and N-methyl-N-tetradecylcarbamoyl), a diacylamino group (e.g., N-succinimido, N-phthalimido, 2,5-dioxo-1-oxazolidinyl, 3-dodecyl 2,5-dioxo-1-hydantoinyl, and 3-(N-acetyl-N-dodecylamino)succinimido), an alkoxycarbonyl group (e.g., methoxycarbonyl, tetradecyloxycarbonyl, and benzyloxycarbonyl), an alkoxysulfonyl group (e.g., methoxysulfonyl, butoxysulfonyl, octyloxysulfonyl, and tetradecyloxysulfonyl), an aryloxysulfonyl group (e.g., phenoxysulfonyl, p-methylphenoxysulfonyl, and 2,4-di-tert-amylphenoxysulfonyl), an alkanesulfonyl (e.g., methanesulfonyl, ethanesulfonyl, octanesulfonyl, 2-ethylhexylsulfonyl, and hexadecanesulfonyl), an arylsulfonyl group (e.g., benzenesulfonyl, 4-nonylbenzenesulfonyl), an alkylthio group (e.g., methylthio, ethylthio, hexylthio, benzylthio, tetradecylthio, and 2-(2,4-di-tert-amylphenoxy)ethylthio), an arylthio group (e.g., phenylthio and p-tolylthio), an alkyloxycarbonylamino group (e.g., methoxycarbonylamino, ethyloxycarbonylamino, benzyloxycarbonylamino, and hexadecyloxycarbonylamino), an alkylureido group (e.g., N-methylureido, N,N-dimethylureido, N-methyl-N-dodecylureido, N-hexadecylureido, and N,N-dioctadecylureido), an acyl group (e.g., acetyl, benzoyl, octadecanoyl, and p-dodecanamidobenzoyl), a nitro group, a carboxy group, a sulfo group, a hydroxy group, and a trichloromethyl group.

In the above-described substituents, the alkyl group has from 1 to 36 carbon atoms and the aryl group has from 6 to 38 carbon atoms.

$Z_{51}$ in formula (PB) described above represents a hydrogen atom, a halogen atom (e.g., chlorine and bromine), a coupling releasing group bonding by an oxygen atom (e.g., acetoxy, propanoyloxy, benzoyloxy, ethoxyoxazolyloxy, pyruviloxyl, cinnamoyloxy, phenoxy, 4-cyanophenoxy, 4-methanesulfonamidophenoxy, α-naphthoxy, 4-cyanoxyl, 4-methanesulfonamidophenoxy, α-naphthoxy, 3-pentadecylphenoxy, benzyloxycarbonyloxy, ethoxy, 2-cyanoethoxy, benzyloxy, 2-phenethyloxy, 2-phenoxyethoxy, 5-phenyltetrazolyloxy, and 2-benzothiazolyloxy), a coupling releasing group bonding by a nitrogen atom (e.g., those described in JP-A-59-99437, practically, benzenesulfonamido, N ethyltoluenesulfonamido, heptafluorobutanamido, 2,3,4,5,6-pentafluorobenzamido, octanesulfonamido, p cyanophenylureido, N,N-diethylsulfamoylamino, 1-piperidyl, 5,5-dimethyl-2,4-dioxo-3-oxozolidinyl, 1-benzyl 5-ethoxy-3-hydantoinyl, 2-oxo-1,2-dihydro-1-pyridinyl, imidazolyl, pyrazolyl, 3,5-diethyl-1,2,4-triazol-1-yl, 5- or 6-bromo-benzotriazol-1-yl, 5-methyl-1,2,3,4-triazol-1-yl, and benzimidazolyl), or a coupling releasing group bonding by a sulfur atom (e.g., phenylthio, 2-carboxyphenylthio, 2-methoxy-5-octylphenylthio, 4-methanesulfonylphenylthio, 4-octanesulfonamidophenylthio, benzylthio, 2-cyanoethylthio, 5-phenyl-2,3,4,5-tetrazolylthio, and 2-benzothiazolyl).

$Z_{51}$ is preferably a coupling releasing group bonding by a nitrogen atom, and particularly preferably pyrazolyl group.

In foregoing formula (PA), E represents a substituted or unsubstituted alkylene group having from 1 to 10 carbon atoms, a substituted or unsubstituted aralkylene group, or a substituted or unsubstituted phenylene group, and the alkylene group may be a straight chain group or a branched group. Examples of the alkylene group are methylene, methylmethylene, dimethylmethylene, dimethylene, trimethylene, tetramethylene, pentamethylene, hexamethylene, and decylmethylene. Examples of the aralkylene group are benzylidene, etc. Examples of the phenylene group are p-phenylene, m-phenylene, and methylphenylene.

Also, as the substituent for the substituted alkylene group, the substituted aralkylene group, or the substituted phenylene group shown by E in formula (PA) are an aryl group (e.g., phenyl), a nitro group, a hydroxy group, a cyano group, a sulfo group, an alkoxy group (e.g., methoxy), an aryloxy group (e.g., phenoxy), an acyloxy group (e.g., acetoxy), an acylamino group (e.g., acetylamino), a sulfonamido group e.g., methanesulfonamido), a sulfamoyl group (e.g., methylsulfamoyl), a halogen atom (e.g., fluorine, chlorine, and bromine), a carboxy group, a carbamoyl group (e.g., methylcarbamoyl), an alkoxycarbonyl group (e.g., methoxycarbonyl), and a sulfonyl group (e.g., methylsulfonyl). When two or more substituents exist, they may be the same or different.

As a noncoloring ethylenical monomer which can be copolymerized with the coupler monomer represented by foregoing formula (PA) and which does not cause coupling with the oxidation product of an aromatic primary amine developing agent, there are, for example, acrylic acid esters, methacrylic acid esters, crotonic acid esters, vinyl esters, maleic acid diesters, fumaric acid diesters, itaconic acid diesters, acrylamides, methacrylamides, vinyl ethers, and styrenes.

Practical examples of these monomers are as follows.

Examples of the acrylic acid ester are methyl acrylate, ethyl acrylate, n-propyl acrylate, isopropyl acrylate, n-butyl acrylate, isobutyl acrylate, tertbutyl acrylate, hexyl acrylate, 2-ethylhexyl acrylate, acetoxyethyl acrylate, phenyl acrylate, 2-methoxy acrylate, 2-ethoxy acrylate, and 2-(2-methoxyethoxy)ethyl acrylate.

Examples of the methacrylic acid are methyl methacrylate, ethyl methacrylate, n-propyl methacrylate, n-butyl methacrylate, tert-butyl methacrylate, cyclohexyl methacrylate, 2-hydroxyethyl methacrylate, and 2-ethoxyethyl methacrylate.

Examples of the crotonic acid ester are butyl crotonate and hexyl crotonate.

Examples of the vinyl ester are vinyl acetate, vinyl propionate, vinyl butyrate, vinylmethoxy acetate, vinyl benzoate.

Examples of the maleic acid diester are diethyl maleate, dimethyl maleate, and dibutyl maleate.

Examples of the maleic acid diester are dimethyl maleate, diethyl maleate, and dibutyl maleate.

Examples of the fumaric acid diester are diethyl fumarate, dimethyl fumarate, and dibutyl fumarate.

Examples of the itaconic acid diester are diethyl itaconate, dimethyl itaconate, and dibutyl itaconate.

Examples of the acrylamide are acrylamide, methylacrylamide, ethylacrylamide, propylacrylamide, n-butylacrylamide, tert-butylacrylamide, cyclohexylacrylamide, 2-methoxyethylacrylamide, dimethylacrylamide, diethylacrylamide, and phenylacrylamide.

Examples of the methacrylamide are methylmethacrylamide, ethylmethacrylamide, n-butylmethacrylamide, tert-butylmethacrylamide, 2-methoxymethacrylamide, dimethylmethacrylamide, and diethylmethacrylamide.

Examples of the vinyl ether are methyl vinyl ether, butyl vinyl ether, hexyl vinyl ether, methoxyethyl vinyl ether, and dimethylaminoethyl vinyl ether.

Examples of the styrene are styrene, methylstyrene, dimethylstyrene, trimethylstyrene, ethylstyrene, isopropylstyrene, butylstyrene, chloromethyl styrene, methoxystyrene, butoxystyrene, acetoxystyrene, chlorostyrene, dichlorostyrene, bromostyrene, vinylbenzoic acid methyl ester, and 2-methylstyrene.

Examples of other monomers are allyl compounds (e.g., allyl acetate), vinyl ketones (e.g., methyl vinyl ketone), vinyl heterocyclic compounds (e.g., vinylpyridine), glycidyl esters (e.g., glycidyl acrylate), unsaturated nitriles (e.g., acrylonitrile), acrylic acid, methacrylic acid, itaconic acid, maleic acid, itaconic acid monoalkyl esters (e.g., monomethyl itaconate), maleic acid monoalkyl esters (e.g., monoalkyl maleate), citraconic acid, vinylsulfonic acid, acryloyloxyalkylsulfonic acids (e.g., acryloyloxymethylsulfonic acid), and acrylamidoalkylsulfonic acids (e.g., 2-acrylamido-2-methylethanesulfone). These acids may the salts of an alkali metal (e.g., sodium and potassium) or ammonium ion.

Of these monomers, acrylic acid esters, methacrylic acid esters, styrenes, maleic acid esters, acrylamides, and methacrylamides can preferably be used in this invention.

These monomers may be used as a combination of two or more kinds thereof, for example, a combination of n-butyl acrylate and styrene, a combination of n-butyl acrylate and butylstyrene, and a combination of t-butylmethacrylamide and n-butyl acrylate.

The ratio of the coloring moiety corresponding to foregoing formula (PB) in the foregoing magenta polymer coupler is usually from 5 to 80% by weight but is preferably from 30 to 70% by weight for good color reproducibility, coloring property, processing reliance, and stability. In this case, the molecular weight (the gram number of a polymer containing 1 mol of the monomer coupler) is from about 250 to 4,000 although the molecular weight is not limited to this range.

When the magenta polymer coupler is added to a silver halide emulsion layer, the polymer coupler is added in an amount of preferably from 0.005 mol to 0.5 mol, and more preferably from 0.03 mol to 0.25 mol per mol of silver, based on the coupler monomer.

Also, when the magenta polymer coupler is used for a light-insensitive layer, the coating amount thereof is in the range of from 0.01 g/m$^2$ to 1.0 g/m$^2$, and preferably from 0.1 g/m$^2$ to 0.5 g/m$^2$.

The magenta polymer coupler for use in this invention may be prepared by dissolving a oleophilic polymer coupler obtained by polymerizing the monomer coupler in an organic solvent and emulsion dispersing the solution in a form of a latex in an aqueous gelatin solution, or may be prepared directly by an emulsion polymerization method.

As a method for emulsion dispersing the oleophilic polymer coupler in the form of a latex in an aqueous gelatin solution, the method described in U.S. Pat. No. 3,451,820 can be used, and as the emulsion polymerization method, the methods described in U.S. Pat. Nos. 4,080,211 and 3,370,952 and European Patent 341,088A2 can be used.

Also, the synthesis of the foregoing magenta polymer coupler can be carried out using the compounds described in JP-A-56-5543, JP-A-57-94752, JP-A-57-176038, JP-A-57-204038, JP-A-58-28745, JP-A-58-10738, JP-A-58-42044, and JP-A-58-145944 as the polymerization initiator and the polymerization solvent.

The polymerization temperature must be selected according to the molecular weight of the polymer being formed, the kind of the polymerization initiator, etc. The polymerization can be carried out at a temperature of from 0° C. to 100° C. or higher but is usually carried out in the range of from 30° C. to 100° C.

Specific examples of the magenta polymer coupler which can be used in this invention are illustrated below but the magenta polymer coupler for use in this invention is not limited to these compounds.

(The numerals added to each formula show mol ratios.)

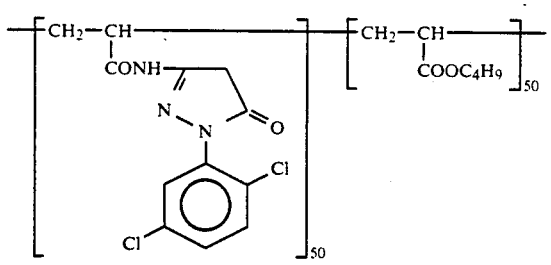

(P-1)

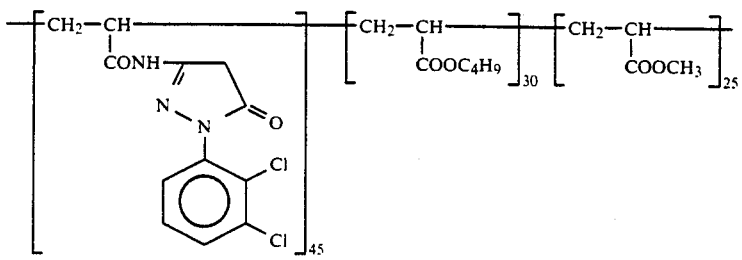

(P-2)

-continued
(P-3)
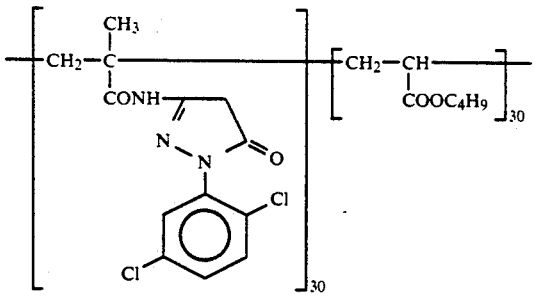
(P-4)
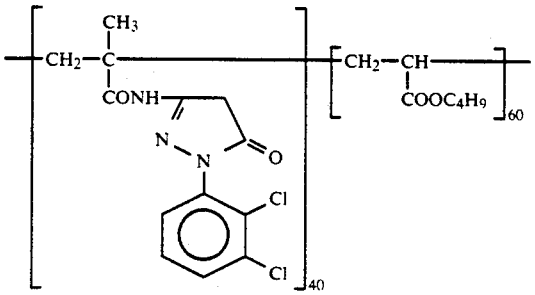
(P-5)
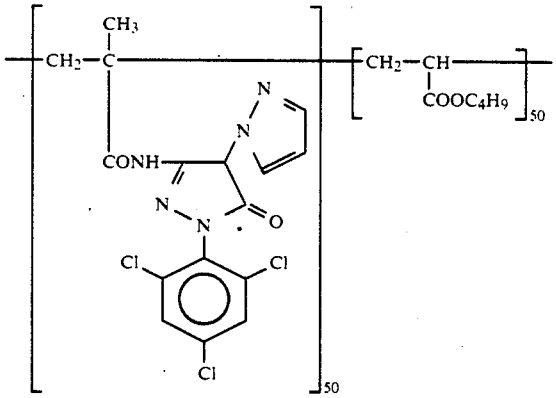
(P-6)
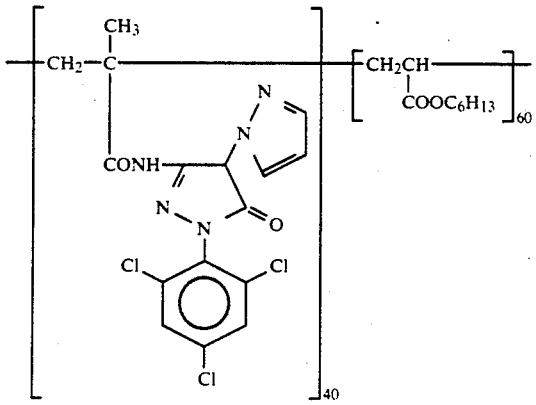

-continued
(P-7)
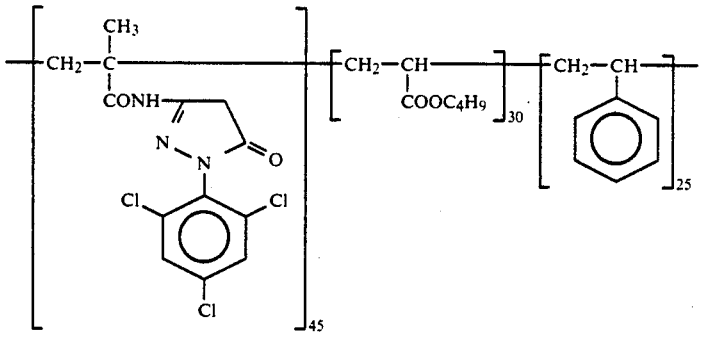
(P-8)
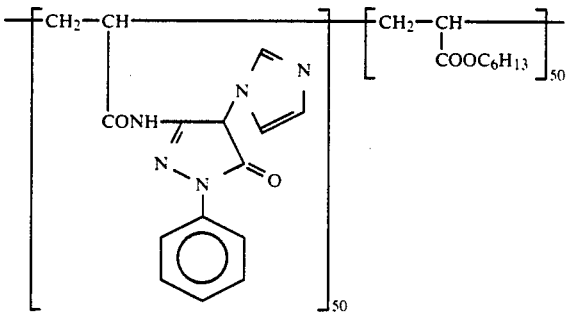
(P-9)
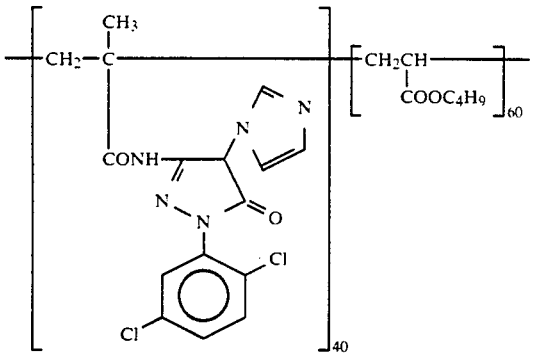
(P-10)
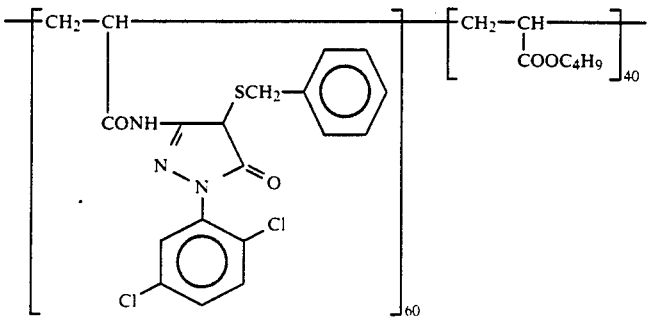

-continued (P-11)

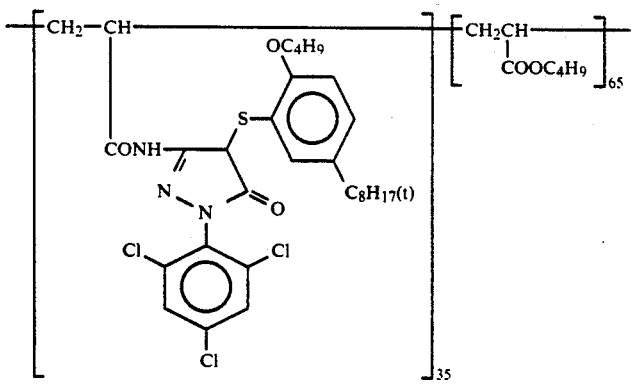

(P-12)

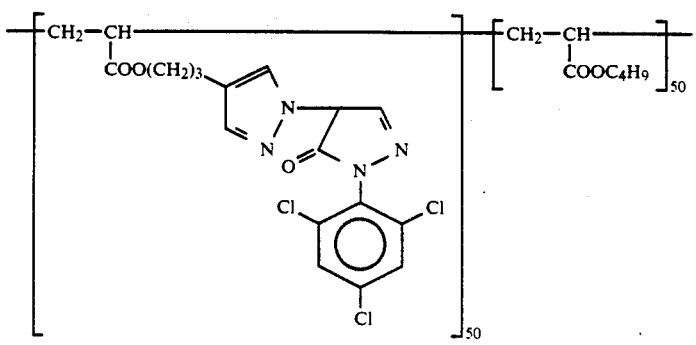

The silver halide color photographic material of this invention may have at least one blue-sensitive silver halide emulsion layer, green-sensitive silver halide emulsion layer, and red-sensitive silver halide emulsion layer and there are no particular restrictions on the layer number of the silver halide emulsion layers and light-insensitive layers and on the disposition order of the layers.

A typical example of the color photographic material of this invention is a silver halide photographic material having at least one light-sensitive layer composed of several silver halide emulsion layers each having substantially the same color sensitivity but having a different light sensitivity on a support and the light-sensitive layer is a unit light-sensitive layer having a color sensitivity to one of blue light, green light, and red light.

In a multilayer silver halide color photographic material, a red-sensitive silver halide emulsion layer, a green-sensitive silver halide emulsion layer, and a blue-sensitive silver halide emulsion layer are generally formed on a support in this order from the support side. However, according to the purpose, other order of disposition of the emulsion layers can be employed. Also, a layer disposition where a different light-sensitive layer is disposed between light-sensitive emulsion layers having the same color sensitivity can be employed.

Also, between the foregoing silver halide emulsion layers and as the uppermost layer and the lowermost layer, various light-insensitive layers such as an interlayer, a protective layer, a subbing layer, etc., may be formed.

The foregoing interlayers may contain the couplers, the DIR compounds, etc., as described in JP-A-61-43748, JP-A-59-113438, JP-A-59-113440, JP-A-61-20037, and JP-A-61-20038 and also may contain color mixing inhibitors which are usually used.

As the several silver halide emulsion layers constituting each unit light-sensitive layer, a two layer structure composed of a high speed silver halide emulsion layer and a low-speed silver halide emulsion layer as described in West German Patent 1,121,470 and British Patent 923,045 can be preferably used. In this case, it is preferred that the low-speed emulsion layer is disposed at the side nearer the support and also a light-insensitive layer may be formed between the silver halide emulsion layers. Also, a low-speed emulsion layer may be disposed at the side far from the support and a high-speed emulsion layer may be disposed at the side nearer the support as described in JP-A-57-112751, JP-A-62-200350, JP-A 62-206541, and JP-A-62-206543.

As a practical example, a layer order of a low-speed blue-sensitive silver halide emulsion layer (BL)/a high-speed blue-sensitive silver halide emulsion layer (BH)/a high-speed green-sensitive silver halide emulsion layer (GH)/a low-speed green-sensitive silver halide emulsion layer (GL)/a high-speed red-sensitive silver halide emulsion layer (RH)/a low-speed red-sensitive silver halide emulsion layer, a layer order of BH/BL/GL/GH/RH/RL, or a layer order of BH/BL/GL/GH/RL/RH from the farthest side of the support can be employed.

Also, the layer order of a blue-sensitive silver halide emulsion layer/GH/RH/GL/RL from the farthest side of the support as described in JP-A-56-25738 and JP-A-62-63936 can be employed.

Also, a three-layer structure composed of the highest light-sensitive silver halide emulsion as the upper layer, a silver halide emulsion layer having a light-sensitivity lower than the upper layer as an intermediate layer, and a silver halide emulsion layer having a light-sensitivity lower than the intermediate layer, the light sensitivity of these emulsion layers being successively lowered towards the support as described in JP-B-49-15495 (the term "JP-B" as used herein means an "examined Japanese patent publication") can be employed. In the case of employing the three-layer structure of emulsion layers each having a different light sensitivity as described above, the layers may be disposed in the order of an intermediate-speed emulsion layer/a high-speed emulsion layer/a low-speed emulsion layer from the side far from the support in a same color sensitive emulsion layer as described in JP-A-59-202464.

In other examples, a layer order of a high-speed emulsion layer/a low-speed emulsion layer/an intermediate emulsion layer or a layer order or a low-speed emulsion layer/an intermediate emulsion layer/a high-sensitive emulsion layer may be employed. Also, 4-layer or more-layer structure may be used and in such a case, the layer disposition order can be changed as described above.

For improving the color reproducibility, it is preferred to dispose a donor layer (CL) having a different spectral sensitivity distribution from the main light-sensitive layer such as BL, GL, RL, etc., adjacent to or near the main light-sensitive layer as described in U.S. Pat. Nos. 4,663,271, 4,705,744, and 4,707,436, JP-A-62-160448 and JP-A-63-89850.

As described above, various layer structures and layer dispositions can be selected according to the purpose of each color photographic material.

A preferred silver halide contained in the photographic silver halide emulsion layers of the color photographic material of this invention include silver iodobromide, silver iodochloride, or silver iodochlorobromide containing less than about 30 mol % silver iodide. Particularly preferred silver halide is silver iodobromide or silver iodochlorobromide containing from about 2 mol % to about 10 mol % silver iodide.

The silver halide grains in the photographic silver halide emulsion may have a regular crystal form such as cubic, octahedral, tetradecahedral, etc., an irregular crystal form such as spherical, tabular, etc., a crystal form having a crystal defect such as twin planes, or a composite form of them.

The grain sizes of the silver halide grains may be as fine as less than about 0.2 μm or as large as up to about 10 μm as the diameter of the projected area. The silver halide emulsion may be a polydisperse emulsion or a monodisperse emulsion.

The silver halide photographic emulsions for use in this invention can be prepared using the methods described in *Research Disclosure,* No. 17643 (December 1978), pages 22–23, "I. Emulsion Preparation and Types", ibid., No. 18716 (November, 1979), page 648, ibid., No. 307105 (November, 1989) pages 863 to 865, P. Glafkides, *Chemie et Phisique Photographique,* Paul Montel, 1967, G. F. Duffin *Photographic Emulsion Chemistry* (Focal Press, 1966), and V. L. Zelikman et al., *Making and Coating Photographic Emulsion,* Focal Press, 1964.

The monodisperse emulsions described in U.S. Pat. Nos. 3,574,628 and 3,655,394 and British Patent 1,413,748 can also preferably be used in this invention.

Also, tabular silver halide grains having an aspect ratio of at least about 3 can be used in this invention. Tabular silver halide grains can be easily prepared by the methods described in Gutoff, *Photographic Science and Engineering,* Vol. 14, 248–257 (1970), U.S. Pat. Nos. 4,434,226, 4,414.310, 4,433,048 and 4,439,520 and British Patent 2,112,157.

The crystal structure of silver halide grains may be composed of a uniform halogen composition throughout the grain or may be composed of different halogen compositions between the inside and the surface portion thereof, or may have a layer structure. Also, the silver halide grains may have a structure where the silver halide having a different halogen composition is junctioned by an epitaxial junction or the silver halide grains are junctioned to a compound other than silver halide, such as silver rhodanide, lead oxide, etc. Furthermore, a mixture of silver halide grains having various crystal forms may also be used.

The silver halide emulsion for use in this invention may be of a surface latent image type for forming latent images mainly on the surface of the silver halide grains, or an internal latent image type of forming latent images mainly in the inside of the silver halide grains, or of a type of forming latent images on the surface and in the inside of the silver halide grains, but it is necessary that the silver halide emulsion is a negative working emulsion. In the internal latent image type emulsion, the core/shell type internal latent image type emulsion described in JP A-63-264740 may be used. The preparation method of the core/shell type internal latent image type emulsion is described in JP-A-59-133542. The thickness of the shell of the core/shell type emulsion depends upon the kind of photographic processing, etc., but is preferably from 3 to 40 nm, and particularly preferably form 5 to 20 nm.

The silver halide emulsion is usually physically ripened, chemically ripened, and spectrally sensitized at use. Additives which are used for these steps are described in *Research Disclosure (RD),* No. 17643, ibid., No. 18716, and ibid., No. 307105 and the corresponding portions are summarized in the table shown below.

In the color photographic light-sensitive material of this invention, two or more kinds of silver halide emulsions having at least one different characteristic with respect to the grain size, the grain size distribution, the halogen composition, the grain form, and the sensitivity of the silver halide grains of the light-sensitive silver halide emulsion can be used in the same layer as a mixture thereof.

Also, the surface-fogged silver halide grains described in U.S. Pat. No. 4,082,553, the inside-fogged silver halide grains described in U.S. Pat. No. 4,626,498 and JP-A-59-214852, or colloidal silver can preferably be used for the light-sensitive silver halide emulsion layer and/or the substantially light-insensitive hydrophilic colloid layer.

The inside- and/or surface-fogged silver halide grains mean silver halide grains which can be uniformly (non-imagewise) developed regardless of the unexposed portions and exposed portions of the color photographic materials.

The preparation method for the inside- or surface-fogged silver halide grains is described in U.S. Pat. No. 4,626,498 and JP-A-59-214852.

The silver halide forming the inside core of the inside-fogged core/shell silver halide grains may have the same halogen composition as or a different halogen composition from that of the shell silver halide grains. As the inside- or surface-fogged silver halide, any one of silver chloride, silver chlorobromide, silver iodobromide, and silver chloroiodobromide can be used.

There is no particular restriction on the grains sizes of these fogged silver halide grains but the mean grain size is preferably from 0.01 μm to 0.75 μm, and particularly preferably from 0.05 μm t 0.6 μm. Also, there is no particular restriction on the grain form, the silver halide grains may be regular grains or the sliver halide emulsion may be a polydisperse emulsion but is preferably a monodisperse emulsion (at least 95% of the weight or the grain number of the silver halide grains have grain diameters within ±40% of the mean grain size).

For the color photographic material of this invention, the use of a light-insensitive fine grain silver halide is preferable. The light-insensitive fine grains silver halide is silver halide fine grains which are not exposed during an imagewise exposure for obtaining color images and are not substantially developed in the development process, and it is preferred that the silver halide fine grains are not previously fogged.

In the silver halide fine grains, the content of silver bromide is from 0 to 100 mol % and if necessary, the silver halide grains may contain silver chloride and/or silver iodide and preferably contain from 0.5 to 10 mol % silver iodide.

The mean grain size (the mean value of the circle-corresponding diameters of the projected areas) of the silver halide fine grains is preferably from 0.01 μm to 0.5 μm, and more preferably from 0.02 μm to 0.2 μm.

The silver halide fine grains can be prepared by the same method as the case of preparing an ordinary light-sensitive silver halide. In this case, it is unnecessary that the surface of the silver halide grains is optically sensitized and also the application of a spectral sensitization is unnecessary. However, before adding the silver halide grains to a coating liquid, it is preferred to previously add a known stabilizer such as a triazole series compound, an azaindene series compound, a benzothiazolium series compound, a mercapto series compound or a lead compound to the silver halide grains. Also, the layer containing the silver halide fine grains can preferably contain colloidal silver.

The coating amount of silver in the color photographic material of this invention is preferably not more than 6.0 g/m$^2$, and most preferably not more than 4.5 g/m$^2$.

Various photographic additives which can be used in this invention are also described in the foregoing three *Research Disclosure (RD)* and the relevant portions are shown in the following table.

| Additive | RD 17643 | RD 18716 | RD 307105 |
|---|---|---|---|
| 1. Chemical Sensitizer | p. 23 | p. 648, right column (RC) | p. 866 |
| 2. Sensitivity Increasing Agent | | p. 648, right column (RC) | |
| 3. Spectral Sensitizer, Supersensitizer | pp. 23–24 | p. 648, RC to p. 649, RC | pp. 866–868 |
| 4. Whitening Agent | p. 24 | p. 647, RC | p. 868 |
| 5. Antifoggant, Stabilizer | pp. 24–25 | p. 649, RC | pp. 868–870 |
| 6. Light Absorber, Filter Dye, Ultraviolet Absorber | pp. 25–26 | p. 649, RC to p. 650, left column (LC) | p. 873 |
| 7. Stain Inhibitor | p. 25, RC | P. 650, LC to RC | p. 872 |
| 8. Dye Image Stabilizer | p. 25 | p. 650, LC | p. 872 |
| 9. Hardening Agent | p. 26 | p. 651, LC | pp. 874–875 |
| 10. Binder | p. 26 | p. 651, LC | PP. 873–874 |
| 11. Plasticizer, Lubricant | p. 27 | P. 650, RC | p. 876 |
| 12. Coating Aid, Surface Active Agent | pp. 26–27 | p. 650, RC | pp. 875–876 |
| 13. Antistatic Agent | p. 27 | p. 650, RC | pp. 876–877 |
| 14. matting Agent | | | pp. 878–879 |

Also, for preventing the deterioration of the photographic performance by a formaldehyde gas, it is preferred that the color photographic material of this invention contains a compound capable of fixing formaldehyde by reacting with it as described in U.S. Pat. Nos. 4,411,987 and 4,435,503.

It is also preferred that the color photographic material of this invention contains the mercapto compounds described in U.S. Pat. Nos. 4,740,454 and 4,788,132, JP-A-62-18539 and JP-A-1-283551.

Furthermore, it is preferred that the color photographic material of this invention contains a fogging agent, a development accelerator, and a silver halide solvent or the precursors thereof described in JP-A-1-106052 regardless of the amount of developed silver formed by development processing.

Still further, it is also preferred that the color photographic material of this invention contains the dye dispersed by the method described in WO 88/04794 and JP-A-1-502912 or the dyes described in EP 317,308A, U.S. Pat. No. 4,420,555 and JP-A-1-259358.

In this invention, various color couplers can be used and practical examples thereof are described in the patents cited in *Research Disclosure,* No. 17643, VII-C to G and ibid., No. 307105, VII-C to G.

As the yellow couplers, in addition to the couplers shown by foregoing formulas (I) and (II), the yellow couplers described, for example, in U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and European Patent 249,473A can preferably be used.

As the magenta coupler, 5-pyrazolone series compounds and pyrazoloazole series compounds are preferred and examples of the particularly preferred compounds are described in U.S. Pat. Nos. 4,310,619, 4,351,897, 3,061,432, and 3,725,067, European Patent 73,636, *Research Disclosure* No. 24220 (June, 1984), ibid., No. 24230 (June, 1984), JP-A-60-33552, JP-A-60-43659, JP-A-61-72238, JP-A-60-35730, JP-A-55-118034, and JP-A-60-185951, U.S. Pat. Nos. 4,500,630, 4,540,654, and 4,556,630 and (PCT) WO 88/04795.

In particular, the use of the magenta coupler represented by the following general formula (M) in combination is more preferred in order to improve the color reproducibility and the color image storage stability.

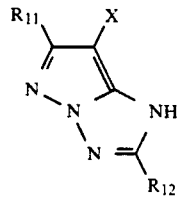

(M)

wherein $R_{11}$ and $R_{12}$ each represents a hydrogen atom or a substituent, X represents a hydrogen atom or a group capable of being released by the reaction with the oxidation product of the developing agent.

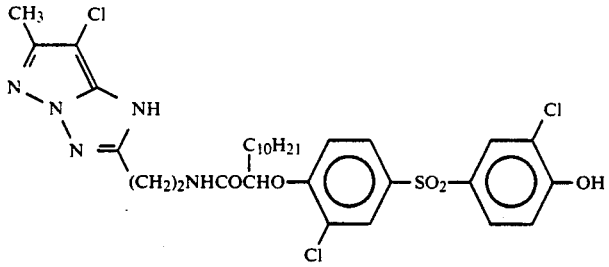
(M-1)
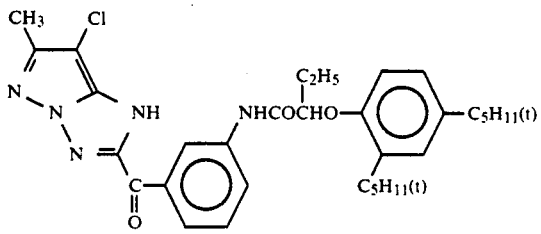
(M-2)
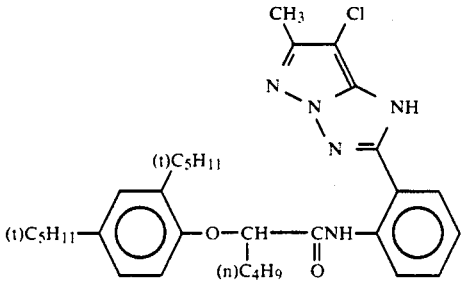
(M-3)
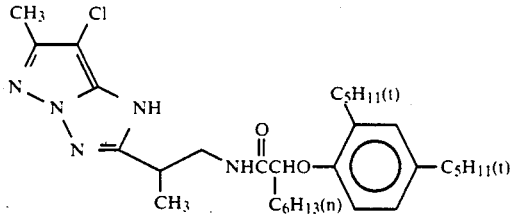
(M-4)
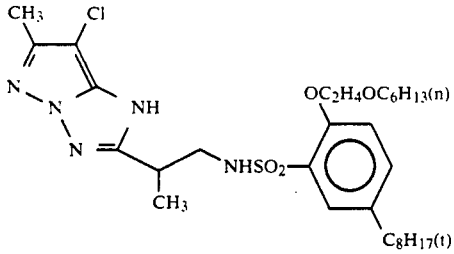
(M-5)
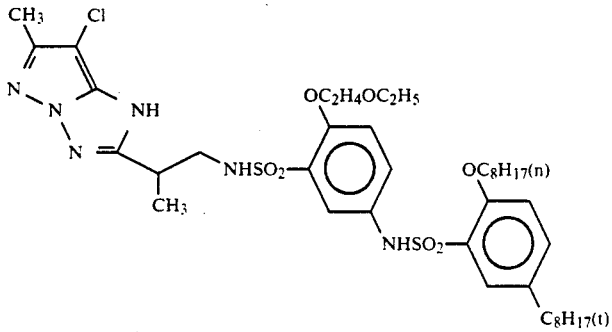
(M-6)

-continued
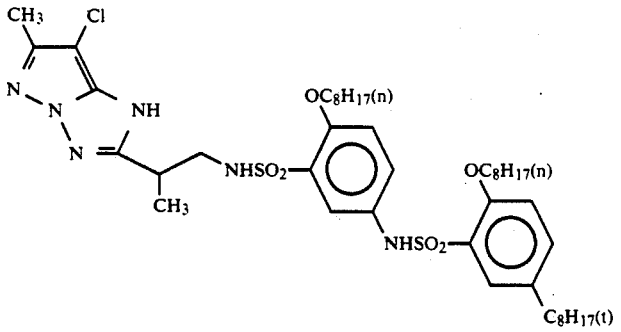
(M-7)
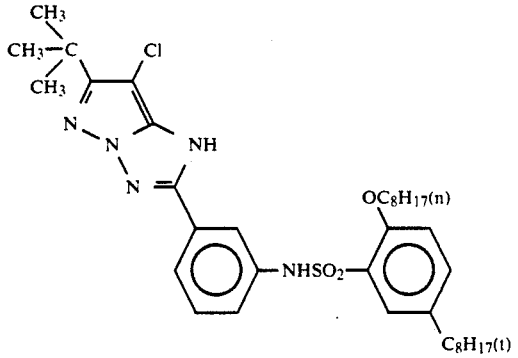
(M-8)
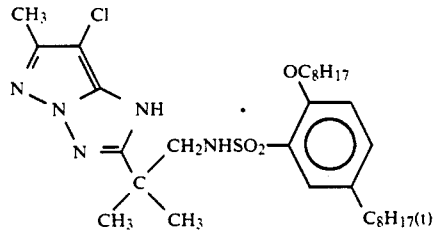
(M-9)
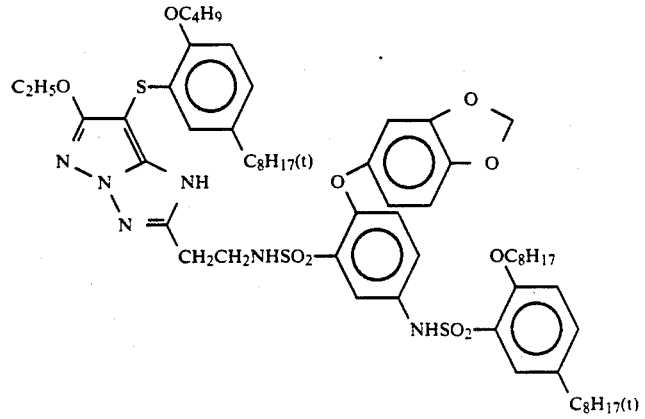
(M-10)

-continued
(M-11)
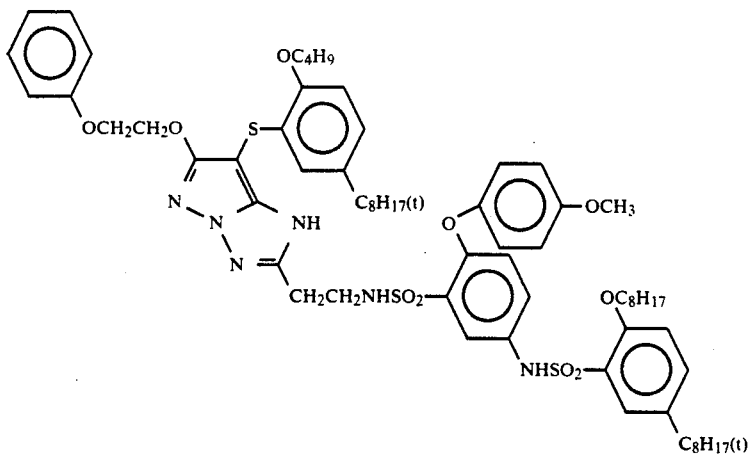
(M-12)
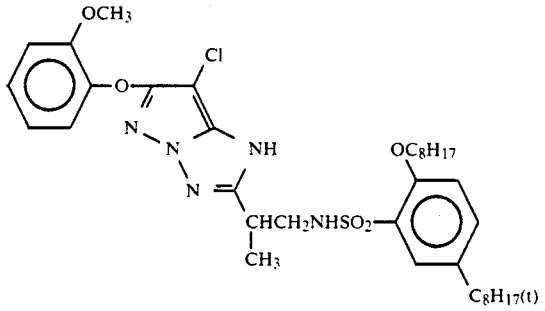
(M-13)
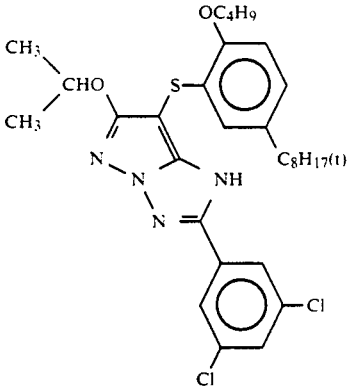
(M-14)
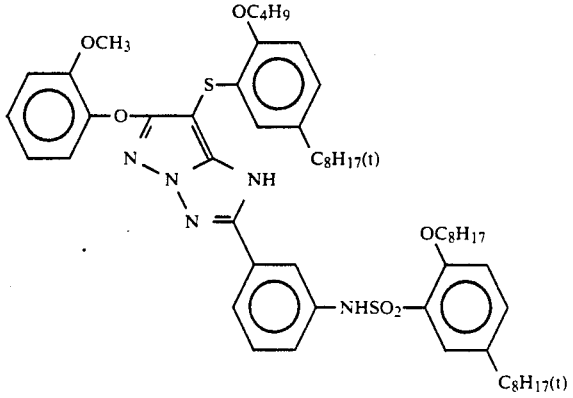

-continued (M-15)

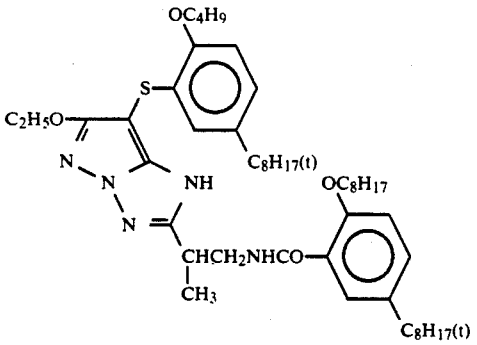

(M-16)

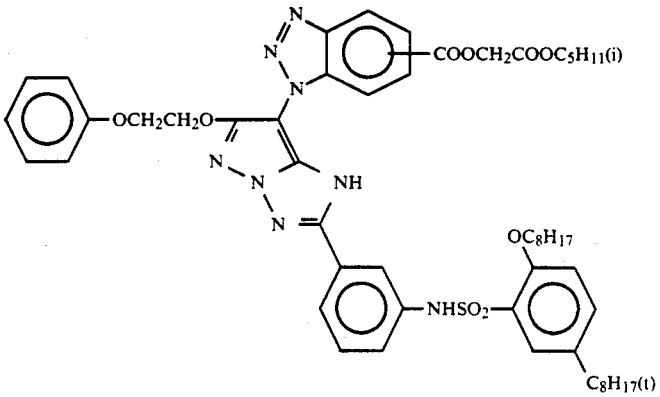

(M-17)

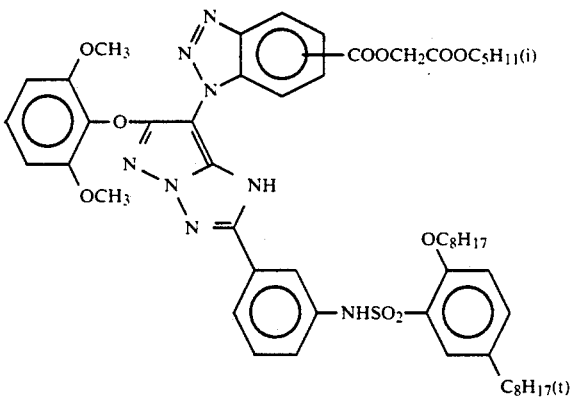

(M-18)

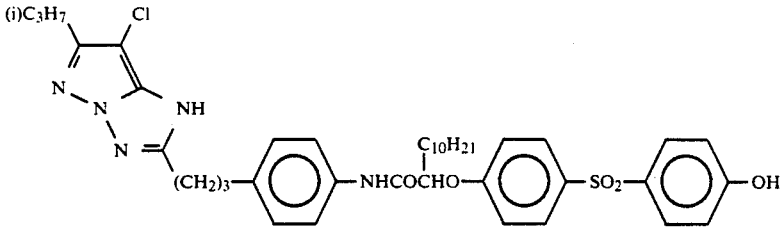

As the cyan couplers, in addition to the phenolic and naphtholic couplers for use in this invention described above, the cyan couplers described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German. Patent 3,329,729, European Patents 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658 are preferably used. Furthermore, the pyrazoloazole series couplers described in JP-A-64-553, JP-A-64-554, JP-A-64-555, and JP-A-64-556 and the imidazole series couplers described in U.S. Pat. No. 4,818,672 can also be used.

Typical examples of polymerized dye-forming couplers are described in U.S. Pat. Nos. 3,451,820, 4,080,211, 4,367,282, 4,409,320, and 4,576,910, British Patent 2,102,137, and European Patent 341,188A.

In this invention, a coupler which provides a colored dye having a proper diffusibility can be used and as such a coupler, the couplers described in U.S. Pat. No. 4,366,237, British Patent 2,125,570, European Patent 96,570, and West German Patent Application (OLS) 3,234,533 are preferably used.

As colored couplers for correcting unnecessary absorption of colored dyes, in addition to the yellow-colored cyan couplers for used in this invention, the couplers described in *Research Disclosure,* No. 17643, VII-G, ibid., No. 307105, VII-G, U.S. Pat. Nos. 4,163,670, 4,004,929, and 4,138,258, JP-B-57-39413, and British Patent 1,146,368 can preferably be used. Also, the coupler correcting the unnecessary absorption of the colored dye by the fluorescent dye released therefrom at coupling described in U.S. Pat. No. 4,774,181 and the coupler having a dye precursor group capable of forming a dye by reacting with a developing agent as a releasing group described in U.S. Pat. No. 4,777,120 can also preferably be used in this invention.

A compound releasing a photographically useful residue with coupling can also be preferably used in this invention.

Preferred DIR couplers releasing a development inhibitor are described in the patents described in *Research Disclosure,* No. 17643, VII-F and ibid., No. 307105, VII-F, JP-A-57-151944, JP-A-57-154234, JP-A-60-184248, JP A-63-37346, and JP-A-63-37350, U.S. Pat. Nos. 4,248,962 and 4,782,012.

The compounds releasing a bleach accelerator described in *Research Disclosure,* No. 11449, ibid., No. 24241, and JP-A-61-201247 are effective for shortening the processing time of a processing step having a bleaching faculty for further improving the color reproducibility, and in the case of adding the compound to the color photographic material using the foregoing tabular silver halide grains, the foregoing effect is remarkable. Examples of such compounds include the following compounds.

B-(1)

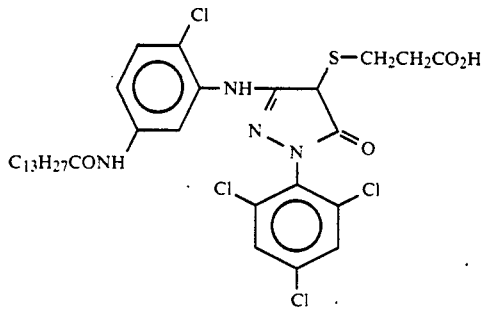

B-(2)

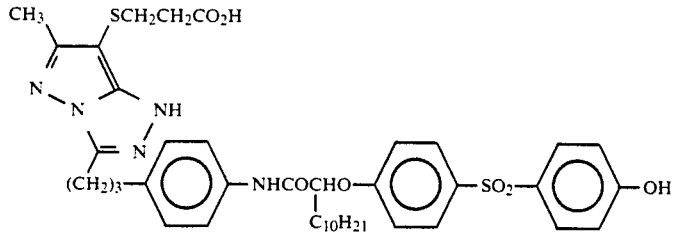

B-(3)

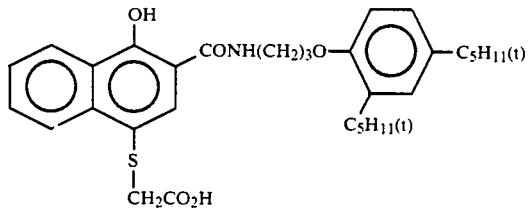

B-(4)

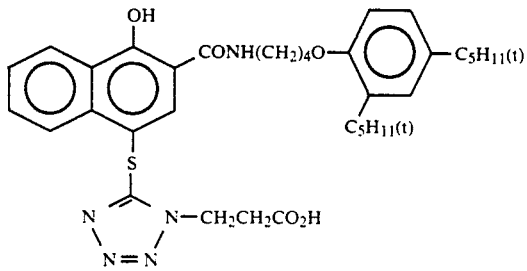

-continued
B-(5)
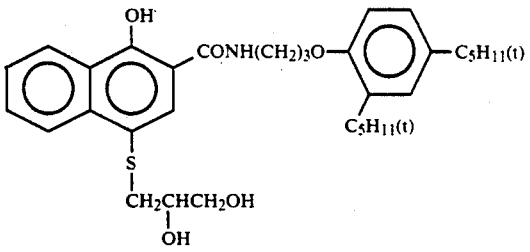
B-(6)
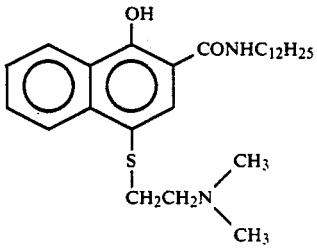
B-(7)
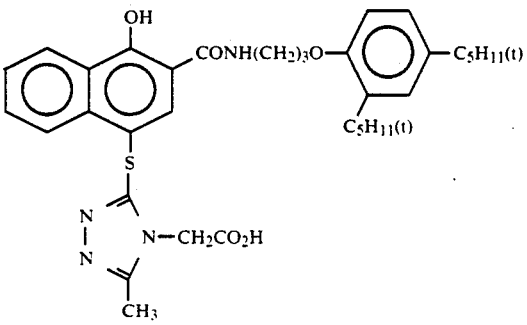
B-(8)
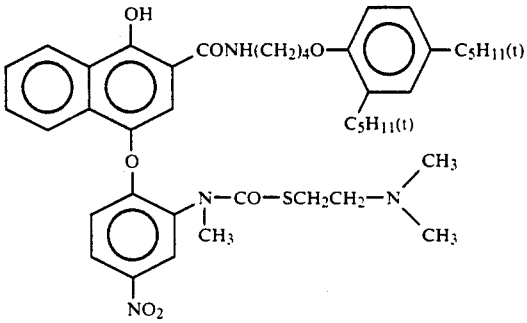
B-(9)
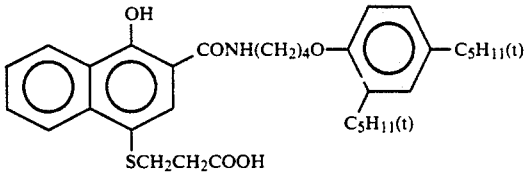
B-(10)
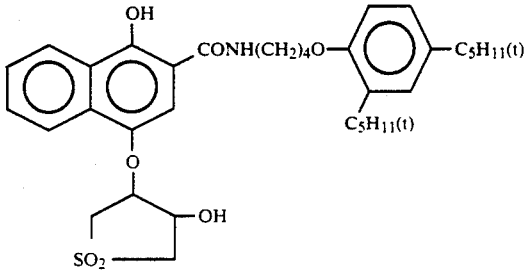

-continued
B-(11)
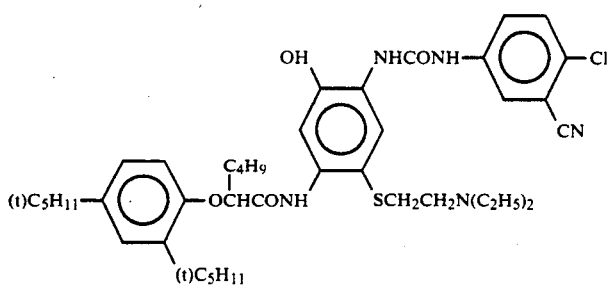
B-(12)
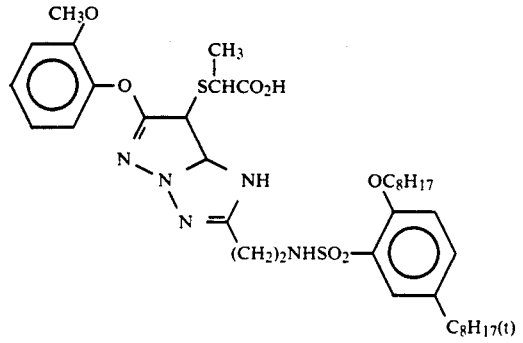
B-(13)
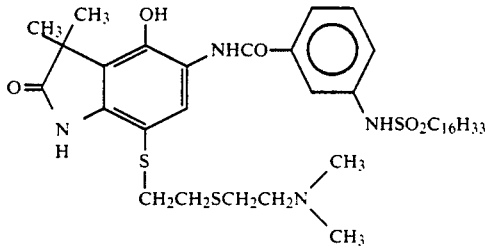
B-(14)
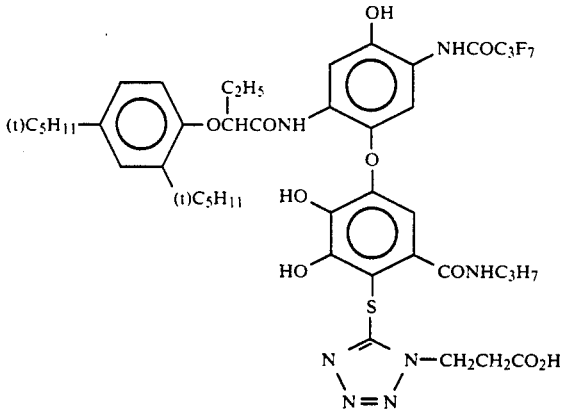
B-(15)
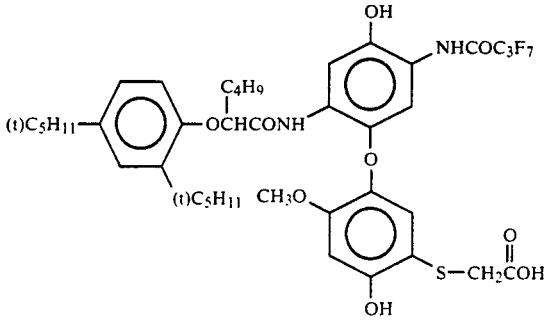

-continued
B-(16)
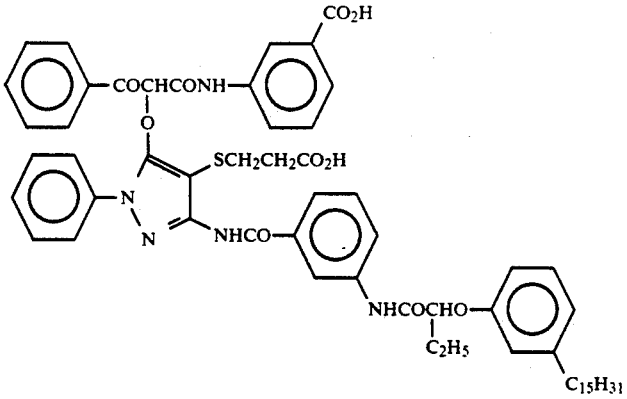
B-(17)
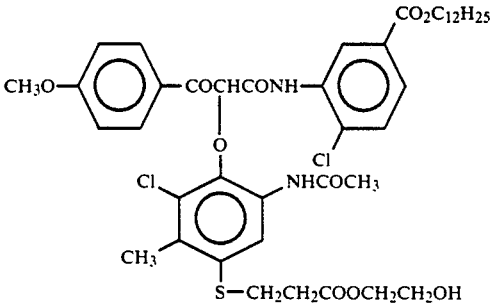
B-(18)
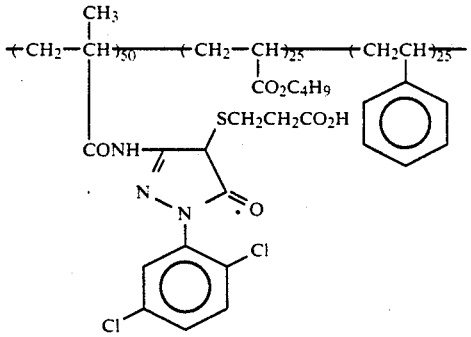
B-(19)
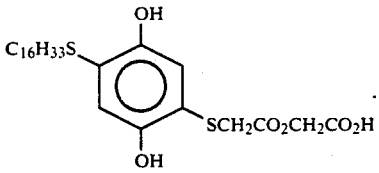
B-(20)
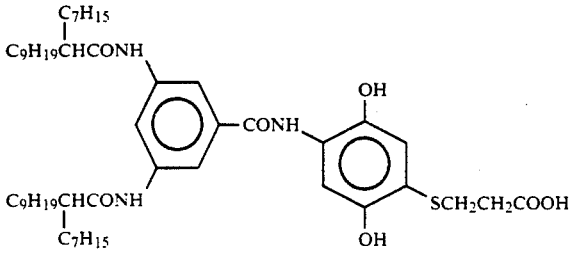

-continued

B-(21)

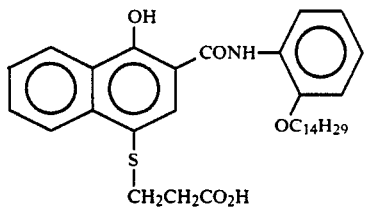

B-(22)

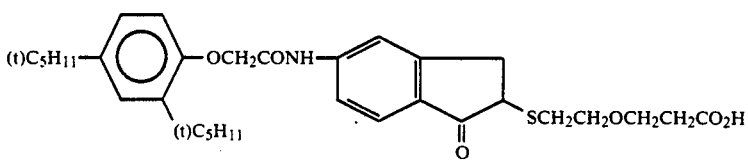

B-(23)

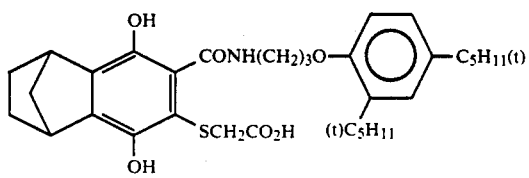

B-(24)

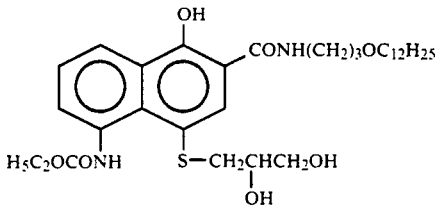

B-(25)

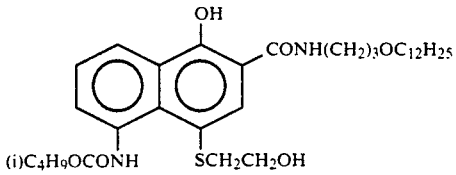

B-(26)

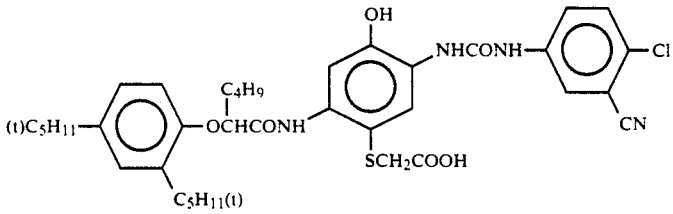

B-(27)

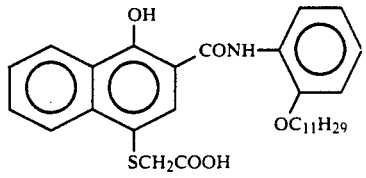

Also, the compounds releasing a fogging agent, a development accelerator, a silver halide solvent, etc., by the oxidation reduction reaction with the oxidation product of a developing agent described in JP-A-60-107029, JP-A-60-252340, JP-A-1-44940, and JP-A-1-45687 are preferably used in this invention.

Other compounds which can be used in this invention include the competing couplers described in U.S. Pat. No. 4,130,427, the poly-equivalent couplers described in U.S. Pat. Nos. 4,283,472, 4,338,393, and 4,310,618, the DIR redox compound-releasing couplers, the DIR coupler releasing couplers, the DIR coupler-releasing redox compounds, and the DIR redox-releasing redox compound described in JP-A-60-185950 and JP-A-62-24252, the couplers releasing a dye capable of recoloring after being released as described in European Patents 173,302A and 313,308A, the ligand-releasing couplers described in U.S. Pat. No. 4,555,477, and the couplers releasing a fluorescent dye described in U.S. Pat. No. 4,774,181.

The couplers for use in this invention can be introduced into the color photographic materials of this invention by various known dispersion methods.

Examples of a high-boiling solvent which are used for an oil drop-in-water dispersing method are described in U.S. Pat. No. 2,322,027. Practical examples of high-boiling organic solvents having a boiling point at normal pressure of at least 175° C., which are used for the oil drop-in-water dispersion method, include phthalic acid esters (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, and bis(1,1-diethylpropyl) phthalate), phosphoric acid esters or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphonate), benzoic acid esters (2-ethylhexyl benzoate, dodecyl benzoate, and 2-ethylhexyl-p-hydroxy benzoate), amides (N,N-diethyldodecanamide, N,N-diethyllaurylamide, and N-tetradecylpyrrolidone), alcohols and phenols (e.g., isostearyl alcohol and 2,4-di tert-amylphenol), aliphatic carboxylic acid esters (e.g., bis(2-ethylhexyl) sebacate, dioctyl azerate, glycerol butyrate, isostearyl lactate, and trioctyl citrate), aniline derivatives (e.g., N,N-dibutyl-2-butoxy-5-tert-octylaniline), and hydrocarbons (e.g., paraffin, dodecylbenzene, diisopropylnaphthalene).

Also, as an auxiliary solvent, an organic solvent having a boiling point of higher than about 30° C., and preferably from 50° C. to 160° C. can be used and typical examples thereof are ethyl acetate, butyl acetate, ethyl propionate, methyl ethyl ketone, cyclohexanone, 2-ethoxyethyl acetate, and dimethylformamide.

A latex dispersion method can be also used for introducing the couplers in this invention and practical examples of the step and effect of the latex dispersing method and latexes for impregnation are described in U.S. Pat. No. 4,199,363, West German Patent Applications (OLS) 2,541,274 and 2,541,230.

It is preferred that the color photographic light-sensitive materials of this invention contain various antiseptics or antifungal agents such as phenthyl alcohol and also 1,2-benzisothiazolin-3-one, n-butyl p-hydroxybenzoate, phenol, 4-chloro-3,5-dimethylphenol, 2-phenoxyethanol, and 2-(4-thiazolyl)benzimidazole described in JP-A-63-257747, JP-A-62-272248, and JP-A-1-80941.

The present invention can be applied to various color photographic light-sensitive materials, such as general cine color photographic negative films, color reversal photographic films for slide or television, color photographic papers, color photographic positive films, and color reversal photographic papers.

Suitable supports which can be used in this invention are described, e.g., in *Research Disclosure*, No. 17643, page 28, ibid., No. 18716, page 647, right column to page 648, left column, and ibid., No. 307105, page 879.

In the color photographic material of this invention, the sum total of the layer thicknesses of all the hydrophobic colloid layers at the side carrying the silver halide emulsion layers is preferably not thicker than 28 μm, more preferably not thicker than 23 μm, still more preferably not thicker than 18 μm, and particularly preferably not thicker than 16 μm.

Also, a film swelling rate $T_{178}$ is preferably less than 30 seconds, and more preferably less than 20 seconds. The layer thickness means a layer thickness measured at 25° C. and 55% RH (2 days) and the film swelling rate $T_{\frac{1}{2}}$ can be measured by a method known in the field of the art. For example, $T_{\frac{1}{2}}$ can be measured by using a swellometer of the type described in A. Green, *Photographic Science and Engineering*, Vol. 19, No. 2, pages 124–129. $T_{\frac{1}{2}}$ is defined as the time for reaching the thickness of ½ of a saturated film thickness, which is 90% of the maximum swollen film thickness attained when processed in a color developer at 30° C. for 3 minutes and 15 seconds.

The film swelling rate $T_{\frac{1}{2}}$ can be controlled by adding a hardening agent to gelatin as a binder or by changing the storing conditions of the color photographic material after coating.

Also, the swelling ratio is preferably from 150% to 400%. the swelling ratio can be calculated by the following formula from the maximum swollen film thickness under the aforesaid conditions:

Swelling ratio $=(A-B)/B$

A: Maximum swollen film thickness

B: Film thickness.

It is preferred that in the color photographic material of this invention, a hydrophilic colloid layer (back layer) has a total dry thickness form 2 μm to 20 μm at the opposite side of the support to the side carrying the silver halide emulsion layers. It is preferred that the back layer contains a light absorbent, a filter dye, an ultraviolet absorbent, an antistatic agent, a hardening agent, a binder, a plasticizer, a lubricant, a coating aid, a surface active agent, etc. the swelling ratio of the back layer is preferably from 150% to 500%.

The color photographic light-sensitive material of this invention can be processed by an ordinary method as described in *Research Disclosure*, No. 17643, pages 28–29, ibid., No. 18716, page 615, left column to right column, and ibid.,No. 307105, pages 880–881.

The color developer which is used for developing the color photographic light-sensitive material is preferably an alkaline aqueous solution containing an aromatic primary amine color developing agent as the main component. As the color developing agent, an aminophenol series compound is useful but a p-phenylenediamine series compound is preferably used. Typical examples thereof are 3-methyl-4-amino-N,N-diethylaniline, 3-methyl-4-amino-N-ethyl-N-β-hydroxyethylaniline. 3-methyl-4-amino-N-ethyl-N-β-methanesulfonamidoethylaniline, 3-methyl-4-amino-N-ethyl-β-methoxyethylaniline, and the sulfates, hydrochlorides or p-toluenesulfonates thereof. These compounds can be used as a combination of two or more kinds thereof according to the purpose.

The color developer generally contains a pH buffer such as the carbonates, borates, or phosphates of an alkali metal and a development inhibitor or an anti-foggant such as chlorides, bromides, iodides, benzimidazoles, benzothiazoles, and mercapto compounds. Also, if necessary, the color developer can further contain various preservatives such as hydroxylamine, diethylhydroxylamine, sulfites, hydrazines (e.g., N,N-biscarboxymethylhydrazine), phenylsemicarbazides, triethanolamine, catechol sulfonic acids, etc.; organic solvents such as ethylene glycol, diethylene glycol, etc.; development accelerators such as benzyl alcohol, polyethylene glycol, quaternary ammonium salts, amines, etc; dye-forming couplers, competing couplers; auxiliary developing agents (e.g., 1-phenyl-3-pyrazolidone), tackifiers; chelating agents such as aminopolycarboxylic acid, aminopolyphosphonic acid, alkylphosphonic acid, phosphonocarboxylic acid, etc., (e.g., ethylenediaminetetraacetic acid, nitrilotriacetic acid, diethylenetriaminepentaacetic acid, cyclohexanediaminetetraacetic acid, hydroxyethyliminodiacetic acid, 1-hyeroxyethylidene 1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and the salts of these acids).

In the case of practicing reversal processing, color development is carried out after applying an ordinary black and white development. The black and white developer can contain known black and white developing agents such as dihydroxybenzenes (e.g., hydroquinone), 3-pyrazolidones (e.g., 1-phenyl-3-pyrazolidone), and aminophenols (e.g., N-methyl-p-aminophenol) singly or in a combination thereof.

The pH of the color developer and the black and white developer is generally from 9 to 12.

Also, the amount of the replenishers for these developers depend upon the kind of the color photo graphic material being processed but is generally not more than 3 liters per square meter of the color photographic material. The amount of replenisher can be reduced below 500 ml by reducing the bromide ion concentration in the replenisher.

In the case of reducing the replenishing amount, it is preferred to prevent the evaporation and the air oxidation of the liquid by reducing the contact area of the processing liquid in the tank and air.

The contact area between the processing liquid in a tank and the air can be shown by the open ratio defined as follows.

Open ratio=[contact area ($cm^2$) of liquid and air]/[volume ($cm^3$) of liquid]

The foregoing open ratio is preferably less than 0.1, and more preferably from 0.001 to 0.05. As a method of reducing the open ratio, there is a method of placing a shielding material such as a floating lid, etc., on the surface of a processing liquid in a processing tank, a method of using a movable liquid described in JP A-1-82033, and a slit processing method described in JP-A-63-216050. The reduction of the open ratio is preferably applied not only to the steps of color development and black and white development but also to the subsequent steps of, for example, bleach, blix, fix, wash, stabilization, etc.

Also, by using a means of restraining the accumulation of bromide ions in the developer, the replenishing amount can be reduced.

The processing time for color development processing is usually selected in the range of from 2 minutes to 5 minutes but the processing time can be shortened by increasing the temperature and pH and also by increasing the concentration of a color developing agent in the color developer.

After color development, the photographic emulsion layers are usually bleached. The bleach process may be carried out simultaneously with a fix process (bleach-fix process or blix process) or may be carried out separately from the fix process.

For further quickening processing, a process of employing a blix process after a bleach process may be employed. Furthermore, a process of two blix baths connected with each other, a process of fixing before the blix process, or a process of bleaching after blixing can optionally be practiced according to the purpose.

As a bleaching agent, compounds of polyvalent metals such as iron(III), etc., peracids, quinones, nitro compounds, etc., are used. Typical examples of the bleaching agent are organic complex salts of iron(III), for example, the complex salts of aminopolycarboxylic acids such as ethylenediaminetetraacetic acid, diethylenetriaminepentaacetic acid, cyclohexanediaminetetraacetic acid, methyliminidiacetic acid, 1,3-diaminopropanetetraacetic acid, glycol ether diaminetetraacetic acid, etc., or citric acid, tartaric acid, malic acid, etc.

In these complex salts, aminopolycarboxylic acid iron(III) complex salts such as an ethylenediaminetetraacetic acid iron(III) complex salt and a 1,3-diaminopropanetetraacetic acid iron(III) complex salt are preferably used from the view point of preventing environmental pollution and quick processing. Furthermore, the aminopolycarboxylic acid iron(III) complex salt is particularly useful for a bath of a bleach solution and a blix solution. The pH of the bleach solution or the blix solution using the aminopolycarboxylic acid iron(III) complex salt is usually from 4.0 to 8 but a lower pH can be employed for quickening processing.

For the bleach solution, the blix solution and the pre-bath thereof, a bleach accelerator can be used, if necessary. Practical examples of the bleach accelerator are the compounds having a mercapto group or a disulfido group described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A 53 95631, JP-A-53-104232, JP-A-53-124424, JP-A-141623, JP-A-53-28426, *Research Disclosure,* No, 17129 (July, 1978), etc.; the thiazolidine derivatives described in JP-A-50-140129; the thiourea derivatives described in JP-B-45-8506, JP-A-52-20832, JP-A-53-32735, and U.S. Pat. No. 3,706,561; the iodides described in West German Patent 1,127,715 and JP-A-58-16235; the polyoxyethylene compounds described in West German Patents 966,410 and 2,748,430; the polyamine compounds described in JP-B-45-88361; other compounds described in JP A-49-40943, JP-A-49-59644, JP-A-53-94927, JP-A-54-35727, JP-A-55-26506, and JP-A-58 163940; and bromide ions.

In these compounds, the compounds having a mercapto group or a disulfido group are preferred from the view point of giving a large acceleration effect and in particular, the compounds described in U.S. Pat. No. 3,893,858, West German Patent 1,290,812, and JP-A-53-95630 are preferable. Furthermore, the compounds described in U.S. Pat. No. 4,552,834 are also preferred.

The bleach accelerator may be incorporated in the color photographic material. In the case of blixing a color photographic material for camera use, the use of the bleach accelerator is particularly effective.

The bleach solution or the blix solution preferably contains an organic acid for preventing the occurrence of bleach stains in addition to the foregoing additives. As the organic acid, the compounds having an acid dissociation constant (pKa) from 2 to 5 are particularly preferred and practically, acetic acid, propionic acid, hydroxyacetic acid, etc., are preferred.

As a fixing agent which is used for the fix solution or the blix solution, there are thiosulfates, thiocyanates, thioether series compounds, thioureas, a large amount of iodides, etc., but thiosulfates are generally used and in particular, ammonium thiosulfate is most widely used. Also, a combination of a thiosulfate and a thiocyanate, a thioether series compound, or a thiourea is preferably used.

The fix solution or the blix solution may contain a preservative and preferred examples of the preservative are sulfites, hydrogensulfites, carbonylhydrogen sulfite addition products, or the sulfinic acid compounds described in European Patent 294,769A. Furthermore, the fix solution or the blix solution preferably contains an aminopolycarboxylic acid or an organic phosphonic acid for stabilizing the liquid.

In this invention, for adjusting the pH of the fix solution or the blix solution, it is preferred to add thereto a compound having a pKa from 6.0 to 9.0, preferably imidazoles such as imidazole, 1-methylimidazole, 1-ethylimidazole, 2-methylimidazole, etc., in an amount of 0.1 to 10 mols/liter.

The sum of the times for the desilvering steps preferably is as short as possible in the range of causing inferior desilvering and the time is preferably from 1 minute to 3 minutes, and more preferably from 1 minute to 2 minutes. Also, the processing temperature for the desilvering steps is from 25° C. to 50° C., and preferably from 35° C. to 45° C. In the preferred temperature range, the desilvering speed is increased and the formation of stains after processing can be effectively prevented.

In the desilvering steps, it is preferred that stirring is increased. As a practical method for increasing stirring, there is a method of spraying the processing solution onto the surface of the color photographic material described in JP-A-62-183460, a method of increasing the stirring effect by using a rotary means described in JP-A-62-183461, a method of improving the stirring effect by moving the color photographic material while contacting the emulsion layer surface thereof and a wiper blade formed in the processing solution to disturb the stream on the surface of the emulsion layer, and a method of increasing the amount of the circulating steam in the whole processing solution.

The means of improving stirring is also effective in the bleach solution, the blix solution, and the fix solution. It is considered that the improvement of stirring quickens the supply of a bleaching agent and a fixing agent into the emulsion layers, which results in increasing the desilvering speed. Also, the aforesaid means of improving stirring is more effective in the case of using a bleach accelerator, whereby the acceleration effect is greatly increased and the fixing obstructing action by a bleach accelerator can be solved.

It is preferred that the automatic processor being used for processing the color photographic material of this invention has a means for transferring color photographic materials described in JP-A-60-191257, JP-A-60-191258, and JP-A-60-191259. As described in JP-A-60-191257, such a transferring means can greatly reduce the amount o the carried liquid from a pre-bath to a post bath and gives a high effect of preventing the performance of the processing solution from being deteriorated. Such effects are particularly useful for shortening the processing time in each step and reducing the replenishing amount for each processing solution.

The color photographic material of this invention is generally washed and/or stabilized after desilvering.

The amount of wash water in the wash step can be selected in a wide range according to the characteristics of the color photographic material (e.g., by the materials such as couplers, etc.), the used thereof, the temperature of wash water, the number of wash tanks, the replenishing system such was a countercurrent system, regular current system, etc., and other various conditions. In these conditions, the relation of the number of wash tanks and the amount of water in a multistage countercurrent system can be obtained by the method described in *Journal of the Society of Motion Picture and Television Engineers*, Vol. 64, 248–253 (May, 1955). According to the multistage countercurrent system described in the above literature, the amount of wash water can be greatly reduced but in this case, by the increase of the residence time of water in tanks, there occurs a problem that bacteria grow and the floats formed attach to the color photographic materials.

In processing of the color photographic materials of this invention, for solving such a problem, a method of reducing calcium ions and magnesium ions described, in JP-A-62-288838 can be very effectively used. Also, the isothiazolone compounds described in JP A-57 8542 and chlorine series fungicides such as thiabendazole, chlorinated sodium isocyanurate, etc., as well as benzotriazole, etc., and the fungicides described in Hiroshi Horiguchi, *Bookin Boobai Zai no Kaqaku (Chemistry of Antibacterial and Antifungal Agents)*, published by Sankyo Shuppan K.K., 1986, *Biseibutsu no Mekkin Sakkin Boobai Gijutsu (Antibacterial and Antifungal Technique of Microorganisms)*, edited by Eisei Gijutsu Kai, published by Kogyo Gijutsu Kai, 1982, and *Bookin Boobai Zai Jiten (Antibacterial and Antifungal Agents Handbook)*, edited by Nippon Bookin Boobai Gakkai, 1986 can be used.

The pH of the wash water in the processing of the color photographic materials of this invention is from 4 to 9, and preferably from 5 to 8. The washing temperature and washing time can be variously selected according to the characteristics and use of the color photographic material but are generally from 15° to 45° C. for from 10 minutes to 20 seconds, and preferably from 25° to 40° C. for from 5 minutes to 30 seconds.

Furthermore, the color photographic material of this invention can be directly stabilized in place of washing. For such as stabilization process, the known methods described in JP-A-57-8543, JP-A-58-14834, and JP-A-60-220345 can be used.

Also, as the case may be, stabilization processing is applied after aforesaid wash processing and as an example thereof, there is a stabilization bath containing a dye stabilizer and a surface active agent, which is used as the final bath for a color photographic material for in camera use. As the dye stabilizer, there are aldehydes such as formalin, glutalaldehyde, etc., N-methylol compounds, hexamethylenetetramine, and aldehydesulfite addition products. The stabilization bath can also contain various chelating agents and antifungal agents.

The overflow liquid obtained while replenishing the replenishers for wash water and/or the stabilization solution can be reused in the desilvering steps, etc.

In the case of using an automatic processor, when each processing solution is concentrated by evaporation, it is preferred to add water to correct the concentration.

The silver halide color photographic material of this invention may contain a color developing agent for simplifying and quickening processing. For the purpose, the used of the various precursors for the color developing agent is preferred. As such precursors, there are indoaniline series compounds described in U.S. Pat. No. 3,342,597, the Schiff base type compounds desoribed in U.S. Pat. No. 3,342,599, *Research Disclosure*, No. 14850, and ibid., No. 15159, the aldol compounds described in *Research Disclosure*, No. 13924, the metal complexes described in U.S. Pat. No. 3,719,492, and the urethane series compounds described in JP-A-53-135628.

If necessary, the color photographic material of this invention may contain various 1-phenyl-3-pyrazolidones for accelerating the color development. Typical examples of the compound are described in JP-A-56-64339, JP-A-57-144547 and JP-A-58-115438.

In this invention, each processing solution is used at a temperature from 10° C. to 50° C. Usually a temperature from 33° C. to 38° C. is standard but a higher temperature may be employed for accelerating processing or a lower temperature may be employed for improving the image quality and the stability of the processing solution.

Also, the color photographic material of this invention can be applied to the heat developable light-sensitive materials described in U.S. Pat. No. 4,500,626, JP-A-60-133449, JP-A-59-218443, JP-A-61-238056, and European Patent 210,660A2.

The present invention is further described in detail by referring to the following examples but the invention is not limited to them.

EXAMPLE 1

A multilayer color photographic material (Sample 101) was prepared by forming multilayers each having the following composition on a cellulose triacetate film having a subbing layer.

Composition of Layers

The numeral for each component shows the coating amount by a g/m$^2$ unit, and with respect to the silver halide emulsion, the coating amount of silver calculated is shown. The coating amount of a sensitizing dye is shown by mol unit per mol of the silver halide in the same layer.

| | |
|---|---|
| Layer 1 (Antihalation Layer) | |
| Black Colloidal Silver | 0.18 as Ag |
| Gelatin | 1.40 |
| Layer 2 (Interlayer) | |
| 2,5-Di-t-pentadecylhydroquinone | 0.18 |
| EX-1 | 0.18 |
| Ex-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS 2 | 0.020 |
| Gelatin | 1.04 |
| Layer 3 (1st Red-Sensitive Emulsion Layer) | |
| Emulsion A | 0.25 |
| Emulsion B | 0.25 |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Cyan Coupler (C-7) in the Invention | 0.17 |
| EX-10 | 0.020 |
| Cyan Coupler (C-10) in the Invention | 0.17 |
| HBS-1 | 0.010 |
| Gelatin | 0.70 |
| Layer 4 (2nd Red-Sensitive Emulsion Layer) | |
| Emulsion G | 0.80 |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Cyan Coupler (C-7) in the Invention | 0.20 |
| EX-3 | 0.050 |
| EX-10 | 0.015 |
| Cyan Coupler (C-10) in the Invention | 0.20 |

-continued

| | |
|---|---|
| EX-15 | 0.050 |
| Gelatin | 0.85 |
| Layer 5 (3rd Red-Sensitive Emulsion Layer) | |
| Emulsion D | 1.2 |
| Sensitizing Dye I | $5.4 \times 10^{-5}$ |
| Sensitizing Dye II | $1.4 \times 10^{-5}$ |
| Sensitizing Dye II | $2.4 \times 10^{-4}$ |
| Cyan Coupler (C-7) in the Invention | 0.097 |
| EX-3 | 0.010 |
| Cyan Coupler (C-34) in the Invention | 0.800 |
| HBS-1 | 0.220 |
| HBS-2 | 0.10 |
| Gelatin | 1.63 |
| Layer 6 (Interlayer) | |
| EX-5 | 0.040 |
| HBS-1 | 0.020 |
| Gelatin | 0.80 |
| Layer 7 (1st Green-Sensitive Emulsion Layer) | |
| Emulsion A | 0.15 |
| Emulsion B | 0.15 |
| Sensitizing Dye IV | $3.0 \times 10^{-5}$ |
| Sensitizing Dye V | $1.0 \times 10^{-4}$ |
| Sensitizing Dye VI | $3.8 \times 10^{-4}$ |
| EX-1 | 0.021 |
| Preferred Magenta Coupler (P-7) | 0.26 |
| EX-7 | 0.030 |
| EX-8 | 0.004 |
| HBS-1 | 0.10 |
| HBS-3 | 0.010 |
| Gelatin | 0.63 |
| Layer 8 (2nd Green-Sensitive Emulsion Layer) | |
| Emulsion C | 0.40 |
| Sensitizing Dye IV | $2.1 \times 10^{-5}$ |
| Sensitizing Dye V | $7.0 \times 10^{-5}$ |
| Sensitizing Dye VI | $2.6 \times 10^{-4}$ |
| Preferred Magenta Coupler (P-7) | 0.094 |
| EX-7 | 0.026 |
| EX-8 | 0.003 |
| HBS-1 | 0.16 |
| HBS-3 | $8.0 \times 10^{-3}$ |
| Gelatin | 0.50 |
| Layer 9 (3rd Green-Sensitive Emulsion Layer) | |
| Emulsion E | 1.00 |
| Sensitizing Dye IV | $3.5 \times 10^{-5}$ |
| Sensitizing Dye V | $8.0 \times 10^{-5}$ |
| Sensitizing Dye VI | $3.0 \times 10^{-4}$ |
| EX-1 | 0.013 |
| EX-11 | 0.065 |
| EX-13 | 0.019 |
| HBS-1 | 0.05 |
| HBS-2 | 0.05 |
| Gelatin | 1.00 |
| Layer 10 (Yellow Filter Layer) | |
| Yellow Colloidal Silver | 0.050 as Ag |
| Yellow-5 | 0.080 |
| HBS-1 | 0.030 |
| Gelatin | 0.95 |
| Layer 11 (1st Blue-Sensitive Emulsion Layer) | |
| Emulsion A | 0.080 |
| Emulsion B | 0.070 |
| Emulsion F | 0.070 |
| Sensitizing Dye VII | $3.5 \times 10^{-4}$ |
| EX-8 | 0.008 |
| EX-9 | 0.37 |
| HBS-1 | 0.28 |
| Gelatin | 1.40 |
| Layer 12 (2nd Blue-Sensitive Emulsion Layer) | |
| Emulsion G | 0.40 |
| Sensitizing Dye VII | $2.1 \times 10^{-4}$ |
| EX-9 | 0.11 |
| EX-10 | $7.0 \times 10^{-3}$ |
| HBS-1 | 0.040 |
| Gelatin | 0.78 |
| Layer 13 (3rd Blue-Sensitive Emulsion Layer) | |
| Emulsion H | 0.60 |
| Sensitizing Dye VII | $2.2 \times 10^{-4}$ |
| EX-9 | 0.15 |
| HBS-1 | 0.050 |
| Gelatin | 0.69 |
| Layer 14 (1st Protective Layer | |

-continued

| | |
|---|---|
| Emulsion I | 0.20 |
| U-4 | 0.11 |
| U-5 | 0.17 |
| HBS-1 | $5.0 \times 10^{-2}$ |
| Gelatin | 1.00 |
| Layer 15 (2nd Protective Layer) | |
| H-1 | 0.40 |
| CB-1 (diameter 1.7 μm) | $5.0 \times 10^{-2}$ |
| CB-2 (diameter 1.7 μm) | 0.10 |
| CB-3 | 0.10 |
| S-1 | 0.20 |
| Gelatin | 0.80 |

Furthermore, each of the layers further contained W-1, W-2, W-3, CB-4, CB-5, F-1, F-2, F-3, F-4, F-5, F-6, F-7, F-8, F-9, F-10, F-11, F-12, F-13, and an iron salt, a lead salt, a gold salt, a platinum salt, an iridium salt, and a rhodium salt for improving the storage stability, processing property, pressure resistance, antifungal property, antibacterial property, antistatic property and coating property.

The silver halide emulsions used for the samples are shown in Table 7 below.

TABLE 7

| Emulsion | AgI Content (%) | Mean Grain Size (μm) | Variation Coefficient of Grain Sizes (%) | Aspect Ratio | Silver Amount Ratio (AgI Content %) |
|---|---|---|---|---|---|
| A | 4.0 | 0.45 | 15 | 1 | Core/Shell = ⅓ (13/1), Double Structure Grains |
| B | 8.9 | 0.70 | 14 | 1 | Core/Shell = 3/7 (25/2), Double Structure Grains |
| C | 10 | 0.75 | 15 | 5 | Core/Shell = ½ (24/3), Double Structure Grains |
| D | 16 | 1.05 | 16 | 6 | Core/Shell = 4/6 (40/0), Double Structure Grains |
| E | 10 | 1.05 | 20 | 8 | Core/Shell = ½ (24/3), Double Structure Grains |
| F | 4.0 | 0.25 | 18 | 7 | Core/Shell = ⅓ (13/1), Double Structure Grains |
| G | 14.0 | 0.75 | 17 | 3 | Core/Shell = ½ (42/0), Double Structure Grains |
| H | 14.5 | 1.30 | 15 | 5 | Core/Shell = 37/63 (34/3), Double Structure Grains |
| I | 1 | 0.07 | 15 | 1 | Uniform Grains |

Samples 102 to 106

By replacing EX-9 in Layer 11 of Sample 101 with 1.5 mol times of RY-1 and increasing the amount of gelatin in the layer to 1.5 times, Sample 102 was prepared. Also, by replacing EX-9 in Layer 11 with 1.2 mol % of RY-2 and increasing the amount of gelatin in the layer to 1.2 times, Sample 103 was prepared. Furthermore, by replacing EX-9 in Layer 11 with 0.9 molar times of each of couplers (1), (41), (44), and (46) of this invention, respectively, and changing the amount of gelatin in the layer to 0.85 times, Samples 104 to 107 were prepared.

Samples 108 to 114

In Samples 101 to 107, C-7 in Layer 3, Layer 4, and Layer 5 was replaced with an equimolar amount of EX-2, C-10 in Layer 3 and Layer 5 was replaced with an equimolar amount of EX-14, and C-34 in Layer 5 was replaced with an equimolar amount of EX-4, Samples 108 to 114 were prepared.

Samples 115

In Sample 107, each half of the amounts of C-7 and C-10 in Layer 3 and Layer 4 was replaced with B-25 and B-21, respectively to provide Sample 115.

Samples 116

In Sample 107, P-7 of Layer 7 and Layer 8 was replaced with 1.5 mol times of EX-6 and the amount of gelatin in the layers was increased to 1.2 times to provide sample 116.

Each sample was prepared by simultaneously coating the 15 layers.

The scratching film strength by a sapphire needle having a diameter of 0.05 mm was almost the same in each sample (the coating amount of gelatin was controlled such that the film strength became almost the same in each sample).

Each of the samples was imagewise exposed with white light and immediately processed by the following steps using an automatic processor. The development was carried out at two different temperatures of 38.8° C. and 40.0° C. In the experiments other than the processing temperature dependence, the development was all carried out at 38.8° C.

Also, with respect to the sharpness of each sample, the MTF value of a cyan image at 25 cycle/mm was obtained by a conventional MTF method.

Each sample processed at 38.8° C. was allowed to stand for 10 days under the conditions of 70° C., 69% RH, and the reduced density at a yellow density of 2.0 and a cyan density of 1.0 was obtained, which was used as the measure of the color image fastness.

Furthermore, each of the samples was similarly imagewise exposed with white light, then, allowed to stand for 7 days under the conditions of 45° C., 80% RH, developed, and the colored density deviations of the sample developed immediately after exposure in the exposure amount at a yellow density of 2.0 and a cyan density of 1.0 are shown in Table 8 and Table 9 below.

TABLE 8

| Sample | | Coupler in Layers 3, 4, 5 | Coupler in Layer 11 | Coupler in Layer 7, 8 | Gamma Cyan Image 38.8° | Gamma Cyan Image 40.0° | Gamma Yellow Image 38.8° | Gamma Yellow Image 40.0° |
|---|---|---|---|---|---|---|---|---|
| 101 | (Comparison) | C-7/C-10/C-34 | EX-9 | P-7 | 0.62 | 0.66 | 0.66 | 0.68 |
| 102 | ( " ) | " | RY-1 | " | 0.60 | 0.64 | 0.63 | 0.66 |
| 103 | ( " ) | " | RY-2 | " | 0.60 | 0.64 | 0.62 | 0.66 |
| 104 | (Invention) | " | (1) | " | 0.65 | 0.67 | 0.66 | 0.68 |
| 105 | ( " ) | " | (41) | " | 0.65 | 0.67 | 0.65 | 0.67 |
| 106 | ( " ) | " | (44) | " | 0.65 | 0.67 | 0.66 | 0.68 |
| 107 | ( " ) | " | (46) | " | 0.65 | 0.67 | 0.66 | 0.68 |
| 108 | (Comparison) | EX-2/EX-4/EX-14 | EX-9 | " | 0.62 | 0.66 | 0.66 | 0.68 |
| 109 | ( " ) | " | RY-1 | " | 0.60 | 0.64 | 0.63 | 0.66 |
| 110 | ( " ) | " | RY-2 | " | 0.59 | 0.64 | 0.62 | 0.66 |
| 111 | ( " ) | " | (1) | " | 0.65 | 0.67 | 0.66 | 0.68 |
| 112 | ( " ) | " | (41) | " | 0.65 | 0.67 | 0.65 | 0.67 |
| 113 | ( " ) | " | (44) | " | 0.65 | 0.67 | 0.66 | 0.68 |
| 114 | ( " ) | " | (46) | " | 0.65 | 0.67 | 0.65 | 0.67 |
| 115 | (Invention) | C-7/C-10/C-34/B-25/B-26 | (") | " | 0.66 | 0.68 | 0.65 | 0.67 |
| 116 | ( " ) | C-7/C-10/C-34 | (") | EX-6 | 0.63 | 0.66 | 0.64 | 0.67 |

TABLE 9

| Sample | | MTF Value | Color Image Fastness (Lowered density) Cyan | Color Image Fastness (Lowered density) Yellow | Density Deviation Under Forced Deteriorating Condition Cyan | Density Deviation Under Forced Deteriorating Condition Yellow |
|---|---|---|---|---|---|---|
| 101 | (Comparison) | 0.53 | 0.01 | 0.14 | 0.03 | 0.02 |
| 102 | ( " ) | 0.51 | 0.01 | 0.04 | 0.03 | 0.04 |
| 103 | ( " ) | 0.50 | 0.01 | 0.35 | 0.03 | 0.04 |
| 104 | (Invention) | 0.56 | 0.01 | 0.03 | 0.03 | 0.02 |
| 105 | ( " ) | 0.56 | 0.01 | 0.03 | 0.03 | 0.02 |
| 106 | ( " ) | 0.56 | 0.01 | 0.03 | 0.03 | 0.02 |
| 107 | ( " ) | 0.56 | 0.01 | 0.03 | 0.03 | 0.02 |
| 108 | (Comparison) | 0.53 | 0.25 | 0.16 | 0.15 | 0.04 |
| 109 | ( " ) | 0.51 | 0.26 | 0.06 | 0.17 | 0.05 |
| 110 | ( " ) | 0.50 | 0.26 | 0.37 | 0.17 | 0.05 |
| 111 | ( " ) | 0.56 | 0.23 | 0.05 | 0.15 | 0.04 |
| 112 | ( " ) | 0.56 | 0.23 | 0.05 | 0.15 | 0.04 |
| 113 | ( " ) | 0.56 | 0.23 | 0.05 | 0.15 | 0.04 |
| 114 | ( " ) | 0.56 | 0.23 | 0.05 | 0.15 | 0.04 |
| 115 | (Invention) | 0.56 | 0.01 | 0.03 | 0.05 | 0.03 |
| 116 | ( " ) | 0.54 | 0.02 | 0.04 | 0.03 | 0.03 |

The processing steps employed were as follows.

| Step | Processing steps: Processing Time | Processing Temp | Replenishing | Tank Volume |
|---|---|---|---|---|
| Color Development | 3 min. 15 sec. or 3 min. 15 sec. | 38.8° C. or 40.0° C. | 45 ml | 10 l |
| Bleach | 45 sec. | 38.8° C. | 5 ml | 5 l |
| Fix (1) | 45 sec. | 38.8° C. | — | 5 l |
| Fix (1) | 45 sec. | 38.8° C. | 30 ml | 5 l |
| Stabilization (1) | 20 sec. | 38.8° C. | — | 5 l |
| Stabilization (2) | 20 sec. | 38.8° C. | — | 5 l |
| Stabilization (3) | 20 sec. | 38.8° C. | 40 ml | 5 l |
| Drying | 1 min. | 55° C. | | |

The replenishing amount was 35 mm×1 meter.

The fix was a countercurrent system from (2) to (1).

The stabilization was a countercurrent system from (3) to (1).

In addition, the amount carried over from the developer into the bleach step and the amount carried over from the fix solution into the stabilization step were 2.5 ml and 2.0 ml, respectively per 35 mm×1 meter of the color photographic material.

Then, the composition of each processing solution was described below.

| Color developer | Tank | Replenisher |
|---|---|---|
| Diethylenetriaminepenta-acetic Acid Penta-sodium Salt | 6.5 g | 8.0 g |
| Sodium Sulfite | 4.0 g | 5.0 g |
| Potassium Carbonate | 40.0 g | 50.0 g |
| Potassium Bromide | 1.3 g | 0.5 g |
| Potassium Iodide | 1.2 mg | — |
| 4-[N-Ethyl-N-β-hydroxy-ethyl amino]-2-methyl-aniline Sulfate | 4.7 g | 6.2 g |
| Water to make | 1.0 liter | 1.0 liter |
| pH | 10.50 | 10.70 |
| **Bleach Solution** | **Tank** | **Replenisher** |
| 1,3-Diaminopropanetetra-acetic Acid Ferric Ammonium-Hydrate | 144.0 g | 206.0 g |
| 1,3-Diaminopropanetetra-acetic Acid | 2.8 g | 4.0 g |
| Ammonium Bromide | 84.0 g | 120.0 g |
| Ammonium Nitrate | 17.5 g | 25.0 g |
| Aqueous Ammonia (27%) | 10.0 g | 1.8 g |
| Acetic Acid (98%) | 51.1 g | 73.0 g |
| Water to make | 1 liter | 1 liter |
| pH | 4.3 | 3.4 |
| **Fix Solution Tank liquid = Replenisher** | | |
| Ethylenediaminetetraacetic Acid Di-sodium Salt | | 1.7 g |
| Sodium Sulfite | | 14.0 g |
| Sodium Hydrogensulfite | | 10.0 g |
| Aqueous Ammonium Thiosulfate Solution (70% weight/volume) | | 210.0 ml |
| Ammonium Thiocyanate | | 163.0 g |
| Thiourea | | 1.8 g |
| Water to make | | 1 liter |
| pH | | 6.5 |
| **Stabilization Solution Tank liquid = Replenisher** | | |
| Surface Active Agent ($C_{10}H_{21}$-O-($CH_2CH_2O$)$_{10}$-H) | | 0.4 g |
| Triethanolamine | | 2.0 g |
| 1,2-Benzisothazilin-3-one methanol | | 0.3 g |
| Formalin (37%) | | 1.5 g |
| Water to make | | 1 liter |
| pH | | 6.5 |

From the results shown in Table 8 and Table 9 above, it is clear the samples of this invention have less processing temperature dependence of the photographic performance, are excellent in the sharpness shown by the MTF value and the color image fastness, and also are excellent in the storage stability of the color photographic materials before processing.

Also, it can be seen that these effects are more remarkable when the magenta coupler is a polymer coupler.

EXAMPLE 2

Sample 201 was prepared by following the same procedure as for preparing Sample 101 in Example 1 except that the amount of silver in each light-sensitive silver halide emulsion layer was increased to 10% and also the amount of EX 8 in Layer 7, Layer 8, and Layer 11 was increased to 8 times.

Also, Samples 202 to 204 were prepared by replacing EX-8 in Layer 7, Layer 8, and Layer 11 of Sample 201 with an equimolecular amount of RY-3, coupler (4), and coupler (42) of this invention, respectively.

Samples 205 to 208 were prepared by replacing coupler C-7 in Layer 3, Layer 4, and Layer 5 of each the Samples 201 to 204 with an equimolecular amount of EX-2, coupler C-10 in these layers with an equimolecular amount of EX-14, and Coupler C-34 in these layers with an equimolar amount of EX-4, respectively.

Also, Samples 209 to 211 were prepared by replacing EX-9 in Layer 11 and Layer 12 of Sample 204 with each of couplers (41), (44) and (46) of this invention, respectively.

Each of the samples was subjected to an imagewise exposure to white light and processed as in Example 1. The samples were allowed to stand for 14 days under the conditions of 60° C., 70% RH and the samples were irradiated with a fluorescent lamp of 2,000 lux from the support side for 7 days, and the reduced densities at a yellow density of 2.0 and at a cyan density of 1.0 were measured.

The results obtained are shown in Table 10 below.

From the results shown in Table 10, it can be seen that the samples of this invention are excellent in color image storage stability under high-temperature and high-humidity conditions and under light irradiation.

TABLE 10

| | Sample | Coupler in Layers 7, 8, 11 | Coupler in Layer 11, 12 | Coupler in Layer 3, 4, 5 | Color Image Fastness (Lowered density) 60° C. 70% Cyan | 60° C. 70% Yellow | Fluorescent Lamp Cyan | Fluorescent Lamp Yellow |
|---|---|---|---|---|---|---|---|---|
| 201 | (Comparison) | EX-8 | EX-9 | C-7/C-10/C-34 | 0.00 | 0.22 | 0.02 | 0.27 |
| 202 | ( " ) | RY-3 | " | " | 0.00 | 0.18 | 0.02 | 0.25 |
| 203 | (Invention) | (4) | " | " | 0.00 | 0.08 | 0.02 | 0.09 |
| 204 | ( " ) | (42) | " | " | 0.00 | 0.08 | 0.02 | 0.09 |
| 205 | (Comparison) | EX-8 | " | EX-2/EX-14/EX-4 | 0.18 | 0.25 | 0.11 | 0.29 |
| 206 | ( " ) | RY-3 | " | " | 0.18 | 0.21 | 0.11 | 0.27 |
| 207 | ( " ) | (4) | " | " | 0.18 | 0.12 | 0.11 | 0.11 |
| 208 | ( " ) | (42) | " | " | 0.18 | 0.12 | 0.11 | 0.11 |
| 209 | (Invention) | " | (41) | C-7/C-10/C-34 | 0.00 | 0.03 | 0.02 | 0.05 |
| 210 | ( " ) | " | (44) | " | 0.00 | 0.03 | 0.02 | 0.05 |
| 211 | ( " ) | " | (46) | " | 0.00 | 0.03 | 0.02 | 0.05 |

EXAMPLE 3

Samples 301 to 316 were prepared by following the same procedure as for preparing Samples 101 to 116 in Example 1 except that EX-5 in Layer 5 was replaced by an equimolar amount of Compound B-(23) which releases a desilvering accelerating agent, and evaluated in the same manner as described in Example 1.

As a result of the evaluations, Samples 304, 307, 315 and 316 according to the present invention were found to have less processing dependence, excellent sharpness and fastness of color images, and excellent storage stability of the photographic material prior to development. Also, Samples 301 to 316 were found to have low remaining silver amount after processing and excellent desilvering and color reproducibility, even when the bleaching time in the processing steps described in Example 1, i.e., 45 seconds, was shortened to 30 seconds.

The compounds used in the foregoing examples are shown hereinbelow.

EX-1

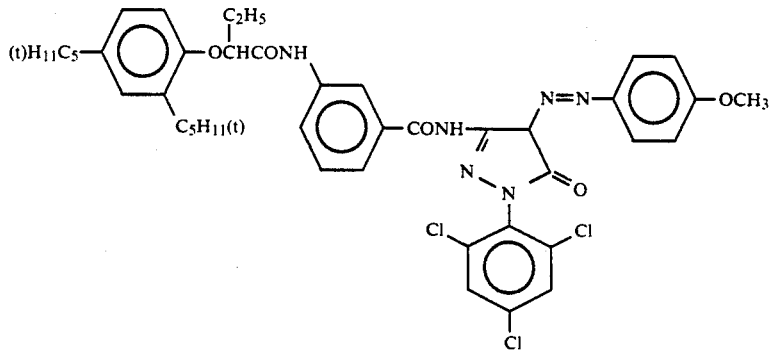

EX-2

-continued
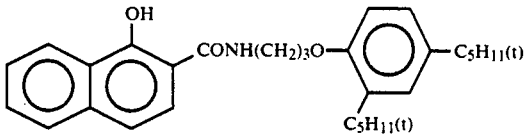
EX-3
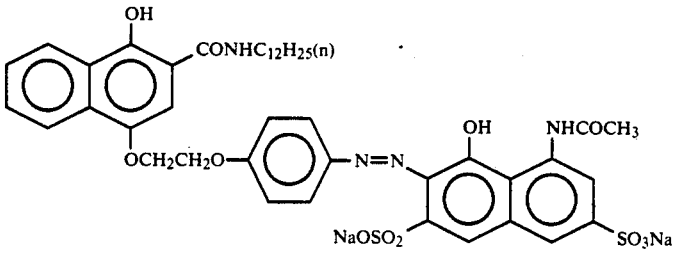
EX-4
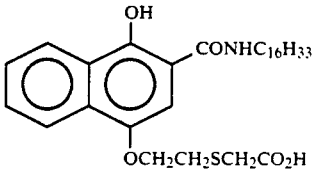
EX-5
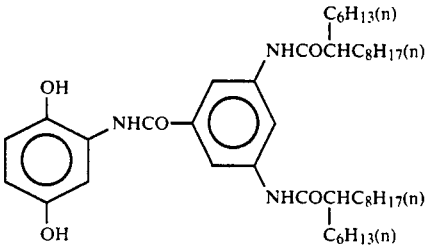
EX-6
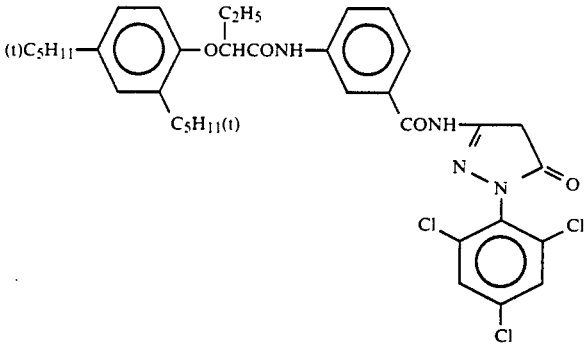
EX-7
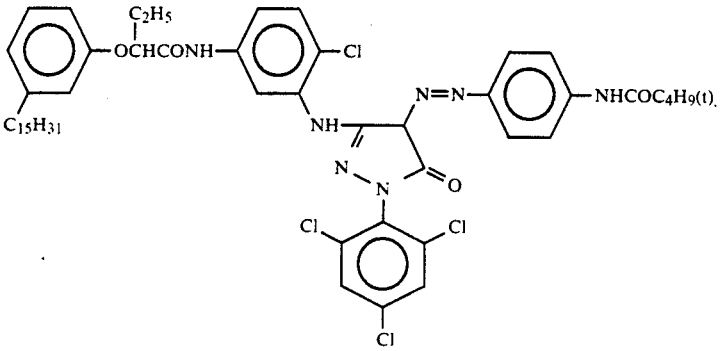

-continued
EX-8 (Coupler included in those described in JP-A-52-69624 and JP-A-57-151974)
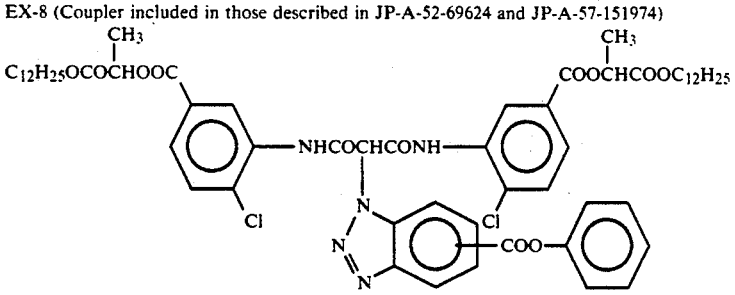
EX-9 (Compound 1 described in Research Disclosure No. 18053)
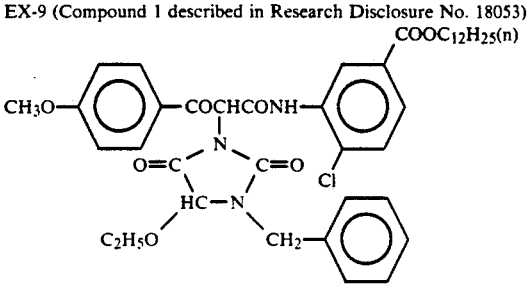
EX-10
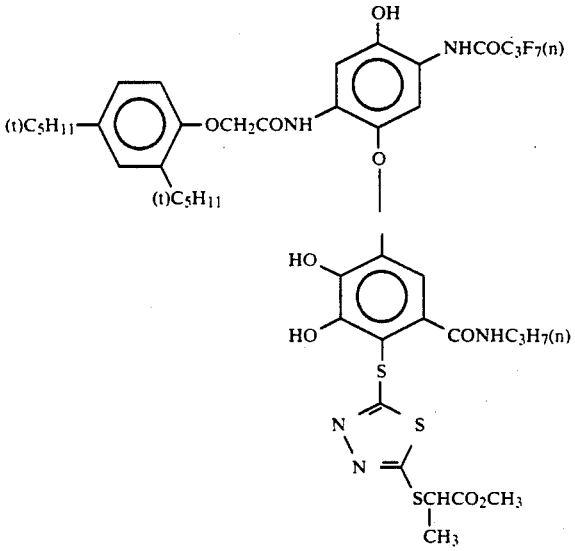
EX-11 (Same as M-19)
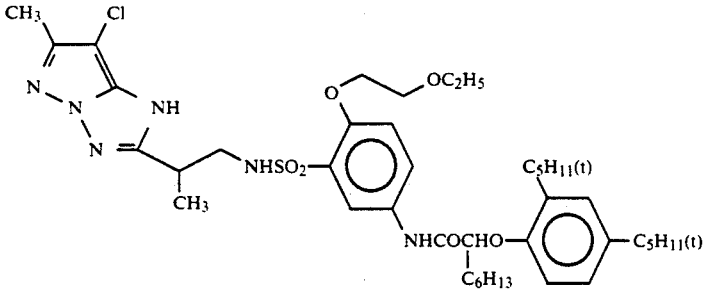
EX-12
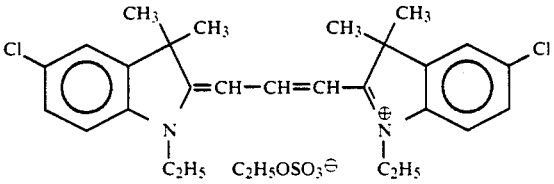

-continued
EX-13 (same as M-20)
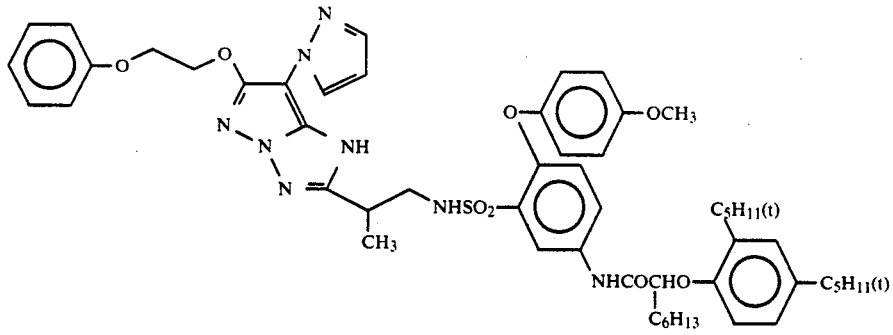
EX-14
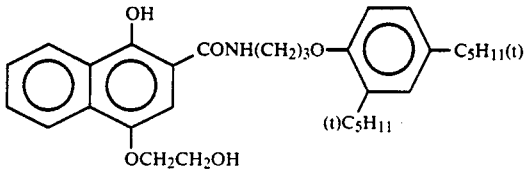
EX-15
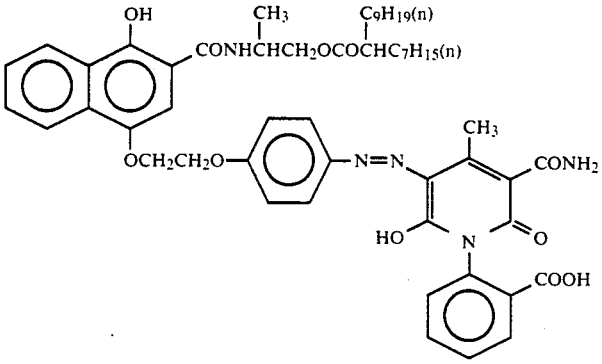
U-1
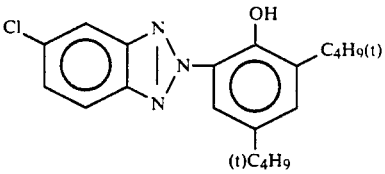
U-2
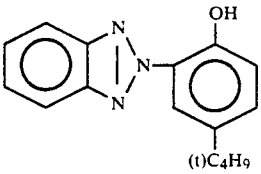
U-3
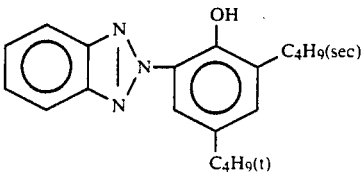
U-4

-continued
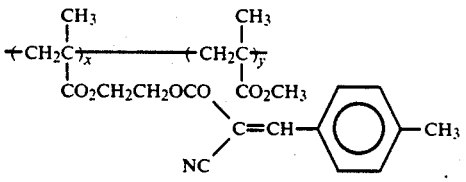
x:y = 70:30 (wt%)
U-5
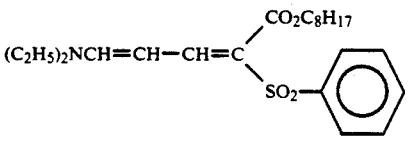
HBS-1
Tricresyl Phosphate
HBS-2
Di-n-butyl Phthalate
HBS-3
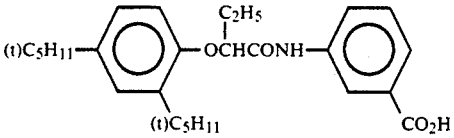
Sensitizing Dye I
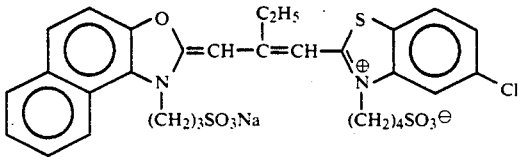
Sensitizing Dye II
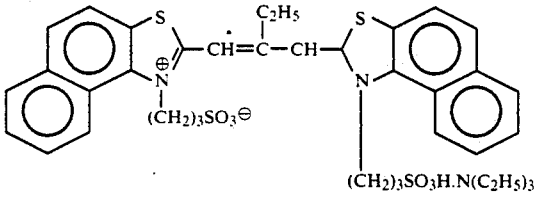
Sensitizing Dye III
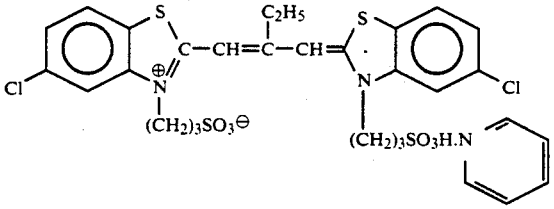
Sensitizing Dye IV
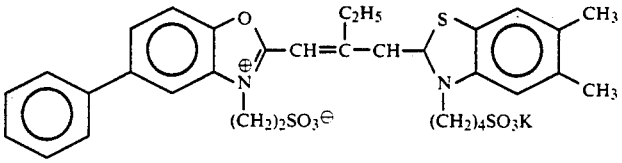
Sensitizing Dye V -continued
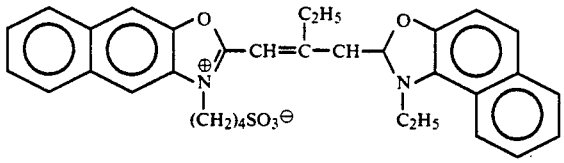
Sensitizing Dye VI
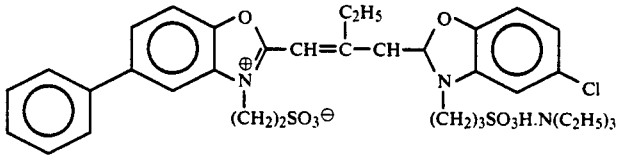
Sensitizing Dye VII
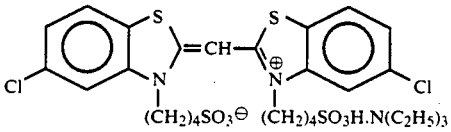
S-1
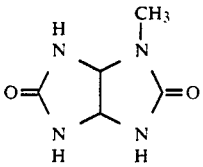
H-1
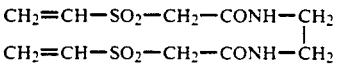
CB-1
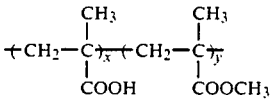
x/y = 10/90
CB-2
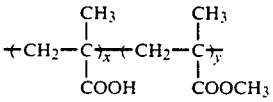
x/y = 40/60
CB-3
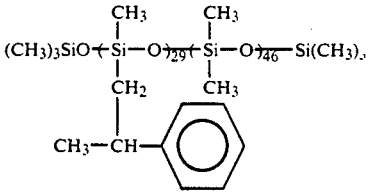
CB-4
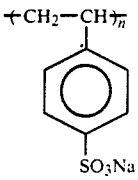
CB-5

-continued
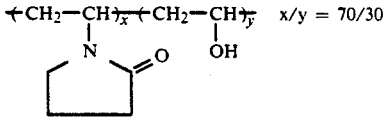
W-1
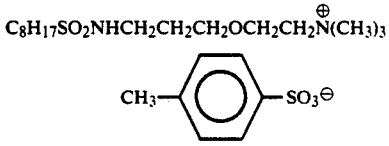
W-2
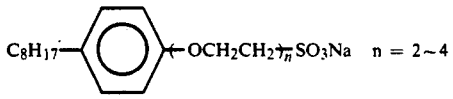
W-3
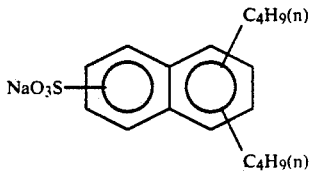
F-1
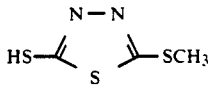
F-2
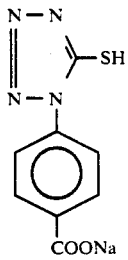
F-3
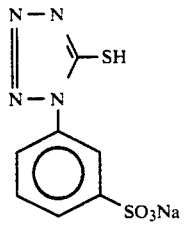
F-4
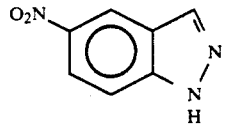
F-5
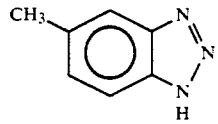

-continued
F-6
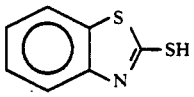
F-7
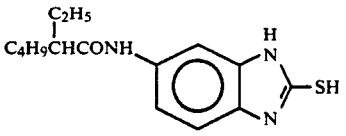
F-8
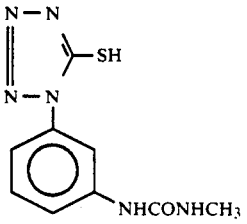
F-9
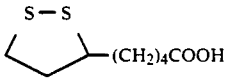
F-10
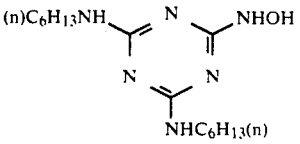
F-11
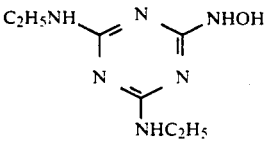
F-12
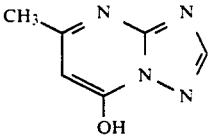
F-13
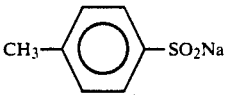
RY-1 (Compound 14 or Research Disclosure, No. 18053)
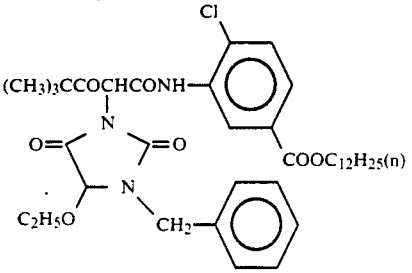

-continued

RY-2 (Coupler similar to the couplers described in British Patent 1,204,680 and JP-A-52-69624)

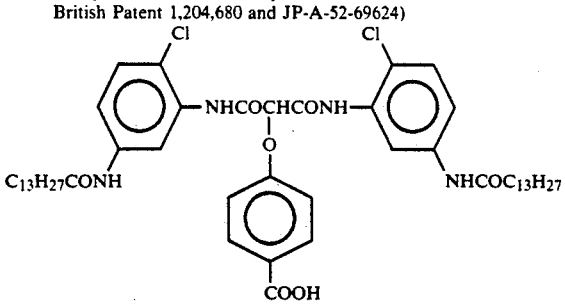

RY-3 (DIR coupler Cp-14 of JP-A-2-212837)

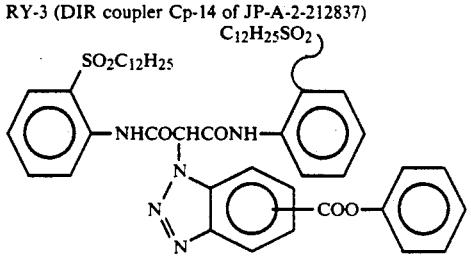

As described above, according to this invention, a color photographic light-sensitive material is obtained which is excellent in image storage stability, sharpness, processing dependence, and color reproducibility and showing less deviation of photographic performance during the storage thereof.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having at least one light-sensitive silver halide emulsion layer or light-insensitive layer on a support, wherein the light-sensitive silver halide emulsion layer or a light-insensitive layer contains a yellow coupler selected from the group consisting of a yellow coupler represented by the following formula (I), a yellow coupler represented by the following formula (II) and combinations thereof, and a cyan coupler selected from the group consisting of a phenolic cyan coupler having a phenylureido group at the 2-position and a carbonamido group at the 5-position, a naphtholic cyan coupler having an amino group at the 5-position and combinations thereof;

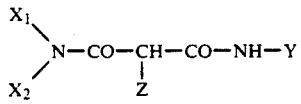

(I)

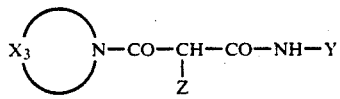

(II)

wherein $X_1$ and $X_2$ each represents an alkyl group, an aryl group, or a heterocyclic group; $X_3$ represents an organic group capable of forming a nitrogen-containing heterocyclic group with >N—; Y represents an aryl group or a heterocyclic group; and Z represents a group capable of being released at the reaction of the coupler shown by the foregoing formula and an oxidation product of a developing agent.

2. The silver halide color photographic material of claim 1, wherein the layer contains a polymer coupler.

3. The silver halide color photographic material of claim 1, wherein $X_1$ and $X_2$ each represents a straight chain, branched or cyclic, saturated or unsaturated, substituted or unsubstituted alkyl group having from 1 to 30 carbon atoms.

4. The silver halide color photographic material of claim 1, wherein $X_1$, $X_2$ and Y each represents a 3- to 12-membered saturated or unsaturated, substituted or unsubstituted, a monocyclic or condensed ring heterocyclic group having from 1 to 20 carbon atoms, and containing at least one nitrogen, oxygen, or sulfur atom as the hetero-atom.

5. The silver halide color photographic material of claim 1, wherein $X_1$ and $X_2$ each represents a substituted or unsubstituted aryl group having from 6 to 20 carbon atoms.

6. The silver halide color photographic material of claim 1, wherein $X_3$ is an organic residue forming a nitrogen-containing heterocyclic group together with >N— and the nitrogen-containing heterocyclic group is a 3- to 12-membered, substituted or unsubstituted, saturated or unsaturated, monocyclic or condensed ring heterocyclic group having from 1 to 20 carbon atoms.

7. The silver halide color photographic material of claim 1, wherein Y represents a substituted or unsubstituted aryl group having from 6 to 20 carbon atoms.

8. The silver halide color photographic material of claim 1, wherein $X_1$ is an alkyl group having from 1 to 10 carbon atoms.

9. The silver halide color photographic material of claim 1, wherein Y is phenyl group having at least one substituent at the ortho-position.

10. The silver halide color photographic material of claim 1, wherein the yellow couplers represented by formulae (I) and (II) are couplers represented by the following formulae (III), (IV), or (V):

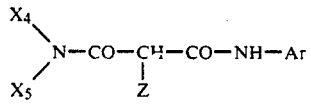
(III)

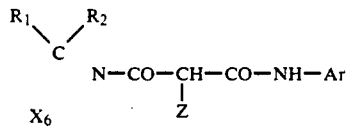
(IV)

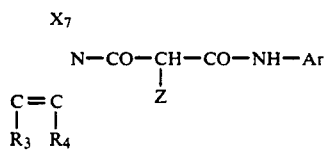
(V)

wherein in the above formulae, Z and Ar have the same meaning as described above in formula (I); $X_4$ represents an alkyl group; $X_5$ represents an alkyl group or an aromatic group; Ar represents a phenyl group having at least one substituent at the ortho-position; $X_6$ represents an organic residue forming a nitrogen-containing heterocyclic group (monocyclic or condensed ring) together with $—C(R_1R_2)—N<$; $X_7$ represents an organic residue forming a nitrogen-containing heterocyclic group (monocyclic or condensed ring) together with $—C(R_3)=C(R_4)—N<$; and $R_1$, $R_2$, $R_3$, and $R_4$ each represents a hydrogen atom or a substituent.

11. The silver halide color photographic material of claim 10, wherein the yellow couplers are the couplers represented by formula (IV) or (V).

12. The silver halide color photographic material of claim 10, wherein the yellow couplers are the couplers represented by formula (V).

13. The silver halide color photographic material of claim 1, wherein the total amount of the yellow coupler to be added in the color photographic light-sensitive material is from 0.0001 to 0.80 g/m$^2$ when the releasing group shown by Z contains a photographically useful group or component.

14. The silver halide color photographic material of claim 1, wherein the total amount of the yellow coupler to be added is from 0.001 to 1.20 g/m$^2$ when the releasing group Z does not contain a photo graphically useful group or component.

15. The silver halide color photographic material of claim 1, wherein the phenol series cyan coupler having a phenylureido group at the 2-position and a carbonamido group at the 5-position is represented by the following formula (B):

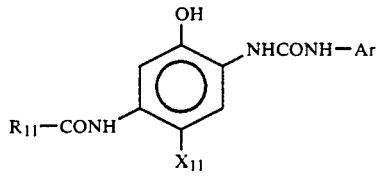
(B)

wherein $R_{11}$ represents an aliphatic group, an aromatic group, or a heterocyclic group; Ar represents an aromatic group; and $X_{11}$ represents a hydrogen atom or a group capable of being released by a coupling reaction with the oxidation product of an aromatic primary amine color developing agent.

16. The silver halide color photographic material of claim 14, wherein $R_{11}$ represents an aliphatic group having from 1 to 36 carbon atoms, an aromatic group having from 6 to 36 carbon atoms, or a heterocyclic group having from 2 to 36 carbon atoms.

17. The silver halide color photographic material of claim 14, wherein $R_{11}$ is a tertiary alkyl group having from 4 to 36 carbon atoms or a group having from 7 to 36 carbon atoms and represented by the following formula (B');

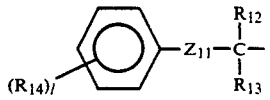
(B')

wherein $R_{12}$ and $R_{13}$, which may be the same or different, each represents a hydrogen atom, an aliphatic group having from 1 to 30 carbon atoms, or an aromatic group having from 6 to 30 carbon atoms; $R_{14}$ represents a monovalent group; $Z_{11}$ represents —O—, —S—, —SO—, or —$SO_2$—; and l represents an integer from 0 to 5 and when $R_{14}$ is plural, plural $R_{14}$s may be the same or different.

18. The silver halide color photographic material of claim 16, wherein $R_{12}$ and $R_{13}$ each represents a branched alkyl group having from 1 to 18 carbon atoms; $R_{14}$ represents a halogen atom, an aliphatic group, an aliphatic oxy group, a carbonamido group, a sulfonamido group, a carboxy group, a sulfo group, a cyano group, a hydroxy group, a carbamoyl group, a sulfamoyl group, an aliphatic oxycarbonyl group, or an aromatic sulfonyl group; and $Z_{11}$ represents —O—; $R_{14}$ has from 0 to 30 carbon atoms and l is from 1 to 3.

19. The silver halide color photographic material of claim 14, wherein Ar represents a substituted or unsubstituted aryl group and may be a condensed ring.

20. The silver halide color photographic material of claim 14, wherein the amount of the cyan coupler shown by formula (B) which may be added is in the range from $1.0\times10^{-5}$ mol to $3.0\times10^{-3}$ mol, per square meter of the color photographic light-sensitive material.

21. The silver halide color photographic material of claim 1, wherein the naphthol series cyan coupler having an amino group at the 5-position is represented by the following formula (C):

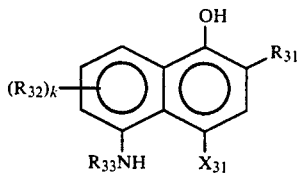
(C)

wherein $R_{31}$ represents —$CONR_{34}R_{35}$, —$SO_2NR_{34}R_{35}$, —$NHCOR_{34}$, —$NHCOOR_{36}$, —$NHSO_2R_{36}$, —$NHCONR_{34}R_{35}$ or —$NHSO_2NR_{34}R_{35}$; $R_{32}$ represents a group capable of being substituted to the naphthalene ring; k represents an integer of from 0 to 3; $R_{33}$ represents a substituent; $X_{31}$ represents a hydrogen atom or a group capable of being released by the coupling reaction with the oxidation product of an aromatic primary amine developing agent; $R_{34}$ and $R_{35}$, which may be the same or different, each represents a hydrogen atom, an alkyl group, an aryl group, or a heterocyclic group and $R_{36}$ represents an alkyl group, an aryl group, or a heterocyclic group.

* * * * *